US008161580B2

(12) United States Patent
Hashidume et al.

(10) Patent No.: US 8,161,580 B2
(45) Date of Patent: Apr. 24, 2012

(54) SANITARY WASHING TOILET SEAT DEVICE AND TOILET DEVICE

(75) Inventors: Kenji Hashidume, Fukuoka-ken (JP); Hideki Takada, Fukuoka-ken (JP); Michinori Yananose, Fukuoka-ken (JP); Nobutake Sakumoto, Fukuoka-ken (JP)

(73) Assignee: Toto Ltd, Fukuoka (JP)

( * ) Notice: Subject to any disclaimer, the term of this patent is extended or adjusted under 35 U.S.C. 154(b) by 563 days.

(21) Appl. No.: 12/278,932

(22) PCT Filed: Feb. 9, 2007

(86) PCT No.: PCT/JP2007/052415

§ 371 (c)(1),
(2), (4) Date: Dec. 23, 2008

(87) PCT Pub. No.: WO2007/091691

PCT Pub. Date: Aug. 16, 2007

(65) Prior Publication Data

US 2010/0162475 A1 Jul. 1, 2010

(30) Foreign Application Priority Data

Feb. 10, 2006 (JP) ..... 2006-034531
Feb. 21, 2006 (JP) ..... 2006-043846
May 30, 2006 (JP) ..... 2006-150744

(51) Int. Cl.
*A47K 3/20* (2006.01)
*A47K 4/00* (2006.01)
*E03D 9/08* (2006.01)

(52) U.S. Cl. ..... 4/420.4; 4/444; 4/447

(58) Field of Classification Search ..... 4/420.4, 4/420.2, 420.1, 433, 444, 447, 448, 420
See application file for complete search history.

(56) References Cited

U.S. PATENT DOCUMENTS 4,136,407 A * 1/1979 Maurer ..... 4/448
4,551,868 A * 11/1985 Kawai et al. ..... 4/443

(Continued)

FOREIGN PATENT DOCUMENTS

JP 58-29945 A 2/1983

(Continued)

OTHER PUBLICATIONS

Attached is a machine translated version of Mizoguchi et al.*

(Continued)

*Primary Examiner* — Brian Glessner
*Assistant Examiner* — Brian D Mattei
(74) *Attorney, Agent, or Firm* — Pearne & Gordon LLP

(57) ABSTRACT

A sanitary washing toilet seat device according to the invention comprises a nozzle head having a water discharge port; a first cylinder capable of housing at least part of the nozzle head; a second cylinder capable of housing at least part of the first cylinder; and a driver configured to advance or retract at least one of the nozzle head and the first and second cylinder. The driver includes a flexible rack with one end connected to the nozzle head; a motor; and a transmission mechanism configured to transmit rotation of the motor to the flexible rack. At least one of the nozzle head and the first and second cylinder is advanced or retracted in accordance with the rotation of the motor. In a sanitary washing toilet seat device and a toilet device equipped therewith, a multistage washing nozzle can be accurately advanced/retracted.

14 Claims, 46 Drawing Sheets

U.S. PATENT DOCUMENTS

| | | | | | |
|---|---|---|---|---|---|
| 4,628,548 | A | * | 12/1986 | Kurosawa et al. | 4/420.4 |
| 5,050,249 | A | * | 9/1991 | Takeda et al. | 4/443 |
| 5,208,922 | A | * | 5/1993 | Machinaga et al. | 4/448 |
| 5,765,238 | A | * | 6/1998 | Furukawa et al. | 4/420.4 |
| 6,477,720 | B2 | * | 11/2002 | Tomita et al. | 4/420.4 |
| 6,754,912 | B1 | * | 6/2004 | Hayashi et al. | 4/420.2 |
| 7,484,251 | B2 | * | 2/2009 | Huang | 4/420.4 |
| 2008/0047055 | A1 | * | 2/2008 | Lim | 4/447 |
| 2008/0052813 | A1 | * | 3/2008 | Kwon et al. | 4/420.4 |

FOREIGN PATENT DOCUMENTS

| | | | | |
|---|---|---|---|---|
| JP | 59-102031 | A | | 6/1984 |
| JP | 60-68855 | A | | 4/1985 |
| JP | 3-33816 | A | | 2/1986 |
| JP | 61-32267 | A | | 2/1986 |
| JP | 01-100509 | | | 7/1989 |
| JP | 02061231 | A | * | 3/1990 |
| JP | 02-213534 | A | | 8/1990 |
| JP | 03250127 | A | * | 11/1991 |
| JP | 09-078661 | A | | 3/1997 |
| JP | 3042429 | A | | 8/1997 |
| JP | 11071800 | A | * | 3/1999 |
| JP | 11-120814 | A | | 4/1999 |
| JP | 11-324072 | A | | 11/1999 |
| JP | 2000-309973 | A | | 11/2000 |
| JP | 2001132053 | A | * | 5/2001 |
| JP | 2002-161568 | A | | 6/2002 |
| JP | 2002-242484 | A | | 8/2002 |
| JP | 2002-307334 | A | | 10/2002 |
| JP | 2006-249862 | A | | 9/2006 |
| TW | 291012 | A | | 11/1996 |

OTHER PUBLICATIONS

Previously attached is a machine translated version of Mizoguchi et al.*

The definition of the term "diaphragm" is included in the Office Action and was downloaded from http://www.thefreedictionary.com/diaphragm.*

International Search Report for PCT-2007/052415, dated May 7, 2007.

Japanese Office action for JP 2006-043846 dated Jul. 13, 2009.

Taiwanese Office action for 096104669 dated Oct. 26, 2010.

* cited by examiner

FIG. 44A
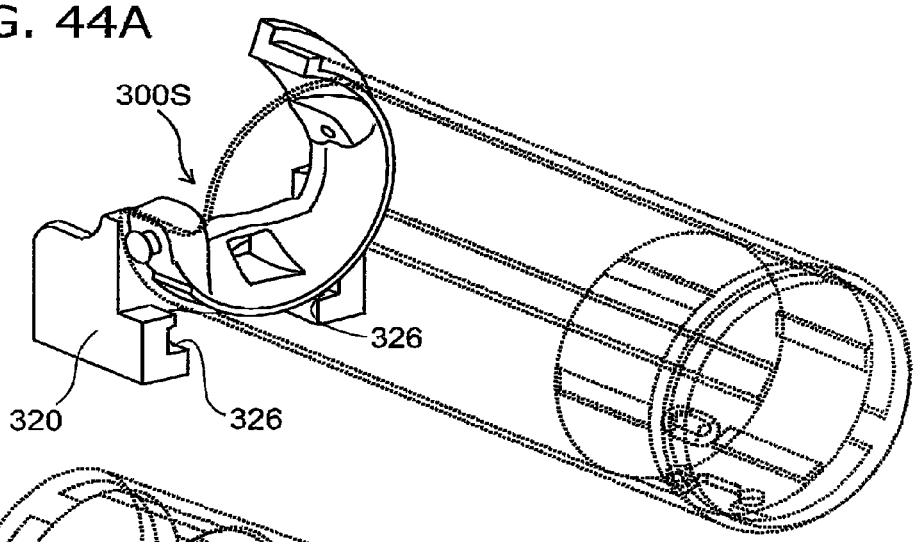
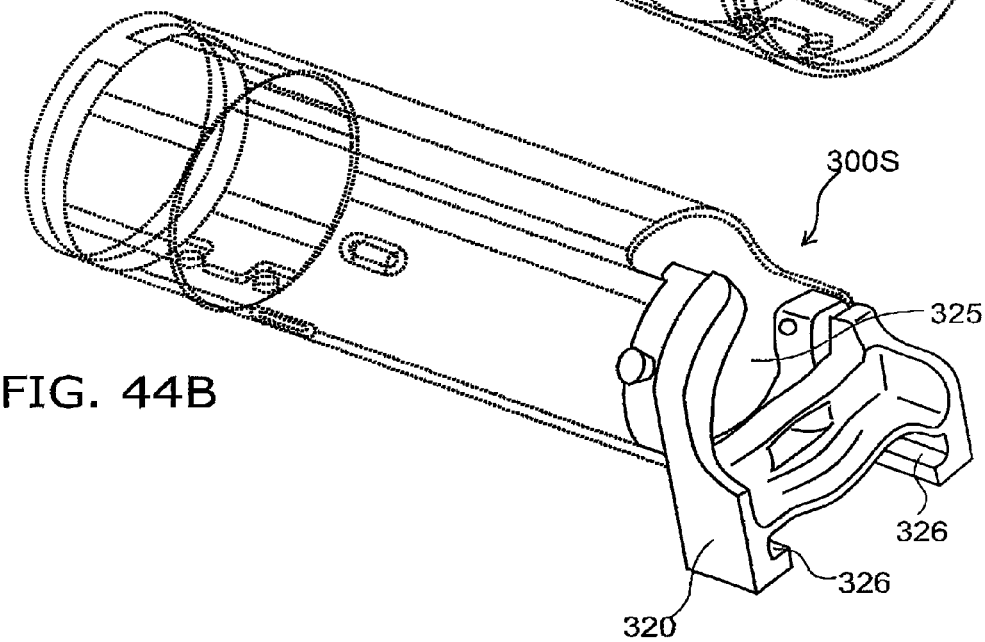
FIG. 44B

SANITARY WASHING TOILET SEAT DEVICE AND TOILET DEVICE

TECHNICAL FIELD

This invention relates to a sanitary washing toilet seat device and a toilet device, and more particularly to a sanitary washing toilet seat device for washing the "bottom" and the like of a user sitting on a sit-down toilet bowl, and to a toilet device equipped therewith.

BACKGROUND ART

A sanitary washing toilet seat device retractably houses therein a washing nozzle for squirting wash water, and hence, in the mainstream configuration, it is installed for use on the rear upper surface of a sit-down toilet bowl. For the purpose of improving the cleanability of such a sanitary washing toilet seat device, its downsizing is under study. More specifically, a smaller depth dimension of the sanitary washing toilet seat device allows the portion overlying the bowl of the sit-down toilet bowl to be reduced, saving trouble to clean the backside of the sanitary washing toilet seat device overlying the bowl. Furthermore, a smaller height of the sanitary washing toilet seat device allows the soiled area to be reduced, also facilitating cleaning.

To downsize the sanitary washing toilet seat device, the dimension of the washing nozzle in the housed state needs to be decreased. As a structure for decreasing the dimension of the washing nozzle in the housed state, the multistage structure is desirable. As an extension/retraction mechanism of the multistage washing nozzle, use of water pressure and a wire is disclosed, for example (Patent Document 1).

On the other hand, as an extension/retraction mechanism of the washing nozzle, also disclosed is a structure in which a leaf spring is wound around a drum rotated by a motor and is advanced/retracted by the rotation of the motor to extend/retract the nozzle (Patent Document 2).

Patent Document 1: Japanese Unexamined Utility Model Application Publication No. 61-32267

Patent Document 2: Japanese Unexamined Patent Application Publication No. 59-102031

DISCLOSURE OF INVENTION

Problems to be Solved by the Invention

However, in the case of using water pressure as disclosed in Patent Document 1, the nozzle needs to be liquid-tight. Furthermore, it is difficult to independently control the water discharge pressure and the extending/retracting motion of the nozzle. These problems are particularly serious in the multistage washing nozzle.

On the other hand, in the structure extended/retracted by a leaf spring as disclosed in Patent Document 2, for a long stroke, the drum for winding the leaf spring needs to be enlarged. Furthermore, there is also room for improvement in that the leaf spring is likely to undergo "flexure", which makes it difficult to accurately control the advancing distance of the washing nozzle by the rotation of the motor.

This invention has been made in view of the above problems, and provides a sanitary washing toilet seat device provided with a mechanism capable of accurately advancing/retracting a multistage washing nozzle, and a toilet device equipped therewith.

Solution to the Problems

According to an aspect of the invention, there is provided a sanitary washing toilet seat device including: a nozzle head having a water discharge port; a first cylinder capable of housing at least part of the nozzle head; a second cylinder capable of housing at least part of the first cylinder; and a driver configured to advance or retract at least one of the nozzle head and the first and second cylinder, the driver including: a flexible rack with one end connected to the nozzle head; a motor; and a transmission mechanism configured to transmit rotation of the motor to the flexible rack, and at least one of the nozzle head and the first and second cylinder being advanced or retracted in accordance with the rotation of the motor.

According to another aspect of the invention, there is provided a toilet device including: a sit-down toilet bowl; and the sanitary washing toilet seat device as mentioned above.

BRIEF DESCRIPTION OF DRAWINGS

FIGS. 6A and 6B are schematic views illustrating the positional relationship between the disengaging portion 630 and the flexible rack 610, in which FIG. 6A is a partial plan view as viewed from above, and FIG. 6B is a side view as viewed from direction A of FIG. 6A.

FIGS. 9A to 9C are schematic views illustrating the structure of the engaging mechanism 330, in which FIG. 9A is a front view as viewed from its nozzle tip side, FIG. 9B is a cross-sectional view taken along line A-A of FIG. 9A, and FIG. 9C is a cross-sectional view taken along line B-B of FIG. 9A.

FIGS. 31A to 30D are schematic partial cross-sectional views showing the retracting motion of the washing nozzle.

FIGS. 44A and 44B are perspective views of the stopper 320 of the second cylinder 300 as viewed from two directions.

DESCRIPTION OF REFERENCE NUMERALS

Figure 1A:
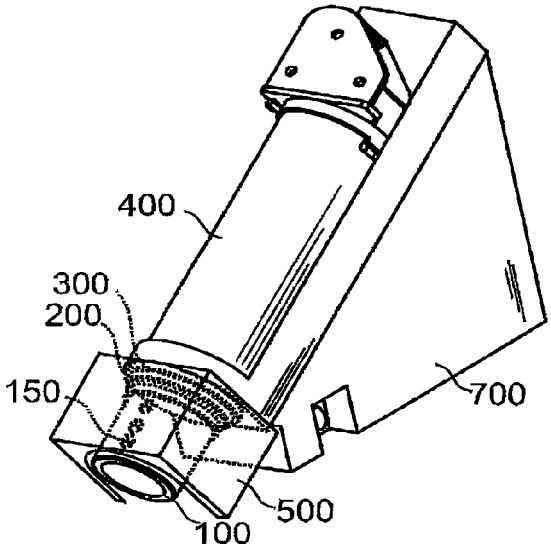
FIGS. 1A and 1B are schematic perspective views of a washing nozzle portion provided in a sanitary washing toilet seat device of an embodiment of the invention.

100 nozzle head
120 stopper
121 extending portion
121S outer peripheral wall
122 projection
124 depression
150, 150A~150C water discharge port
152, 154,156 water flow path
160 switching mechanism
162 stator
164 rotor
166 water channel opening
170 motor
172 output shaft
174 partition plate
176 packing
180, 180A, 180B, 180C water supply tube
182 water channel
184 distribution chamber
186, 186A, 186B, 186C water supply terminal
190 electrical wire harness
200, 300, 400 cylinder
210, 310, 410 slider
210S inner peripheral wall
212, 312 depression
220, 320 stopper
222, 322 projection
224 depression
225, 225A, 225B, 225C, 225D through hole
230, 330 engaging mechanism
240, 340 coll spring
250, 350 latch
300S notch
304 engaging thread
325 through hole
326 depression
331 frame
332, 334 through hole
500 nozzle cleaning chamber, 510 water channel
520, 522, 526 water discharge port
530 through hole
550 support
600 driving portion
610 flexible rack
612 guide portion
620 driving unit
622 motor
624 gear
630 disengaging portion
700 base
710 rail
720 protective wall
800 sanitary washing toilet seat device body
800P extending portion
805 front face
810 toilet seat

820 toilet lid
825 shutter plate
830 seating sensor
850 deodorizer
860 water channel system
862 valve unit
863 heat exchange unit
864 flow control unit
870 warm air dryer
880 control board
900 sit-down toilet bowl

BEST MODE FOR CARRYING OUT THE INVENTION

An embodiment of the invention will now be described with reference to the drawings.

Figure 1B:
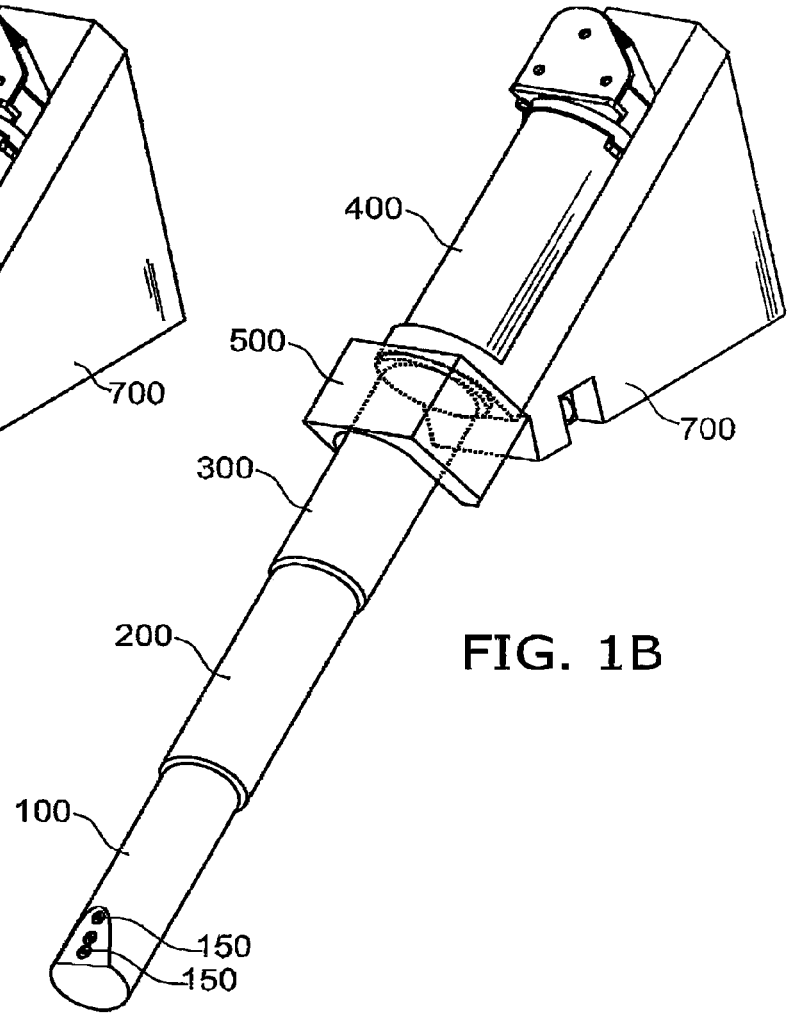

FIG. 1 is a schematic perspective view of a washing nozzle portion provided in a sanitary washing toilet seat device of the embodiment of the invention. More specifically, FIG. 1A shows the housed state of the washing nozzle, and FIG. 1B shows its extended state.

FIG. 2 is a schematic partial cross-sectional view showing the retracting motion of this washing nozzle, in which FIGS. 2A to 2D are schematic views of the washing nozzle as viewed from above.

This washing nozzle is of the three-stage type, including a nozzle head 100, a first cylinder 200, a second cylinder 300, and a third cylinder 400. This example includes a three-stage washing nozzle, that is, a washing nozzle having three movable portions. However, the invention is not limited thereto, but encompasses multistage washing nozzles having four or more movable portions.

At the tip of the nozzle head 100, one or more water discharge ports 150 are provided, which can squirt water toward the "bottom" and the like of a user sitting on a toilet seat (not shown) as described later in detail. The "water" referred to herein includes not only cold water, but also warmed water.

The nozzle head 100 is slidable relative to the first cylinder 200, and at least part of the nozzle head 100 can be housed in the first cylinder 200. Furthermore, the first cylinder 200 is slidable relative to the second cylinder 300, and at least part of the first cylinder 200 can be housed in the second cylinder 300. Likewise, the second cylinder 300 is slidable relative to the third cylinder 400, and at least part of the second cylinder 300 can be housed in the third cylinder 400. The third cylinder 400 is fixed with respect to the nozzle base 700. It is noted that the third cylinder 400 does not necessarily need to be perfectly cylindrical, but only needs to be able to slidably hold the second cylinder 300. The sliding motion of these elements are implemented by a driving portion 600 as described later in detail with reference to examples.

Figure 2A:
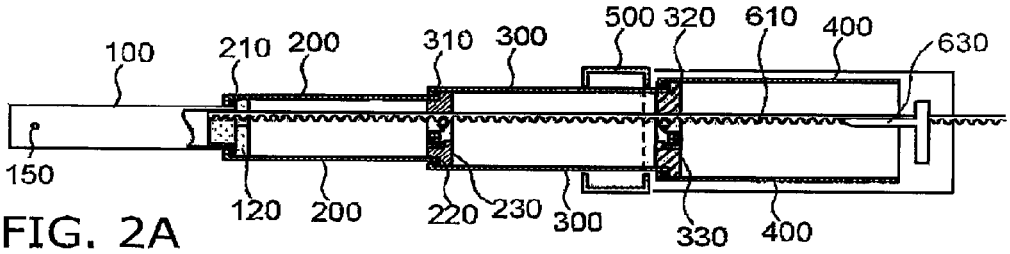
FIGS. 2A to 2D are schematic partial cross-sectional views showing the retracting motion of this washing nozzle.
Figure 2B:
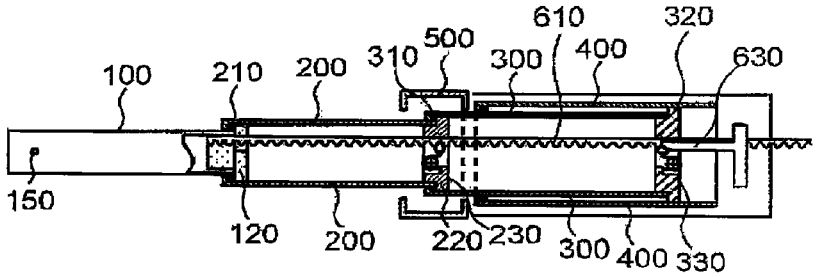
Figure 2C:
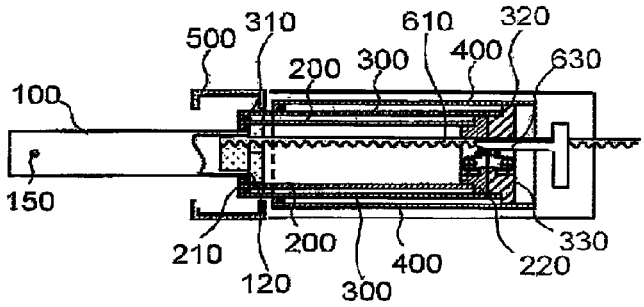
Figure 2D:
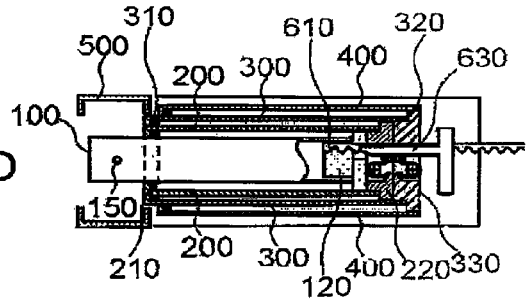

Furthermore, the washing nozzle portion of this embodiment includes a nozzle cleaning chamber 500. The nozzle cleaning chamber 500 is fixed with respect to the nozzle base 700, and can clean the outer peripheral surface of the washing nozzle by squirting water from a water discharge port provided therein. As shown in FIGS. 1A and 2D, in the housed state of the washing nozzle, the tip portion of the nozzle head 100 protrudes from the first cylinder 200 and is almost housed in the nozzle cleaning chamber 500. Furthermore, as shown in FIGS. 1B and 2, the washing nozzle advances/retracts through the nozzle cleaning chamber 500.

In this embodiment, the retracting motion of the washing nozzle is performed sequentially from the outer cylinder. More specifically, from the extended state of the washing nozzle as shown in FIG. 2A, the second cylinder 300 first retracts while interlocking with the nozzle head 100 and the first cylinder 200 and passing through the nozzle cleaning chamber 500, and is housed in the third cylinder 400 as shown in FIG. 2B. Next, the first cylinder 200 retracts while interlocking with the nozzle head 100 and passing through the nozzle cleaning chamber 500, and is housed in the second cylinder 300 as shown in FIG. 2C. Finally, the nozzle head 100 retracts while passing through the nozzle cleaning chamber 500, and is housed in the first cylinder 200 as shown in FIG. 2D.

Thus, in the retracting motion of the washing nozzle, the washing nozzle is passed through the nozzle cleaning chamber 500 sequentially from the outer movable portion. Hence, the outer peripheral surface of the movable portions of the nozzle can be entirely and evenly cleaned in the nozzle cleaning chamber 500. More specifically, when the sanitary washing toilet seat device is used, water is squirted to the "bottom" and the like of a user in the extended state of the washing nozzle as shown in FIGS. 1B and 2A or in a similar state. This washing operation can remove dirt and the like to cleanly wash the "bottom" and the like. However, during this washing, dirt and the like may attach to the surface of the washing nozzle.

Thus, when the washing nozzle is retracted, it is desirable to perform "nozzle body cleaning" for cleaning the outer peripheral surface of the washing nozzle by squirting wash water in the nozzle cleaning chamber 500. According to this embodiment, the second cylinder 300, the first cylinder 200, and the nozzle head 100 can be passed through the nozzle cleaning chamber 500 in this order while being cleaned therein. That is, the outer peripheral surface of these movable portions that have been exposed outside in the extended state can be entirely and evenly cleaned. Consequently, the washing nozzle can be always kept clean, and the sanitary washing toilet seat device can be maintained in a sanitarily desirable condition. Furthermore, it is possible to reduce trouble to clean the washing nozzle, and prevent malfunction, failure and the like of the washing nozzle due to any attached dirt.

Figure 3A:
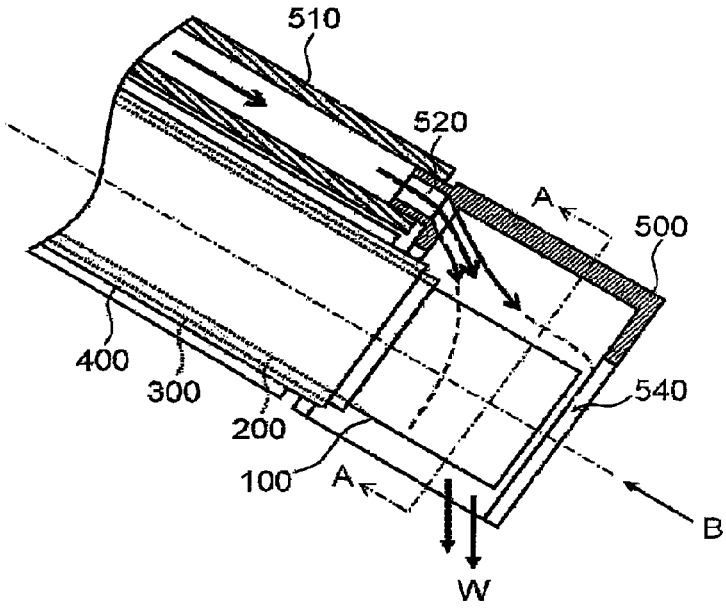
FIGS. 3A to 3C are schematic views illustrating the structure of the nozzle cleaning chamber.
Figure 3B:
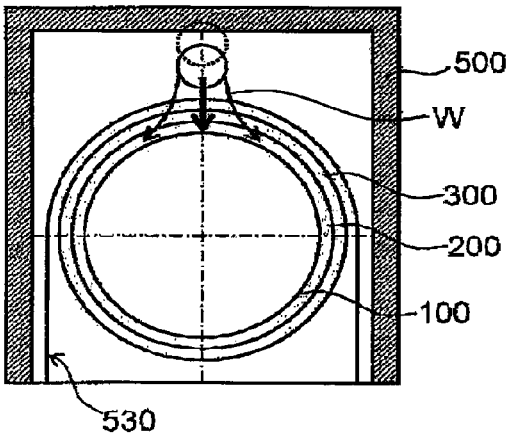
Figure 3C:
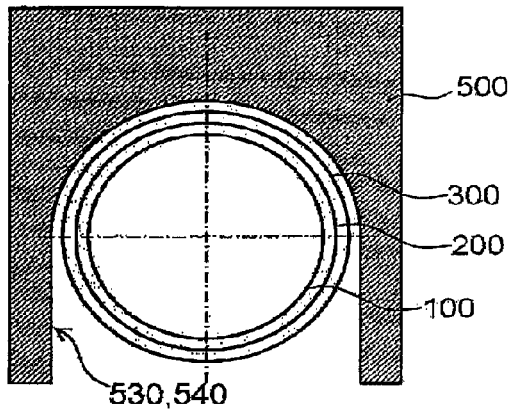

FIG. 3 is a schematic view illustrating the structure of the nozzle cleaning chamber. More specifically, FIG. 3A is a vertical cross-sectional view of the nozzle cleaning chamber 500 and its neighborhood in the housed state of the washing nozzle, FIG. 3B is a cross-sectional view taken along line A-A thereof, and FIG. 3C is a front view as viewed from direction B thereof.

The nozzle cleaning chamber 500 of this example is shaped like a box with the bottom opened. A water channel 510 is connected to the nozzle cleaning chamber 500 and allows wash water W to be squirted from a water channel opening 520 into the nozzle cleaning chamber 500. Furthermore, through holes 530, 540 with the bottom opened are provided in the rear and front side face of the nozzle cleaning chamber 500, respectively. As described above with reference to FIG. 2, the washing nozzle sequentially retracts through these through holes 530, 540, and at this time, its outer peripheral surface is evenly cleaned with wash water W squirted from the water channel opening 520. The wash water W that has cleaned the washing nozzle falls downward and is ejected to the bowl portion (not shown) of the toilet bowl.

In this example, in the housed state of the washing nozzle as shown in FIGS. 2D and 3, the tip of the second cylinder 300 nearly occludes the rear through hole 530 by passing therethrough. Furthermore, also in the advanced/retracted state or the extended state of the washing nozzle as shown in FIGS. 2A to 2C, the through hole 530 is always occluded by the second cylinder 300. Here, the gap between the through hole 530 and the second cylinder 300 can be sufficiently narrowed in consideration of the machining accuracy and assembling accuracy of components and the margin for rattling motion.

In this manner, when "nozzle body cleaning" is performed in the nozzle cleaning chamber 500, wash water W squirted from the water discharge port 520 can be prevented from spattering through the through hole 530 toward the base 700. As described later in detail, the body of the sanitary washing toilet seat device includes electrical components and other various components, and hence spattering of wash water W needs to be minimized. In this regard, in this example, the rear through hole 530 of the nozzle cleaning chamber 500 is always nearly occluded by the second cylinder 300. This can maximally prevent wash water W from spattering into the body of the sanitary washing toilet seat device and realize a sanitary washing toilet seat device with high reliability. Furthermore, as illustrated in FIG. 3A, this example allows wash water W to be squirted forward from the water discharge port 520. This reduces the momentum of water toward the rear through hole 530, and can further prevent wash water W from spattering through the through hole 530 to the device body.

Figure 4A:
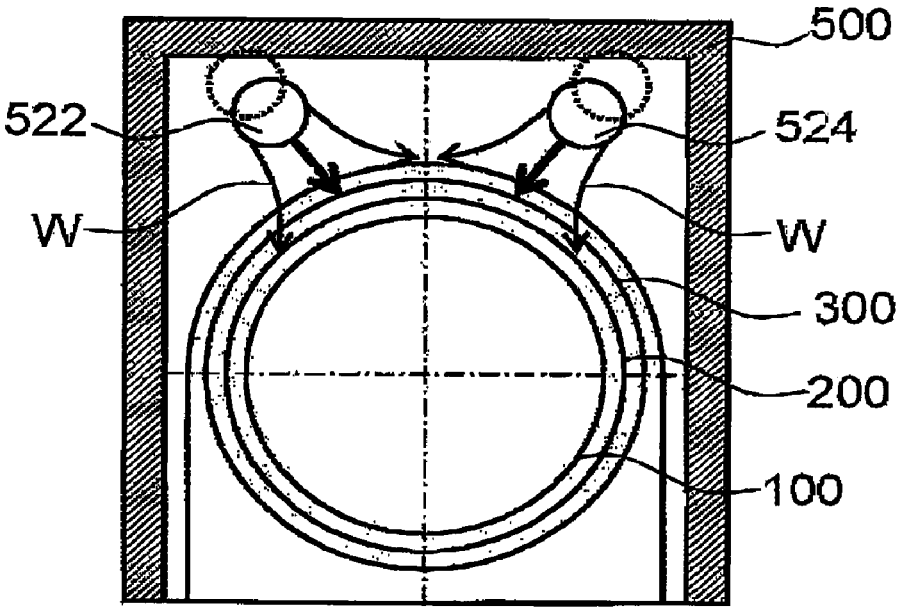
FIGS. 4A and 4B show variations of the nozzle cleaning chamber 500, both corresponding to the cross section taken along line A-A of FIG. 3A.
Figure 4B:
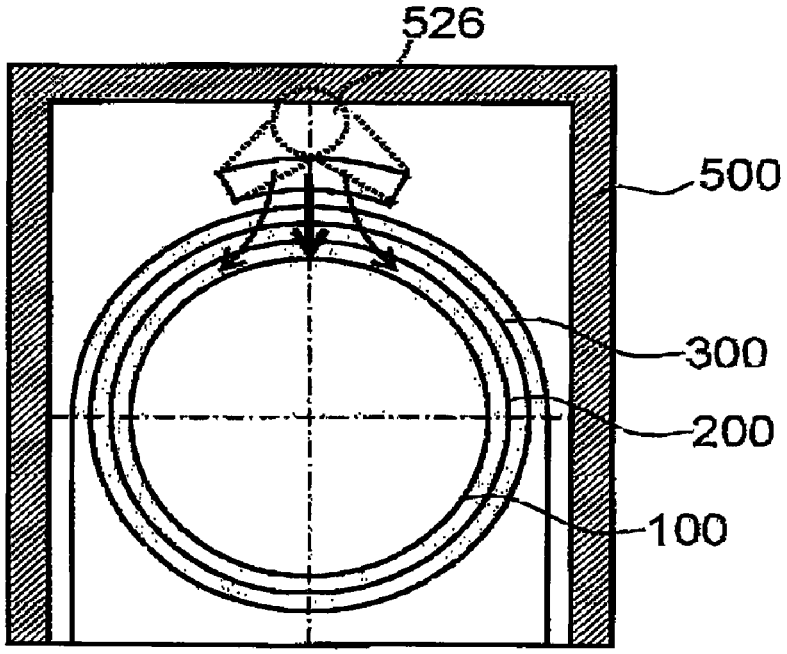

FIGS. 4A and 4B show variations of the nozzle cleaning chamber 500, both corresponding to the cross section taken along line A-A of FIG. 3A.

The variation shown in FIG. 4A includes two water discharge ports 522, 524. Thus, wash water W is squirted from a plurality of directions to the washing nozzle to perform "nozzle body cleaning", and thereby dirt can be removed more evenly and reliably.

On the other hand, the example shown in FIG. 4B includes a water discharge port 526 which expands toward the outer periphery of the washing nozzle in a flattened shape. Thus, wash water W is squirted from such an expanding water discharge port 526 to perform "nozzle body cleaning", and thereby a wide area of the washing nozzle can be evenly cleaned.

It is noted that the invention is not limited to these examples and variations, but they can be combined with each other. Furthermore, the invention also encompasses further variations in the number, shape, and layout of water discharge ports. Moreover, the shape of the nozzle cleaning chamber 500 also encompasses, for example, the shape of only part of the bottom opened and the shape with no opening at the bottom, besides the shape with the bottom entirely opened.

It is noted that, as shown in FIGS. 1, 3B, and 3C, in the examples with the rear through hole of the nozzle cleaning chamber 500 opened at the bottom, the gap between the bottom of this through hole and the second cylinder 300 is preferably occluded by the base 700 to prevent wash water W from spattering.

The washing nozzle portion provided in the sanitary washing toilet seat device of this embodiment will now be described in more detail with reference to examples.

Figure 5:
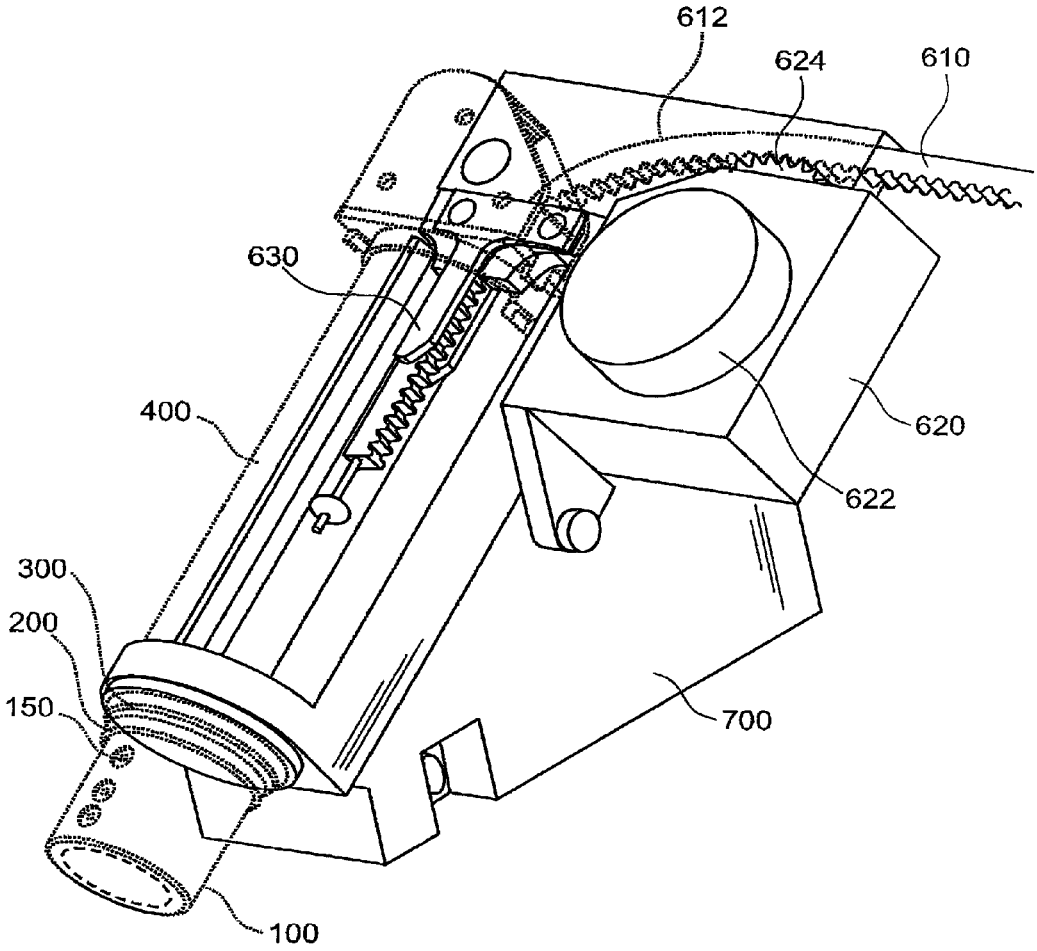
FIG. 5 is a partial cutaway perspective view illustrating the structure of a driving portion 600 of the washing nozzle portion of an example of the invention.

FIG. 5 is a partial cutaway perspective view illustrating the structure of a driving portion 600 of the washing nozzle portion of an example of the invention.

In this example, a flexible rack 610 is used to advance/retract the washing nozzle. The flexible rack 610 is made of a flexible resin or other material, and at least one side surface thereof is provided with a corrugation to be engaged with a gear. By embedding a reinforcing wire made of metal or the like in the flexible rack 610, buckling due to longitudinal compression can be prevented, and tensile strength can be increased. Such a reinforcing wire can illustratively be a cable in which a plurality of metallic wires are stranded together.

The flexible rack 610 is supported along a guide portion 612 provided in the base 700 so as to be longitudinally slidable in the sanitary washing toilet seat device 800, and its tip is fixed to the nozzle head 100. Furthermore, the base 700 is provided with a driving unit 620, which can suitably decelerate the driving output of a motor 622 for output to the gear 624. The flexible rack 610, which is engaged with the gear 624, converts the rotary driving force of the gear 624 to a linear driving force to move the nozzle head 100.

Furthermore, a disengaging portion 630 is provided near the basal portion of the washing nozzle.

Figure 6A:
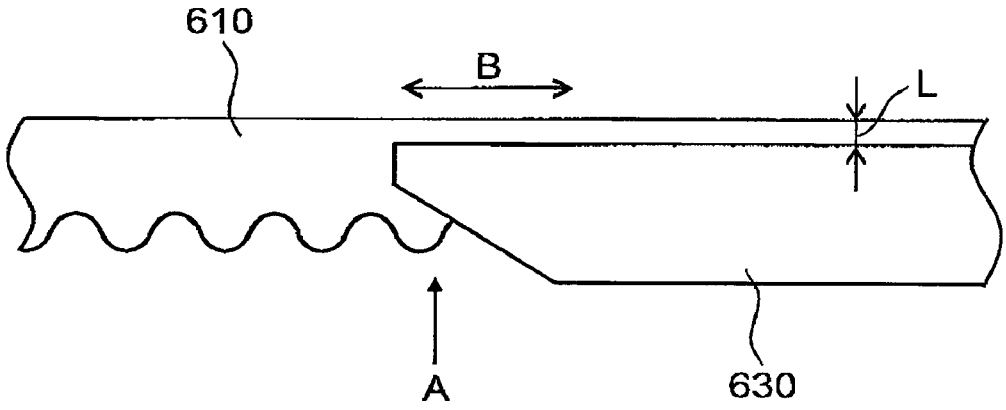
Figure 6B:
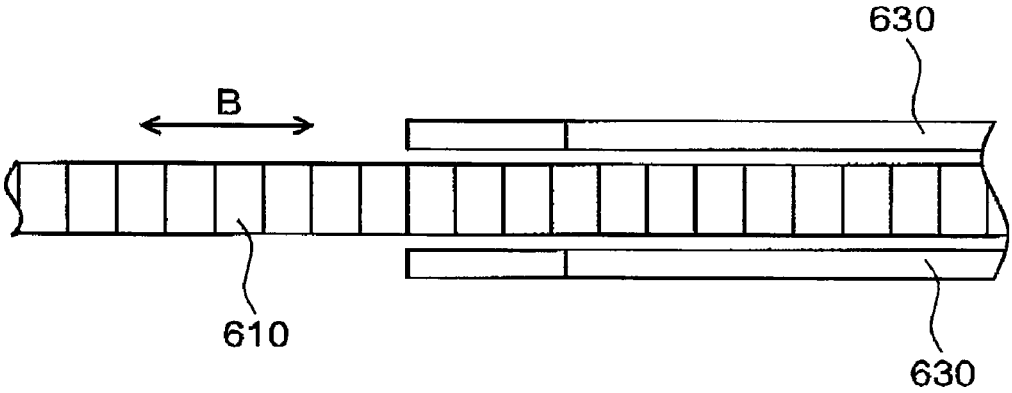

FIG. 6 is a schematic view illustrating the positional relationship between the disengaging portion 630 and the flexible rack 610, in which FIG. 6A is a partial plan view as viewed from above, and FIG. 6B is a side view as viewed from direction A of FIG. 6A.

As seen from these figures, the disengaging portion 630 can be made of a pair of wedge-shaped members provided on both sides of the flexible rack 610. The disengaging portion 630 is fixed with respect to the base 700, and the flexible rack 610 is slidable in the direction of arrow B by the driving force from the gear 624.

Figure 7:
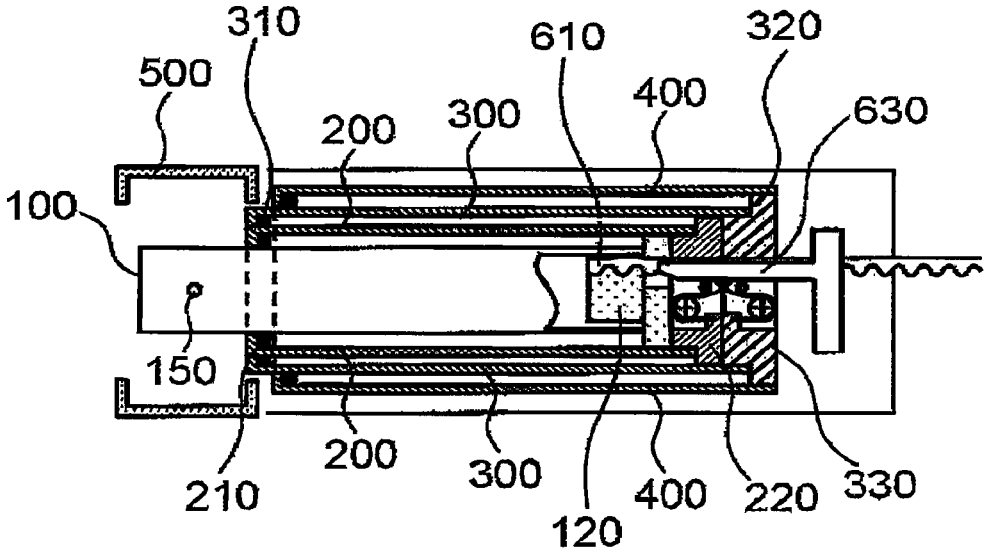
FIG. 7 is a schematic cross-sectional view showing the housed state of the washing nozzle in this example.

FIG. 7 is a schematic cross-sectional view showing the housed state of the washing nozzle in this example.

Figure 8:
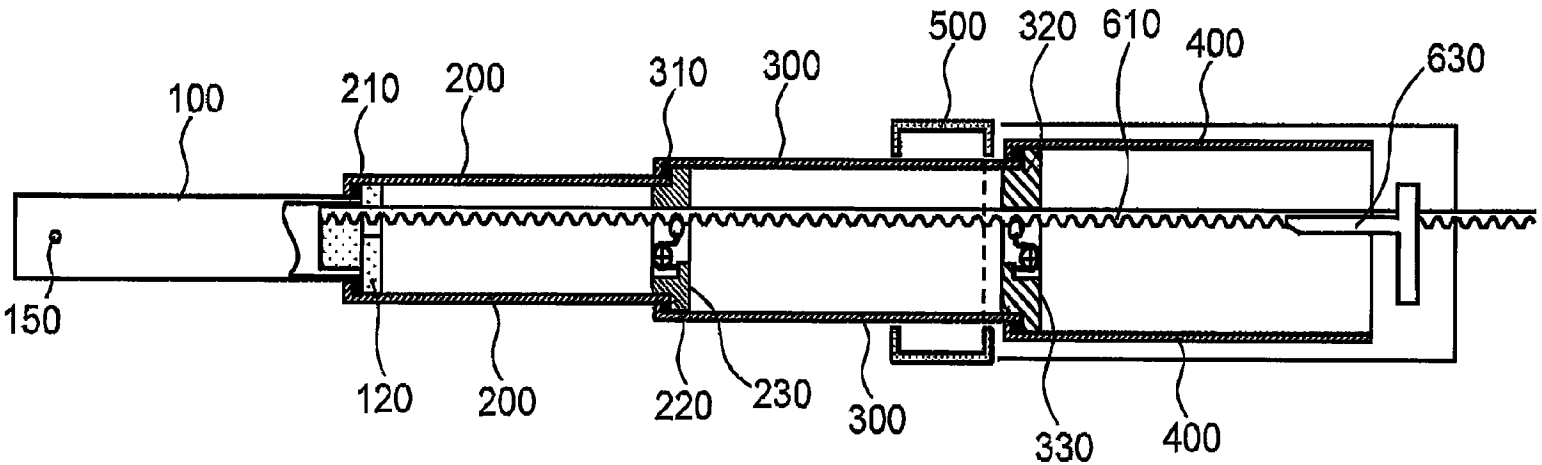
FIG. 8 is a schematic partial cross-sectional view showing the extended state of this washing nozzle.

FIG. 8 is a schematic partial cross-sectional view showing the extended state of this washing nozzle. It is noted that FIGS. 7 and 8 are both schematic partial cross-sectional views of the washing nozzle as viewed from above.

The flexible rack 610 is fixed to the base end of the nozzle head 100. A stopper 120 protruding toward the periphery is provided at the base end of the nozzle head 100. On the other hand, a slider 210 is provided inside the tip portion of the first cylinder 200, and a stopper 220 protruding toward the periphery is provided at the base end of the first cylinder 200. The nozzle head 100 abuts the inner peripheral surface of the slider 210 and is slidably supported thereby. When the nozzle head 100 advances, its stopper 120 abuts the slider 210 of the first cylinder 200, and the stroke end is determined.

Furthermore, a slider 310 is provided also inside the tip portion of the second cylinder 300, and a stopper 320 protruding toward the periphery is provided at the base end of the second cylinder 300. The first cylinder 200 abuts the inner peripheral surface of the slider 310 and is slidably supported thereby. When the first cylinder 200 advances, the stopper 220 abuts the slider 310 of the second cylinder 300, and its stroke end is determined.

Furthermore, a slider 410 is provided inside the tip portion of the third cylinder 400 and slidably supports the second cylinder 300. When the second cylinder 300 advances, the stopper 320 abuts the slider 410 of the third cylinder 400, and its stroke end is determined. Alternatively, it is also possible to use a structure in which the base 700 itself slidably supports the second cylinder 300 without providing the third cylinder 400.

As described later in detail, the body of the nozzle head 100 and the first and second cylinder 200, 300 can be made of metal such as stainless steel or aluminum, and the sliders 210, 310, 410 can be made of resin such as PET (polyethylene terephthalate). This enables smooth sliding while blocking entry of water from outside. Alternatively, the body of the nozzle head 100 can illustratively be formed from resin or the like.

On the other hand, engaging mechanisms 230, 330 for engaging with the flexible rack 610 are provided at the base end of the first and second cylinder 200, 300, respectively.

Figure 9B:
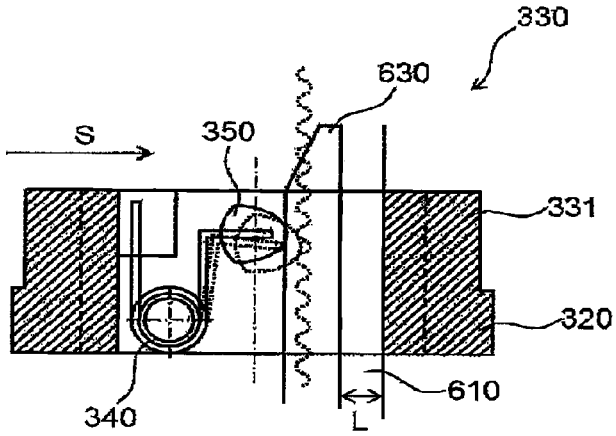
Figure 9A:
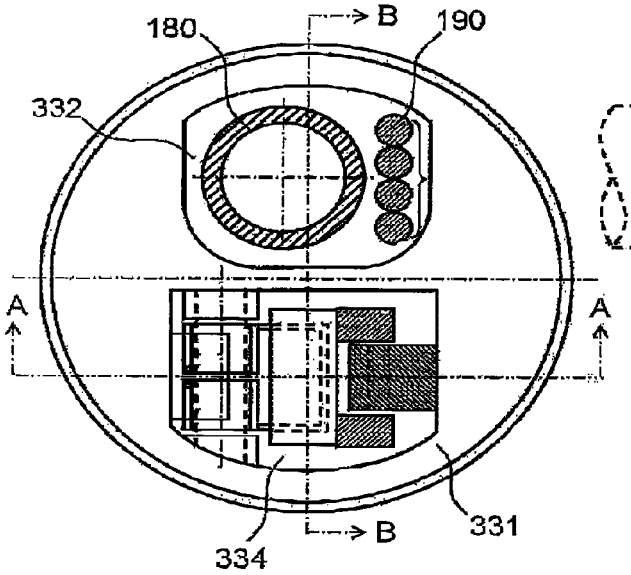
Figure 9C:
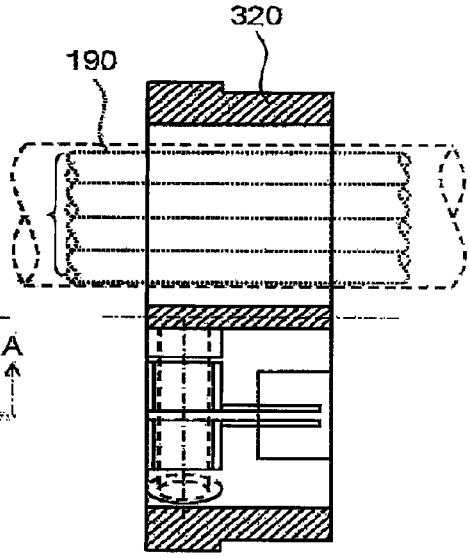

FIG. 9 is a schematic view illustrating the structure of the engaging mechanism 330, in which FIG. 9A is a front view as viewed from its nozzle tip side, FIG. 9B is a cross-sectional view taken along line A-A of FIG. 9A, and FIG. 9C is a cross-sectional view taken along line B-B of FIG. 9A.

The engaging mechanism 330 has a frame 331 illustratively made of resin. The frame 331 can be formed integrally with the stopper 320, or can be formed separately. The frame 331 is provided with a first through hole 332 and a second through hole 334. The first through hole 332 can be used as a path for passing a water supply tube 180 and an electrical wire harness 190. The tube 180 supplies wash water W to the nozzle head 100. The electrical wire harness 190 supplies a driving signal for switching water paths, adjusting the momentum of water and the like. The structure of the nozzle head 100 is described later in detail with reference to examples.

On the other hand, the second through hole 334 is provided with a latch 350 supported by a coil spring 340. The latch 350 is biased in the direction of arrow S in FIG. 9B and serves to engage with a depression of the corrugation provided on the flexible rack 610 and transmit its driving force to the second cylinder 300. By the action of the disengaging portion 630, the latch 350 is detached and disengaged from the flexible rack 610.

The engaging mechanism 230 provided in the first cylinder 200 has a similar structure.

The frictional force acting between the latch 250 of the engaging mechanism 230 and the disengaging portion 630 is configured to be larger than the frictional force produced between the first cylinder 200 and the second cylinder 300. The frictional force acting between the latch 350 of the engaging mechanism 330 and the disengaging portion 630 is configured to be larger than the frictional force produced between the second cylinder 300 and the third cylinder 400 (or the base 700).

Furthermore, the engaging force between the latch 250 of the engaging mechanism 230 and the flexible rack 610 is configured to be larger than the frictional force acting between the nozzle head 100 and the first cylinder 200, between the first cylinder 200 and the second cylinder 300, and between the second cylinder 300 and the third cylinder 400 (or the base 700).

This configuration of the relationship between the engaging force of the engaging mechanisms 230, 330 and the frictional force of the washing nozzle allows the washing nozzle to advance sequentially from the nozzle head 100. When the washing nozzle retracts, the nozzle head 100, the first cylinder 200, and the second cylinder 300 are integrally interlocked until the latches 250, 350 are disengaged from the flexible rack 610. Hence, the washing nozzle retracts sequentially from the outer cylinder (second cylinder 300).

It is noted that, as shown by arrow L in FIGS. 6 and 9, the disengaging portion 630 configured not to protrude outside the flexible rack 610 can avoid the problem of the disengaging portion 630 otherwise abutting the frame 331 and interfering with its advancing/retracting motion.

Next, the advancing and retracting motion of the washing nozzle of this example is described.

Figure 10A:
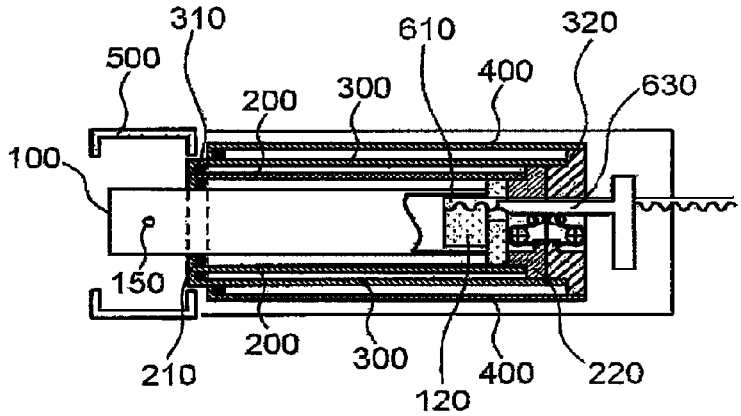
FIGS. 10A to 10C are schematic views for describing the advancing motion of the washing nozzle of this example.

FIGS. 10 and 11 are schematic views for describing the advancing motion of the washing nozzle of this example. FIG. 10A shows the completely housed state of the washing nozzle. In this state, the nozzle head 100, the first cylinder 200, and the second cylinder 300 are each retracted toward the base end, and the stoppers 120, 220, 320 abut each other. Furthermore, in this state, the latches 250, 350 of the first and second cylinder are mounted on the disengaging portion 630 and are detached and disengaged from the flexible rack 610.

At this time, the tip portion of the nozzle head 100 protrudes from the first cylinder 200 and is housed in the nozzle cleaning chamber 500.

In this housed state of the washing nozzle, when a user manipulates a washing switch provided on the sanitary washing toilet seat device or on a remote controller for controlling it, the operation for washing the "bottom" and the like is started.

At this time, first, with the washing nozzle remaining in the housed state as shown in FIG. 10A, "nozzle precleaning" for discharging water from the water discharge port 150 of the nozzle head can be performed. This is the process for previously ejecting cold water that is left in the water flow path from the warm water source to the nozzle head 100 provided in the sanitary washing toilet seat device, and for allowing water at an optimum temperature to be immediately squirted to the "bottom" and the like of the user. Furthermore, previously squirting water can also prevent clogging of the water discharge port 150 of the nozzle head 100. In the case where the nozzle head 100 has a plurality of water discharge ports 150, water can be discharged from all the water discharge ports.

It is noted that such "nozzle precleaning" is performed in the nozzle cleaning chamber 500. Hence, the discharged water does not spatter outside, but the water squirted from the water discharge port 150 flows out of the opening at the bottom of the nozzle cleaning chamber 500 and is ejected to the bowl portion of the toilet bowl.

After the "nozzle precleaning" is finished, the washing nozzle is advanced while performing "nozzle body cleaning". That is, wash water W is squirted from the water discharge port 420 provided in the nozzle cleaning chamber 500 (see FIG. 3).

Figure 10B:
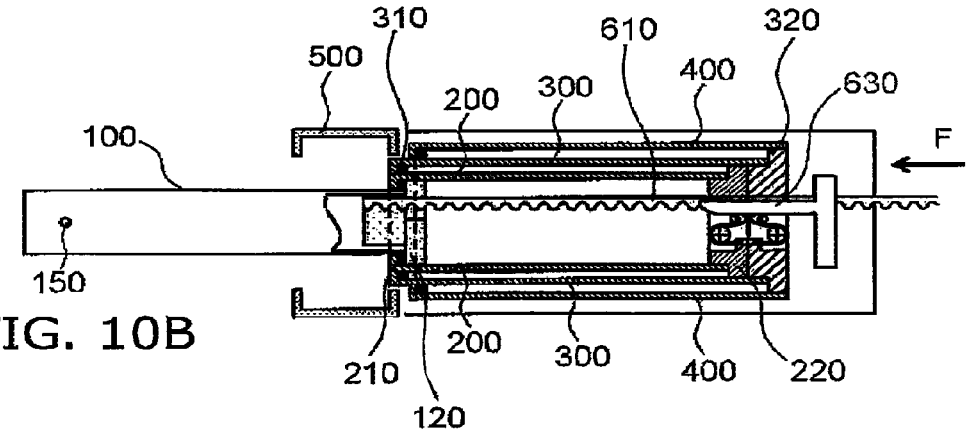

Furthermore, to advance the washing nozzle, the flexible rack 610 is pushed in the direction of arrow F. Then, first, as shown in FIG. 10B, the nozzle head 100 advances. The magnitude relationship of frictional forces acting between the nozzle head 100 and the first to third cylinder 200, 300, 400 can be suitably adjusted so that, at this time, only the nozzle head 100 advances while the first and second cylinder is held still. That is, in a suitable configuration, the frictional force acting between the first cylinder 200 and the nozzle head 100 is smaller than the frictional force acting between the first to third cylinder 200, 300, 400.

Thus, by first advancing only the nozzle head 100, its outer peripheral surface can be entirely and evenly cleaned in the nozzle cleaning chamber 500.

As shown in FIG. 10B, when the nozzle head 100 advances to its stroke end and the stopper 120 abuts the slider 210, the driving force of the flexible rack 610 is transmitted also to the first cylinder 200, which then starts to advance. The magnitude relationship of frictional forces acting between the first to third cylinder 200, 300, 400 can be suitably adjusted so that, also at this time, only the first cylinder 200 advances while the second cylinder is held still. That is, in a suitable configuration, the frictional force acting between the first cylinder 200 and the second cylinder 300 is smaller than the frictional force acting between the second cylinder 300 and the third cylinder 400.

Figure 10C:
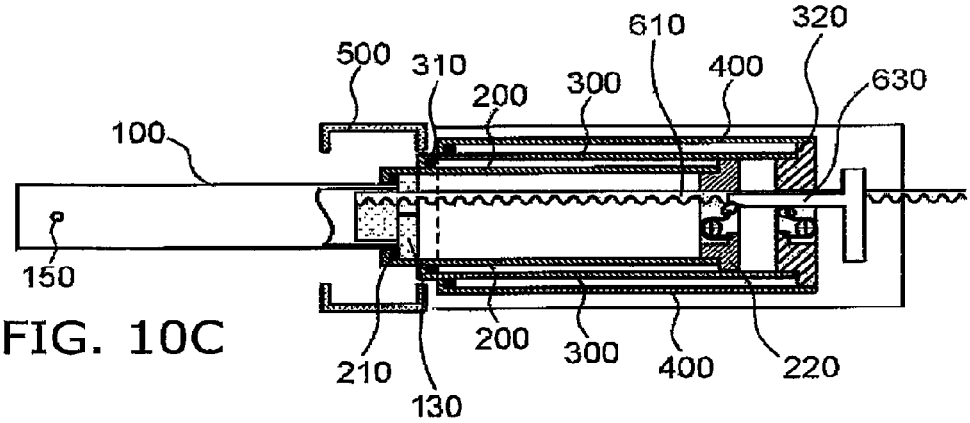

When the first cylinder 200 advances to the position shown in FIG. 10C, the latch 250 is detached from the disengaging portion 630 and engaged with the flexible rack 610 by the biasing force of the coil spring 240.

FIG. 12 is a partial enlarged cross-sectional view illustrating the change in the engagement state associated with the motion of the first cylinder 200.

Figure 12A:
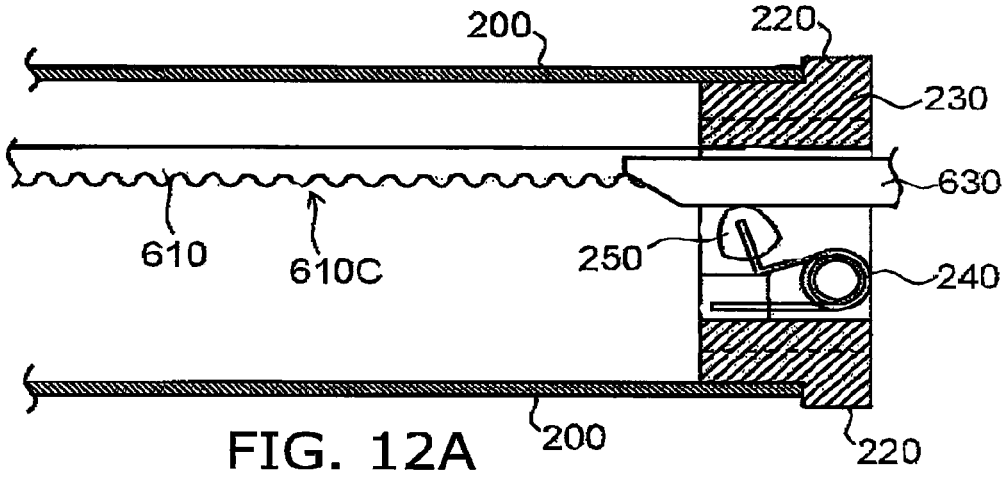
FIGS. 12A to 12C are partial enlarged cross-sectional views illustrating the change in the engagement state associated with the motion of the first cylinder 200.

As shown in FIG. 12A, in the housed state of the first cylinder 200, the latch 250 of the engaging mechanism 230 is mounted on the disengaging portion 630, and detached and disengaged from the flexible rack 610.

Figure 12B:
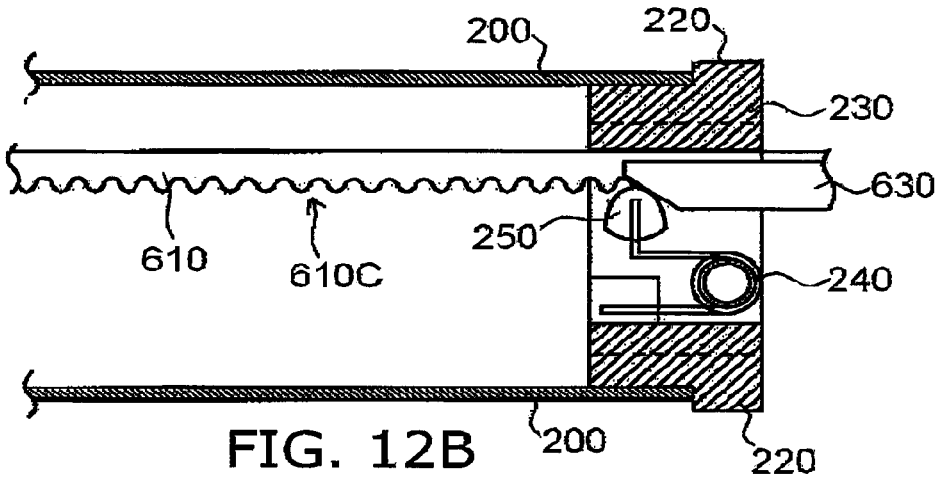
Figure 12C:
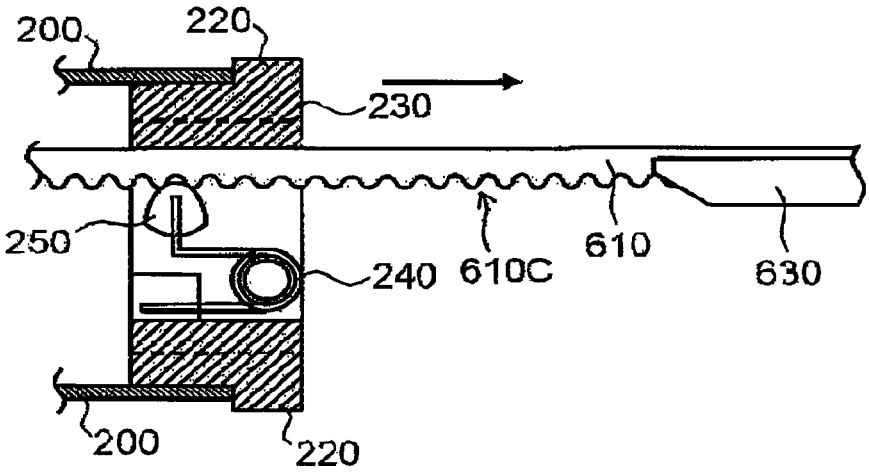

When the first cylinder 200 advances, as shown in FIG. 12B, the latch 250 descends along the wedge-shaped slope of the disengaging portion 630 and engages with a depression of the flexible rack 610. Subsequently, the first cylinder 200 continues to advance as shown in FIG. 12C under the action of both the driving force through the nozzle head 100 and the driving force through the latch 250.

Thus, by advancing the first cylinder 200 subsequent to the nozzle head 100, the outer peripheral surface of the first cylinder 200 can also be entirely and evenly cleaned in the nozzle cleaning chamber 500.

Figure 11A:
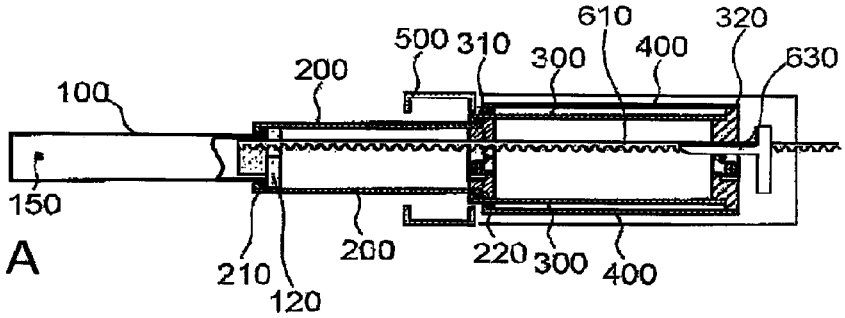
FIGS. 11A to 11C are schematic views for describing the advancing motion of the washing nozzle of this example.
Figure 11B:
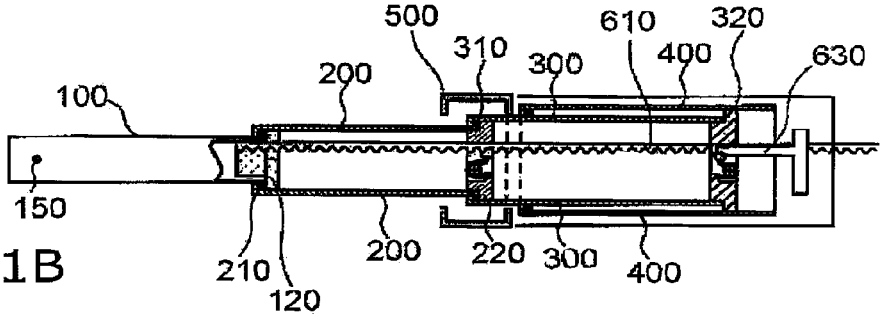

As shown in FIG. 11A, when the first cylinder 200 advances to the stroke end, the stopper 220 abuts the slider 310, and the driving force of the flexible rack 610 is transmitted also to the second cylinder 300, which then starts to advance. When the second cylinder 300 advances to the position shown in FIG. 11B, the latch 350 provided in the engaging mechanism 330 engages with the flexible rack 610. The second cylinder 300 further advances by the driving force of the flexible rack 610 and extends to the state shown in FIG. 11C. Subsequently, water can be squirted from the water discharge port 150 of the nozzle head 100 to wash the "bottom" and the like.

Thus, by advancing the second cylinder 300 subsequent to the first cylinder 200, the outer peripheral surface of the second cylinder 300 can also be evenly cleaned in the nozzle cleaning chamber 500.

Figure 11C:
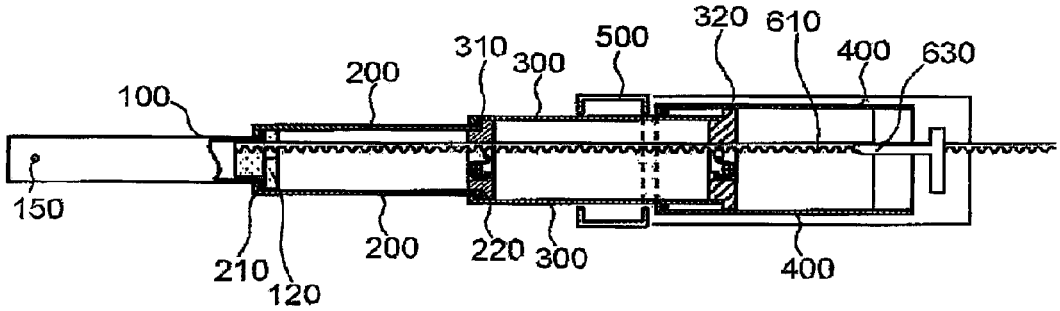

It is noted that FIG. 11C illustratively shows the state of the washing nozzle advanced to the normal position for washing the "bottom", which is slightly shorter than the state of the washing nozzle advanced to the stroke end as illustratively shown in FIG. 2A. In this example, while performing "nozzle body cleaning", the washing nozzle can thus be advanced to the normal position for washing the "bottom" and the like, and then immediately start to wash the "bottom" and the like. Alternatively, while performing "nozzle body cleaning", the washing nozzle can be advanced to the maximum stroke end (e.g., the state of FIG. 2A) to clean its entirety, and then retracted to the normal position (e.g., the state of FIG. 11C) to start to wash the "bottom" and the like.

As described above, in this example, the driving force of the flexible rack 610 can be applied to the nozzle head 100 and transmitted to the cylinders through the stoppers 120, 220 to advance the washing nozzle. Furthermore, the flexible rack 610 has a structure in which a metallic cable is sheathed with resin, and can prevent its flexure and buckling. Consequently, the amount of advancement of the washing nozzle can be precisely controlled even if it is a multistage nozzle.

If the flexible rack 610 advances/retracts only linearly, a thick-diameter wire can be used. However, because the depth of the sanitary washing device body 800 is shorter than the advancement length of the multistage washing nozzle, the flexible rack 610 for advancing/retracting the washing nozzle needs to be bent at the guide portion 612 and housed in the sanitary washing toilet seat device body 800. Hence, as in this example, a cable resistant to bending is preferably used.

Furthermore, the engaging mechanisms 230, 330 are provided at the base end of the first and second cylinder 200, 300, which are advanced with the latches 250, 350 being engaged with the flexible rack 610. Thus, flexure and buckling of the flexible rack 610 can be prevented almost completely. More specifically, without a guide or support provided along the path from the guide portion 612 (see FIG. 5) to the fixing portion of the nozzle head 100, the flexible rack 610 may be bent or buckled in the washing nozzle when it is pushed. In contrast, in this example, the engaging mechanisms 230, 330 are provided, and the flexible rack 610 can be pushed with the latches 250, 350 being engaged with the flexible rack 610. Consequently, flexure and buckling of the flexible rack 610 can be prevented almost completely, and the amount of advancement of the washing nozzle can be controlled more precisely by the amount of rotation of the gear 624 (see FIG. 5).

Moreover, the flexible rack 610 has a thin diameter, and is supported so as to be longitudinally slidable in the sanitary washing toilet seat device 800. Hence, it is possible to reduce the space for housing the mechanism for advancing/retracting the washing nozzle in the sanitary washing device 800.

Furthermore, according to this example, the washing nozzle is advanced in the order of the nozzle head 100, the first cylinder 200, and the second cylinder 300. Thus, the outer periphery of these movable portions can be entirely and evenly cleaned. Consequently, the "bottom" and the like can be washed with the washing nozzle in a clean and sanitary condition. Furthermore, prewetting the outer peripheral surface of the washing nozzle has the additional effect of preventing attachment of dirt and the like spattered during washing the "bottom" and the like.

Next, the retracting motion of the washing nozzle in this example is described.

Figure 13A:
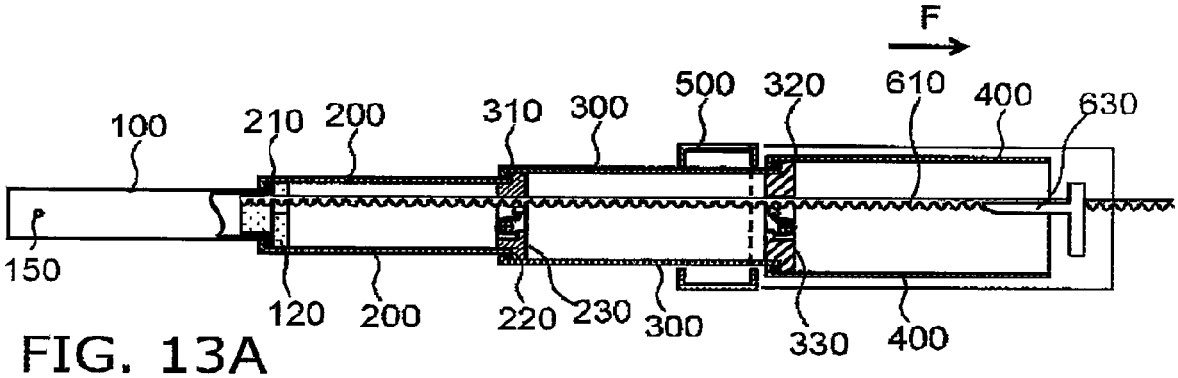
FIGS. 13A to 13C are schematic views for describing the retracting motion of the washing nozzle of this example.

FIGS. 13 and 14 are schematic views for describing the retracting motion of the washing nozzle of this example. FIG. 13A shows the completely extended state of the washing nozzle.

In this state, the nozzle head 100, the first cylinder 200, and the second cylinder 300 are each advanced toward the tip, and the stoppers 120, 220, 320 abut the sliders 210, 310, 410. Furthermore, in this state, the engaging mechanisms 230, 330 of the first and second cylinder engage with the flexible rack 610. It is noted that, instead of such a completely advanced state, the washing nozzle can be located at a position for washing the "bottom" and the like as described above with reference to FIG. 11C.

In this advanced state of the washing nozzle, when the user finishes washing the "bottom" and the like and manipulates a stop switch illustratively provided on the remote controller, water discharge from the water discharge port 150 of the nozzle head 100 is stopped, and the retracting motion of the washing nozzle is started while performing "nozzle body cleaning".

More specifically, first, wash water W is squirted from the water discharge port 420 provided in the nozzle cleaning chamber 500 (see FIG. 3).

Figure 13B:
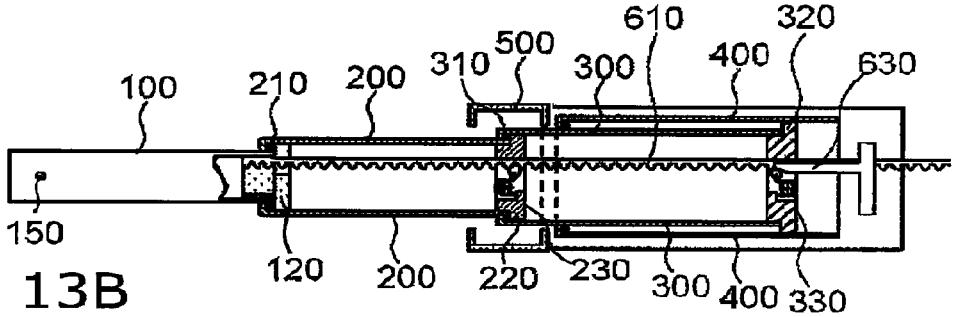

Next, to start to retract the washing nozzle, the flexible rack 610 is pulled back in the direction of arrow F. Then, as shown in FIG. 13B, the second cylinder 300 starts to retract with the nozzle head 100 and the first cylinder 200, and is housed in the third cylinder 400. At this time, the second cylinder 300 is cleaned while passing through the nozzle cleaning chamber 500. That is, the outer peripheral surface of the second cylinder 300 can be entirely and evenly cleaned in the nozzle cleaning chamber 500.

As shown in FIG. 13B, when the second cylinder 300 retracts to the vicinity of its stroke end and the latch 350 of the engaging mechanism 330 abuts the disengaging portion 630, it is disengaged from the flexible rack 610.

FIG. 15 is a partial enlarged cross-sectional view illustrating the state change of the engaging mechanism 330 associated with the motion of the second cylinder 300.

Figure 15A:
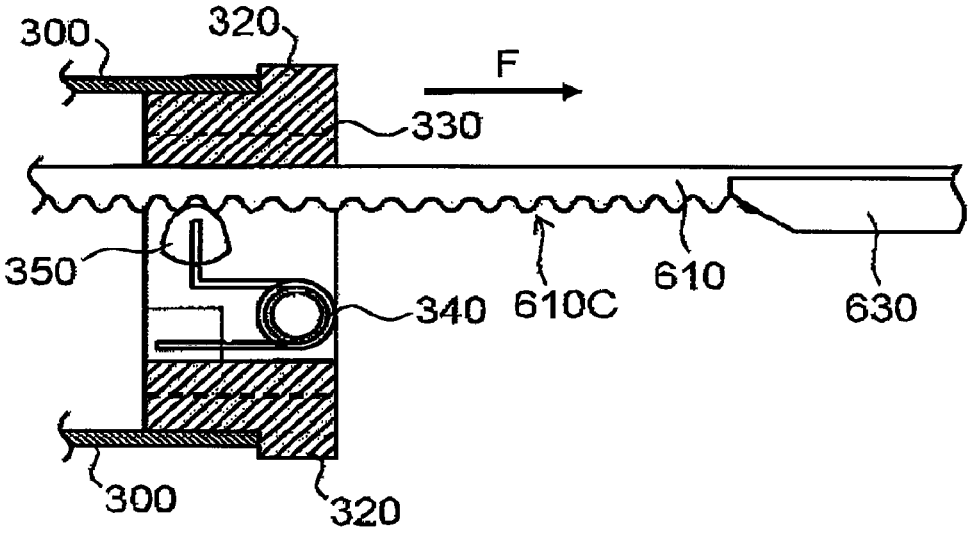
FIGS. 15A and 15B are partial enlarged cross-sectional views illustrating the state change of the engaging mechanism 330 associated with the motion of the second cylinder 300.
Figure 15B:
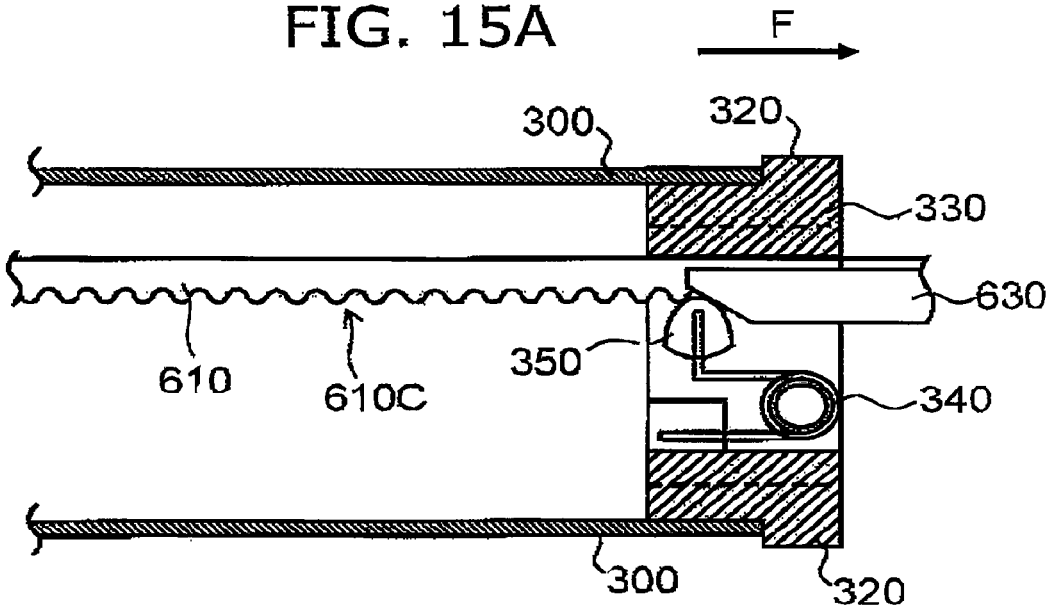

As shown in FIG. 15A, first, with the latch 350 of the engaging mechanism 330 being engaged with the flexible rack 610, the second cylinder 300 retracts. Then, as shown in FIG. 15B, when the latch 350 abuts the wedge-shaped slope of the disengaging portion 630, an effort to lift up the latch 350 occurs against the biasing force of the coil spring 340. Consequently, the latch 350 is disengaged from the flexible rack 610, and the second cylinder 300 stops retracting.

Subsequently, the flexible rack 610 still continues to be pulled back in the direction of arrow F. At this time, the latch 350 idles on the corrugated surface of the flexible rack 610 in accordance with the counterbalance between the biasing force of the coil spring 340 and the effort exerted by the disengaging portion 630. The biasing force of the coil spring 340, the slope shape of the disengaging portion 630, and the shape of the abutment surface of the latch 350 can be suitably configured to allow the latch 350 to smoothly idle in this state so that an excessive braking force is not applied to the flexible rack 610.

When the engaging mechanism 330 is thus disengaged, the second cylinder 300 stops, and the first cylinder 200 continues to retract with the nozzle head 100. At this time, the first cylinder 200 passes through the nozzle cleaning chamber 500, and its outer peripheral surface can be entirely and evenly cleaned in the nozzle cleaning chamber 500.

Figure 13C:
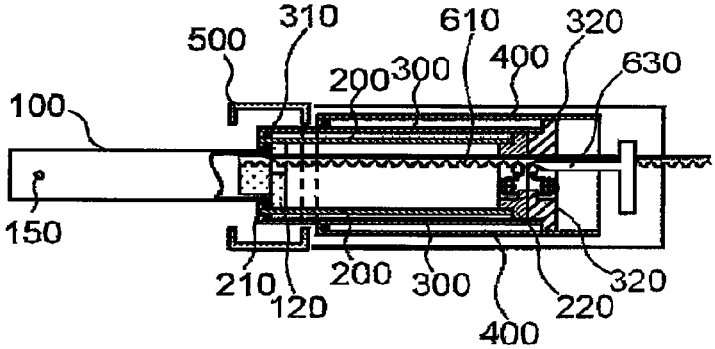
Figure 14A:
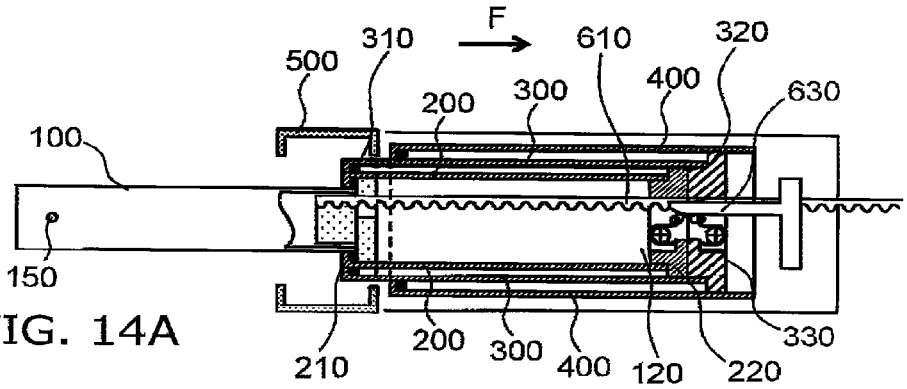
FIGS. 14A to 14C are schematic views for describing the retracting motion of the washing nozzle of this example.

As shown in FIG. 13C, when the first cylinder 200 retracts, the stopper 220 (or the engaging mechanism 230) of the first cylinder 200 abuts the stopper 320 (or the engaging mechanism 330) of the second cylinder 300. By further retraction, the latch 350 of the engaging mechanism 330 of the second cylinder 300 is pushed up onto the disengaging portion 630. As shown in FIG. 14A, when the latch 250 of the first cylinder 200 abuts the wedge-shaped slope of the disengaging portion 630, it is disengaged from the flexible rack 610 as described above with reference to FIG. 15, and the first cylinder 200 stops. Subsequently, the flexible rack 610 is pulled back in the direction of arrow F, and the latch 250 idles on the corrugated surface of the flexible rack 610.

Figure 14B:
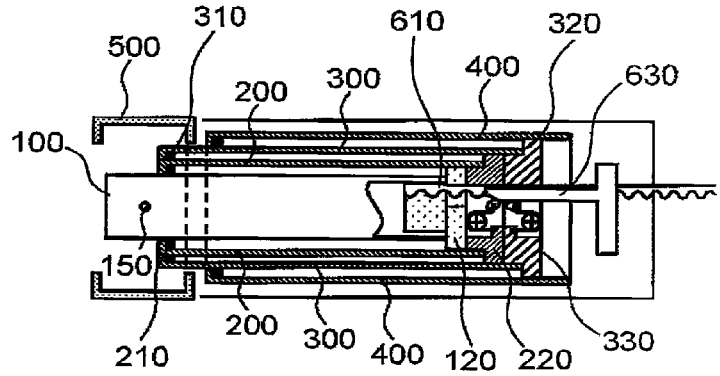
Figure 14C:
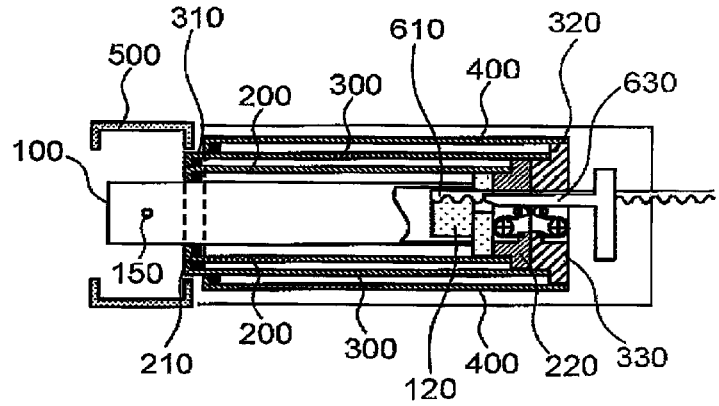

Also when the nozzle head 100 retracts after the retraction of the first cylinder 200, the outer peripheral surface of the nozzle head 100 can be entirely and evenly cleaned in the nozzle cleaning chamber 500. Then, as shown in FIG. 14B, the stopper 120 of the nozzle head 100 abuts the stopper 220 (or the engaging mechanism 230) of the first cylinder 200, and further retraction pushes up the latch 250 onto the disengaging portion 630. Thus, as shown in FIG. 14C, the washing nozzle is completely housed when it retracts to the stroke end.

Subsequently, "nozzle postcleaning" can be performed by suitably squirting water from the water discharge port 150 at the tip portion of the nozzle head 100 housed in the nozzle cleaning chamber 500. This can prevent clogging of the water discharge port 150, and has the additional effect of thoroughly cleaning the tip portion of the nozzle head 100 and the inside of the nozzle cleaning chamber 500. In the case where the nozzle head 100 has a plurality of water discharge ports 150, water can be discharged from all the water discharge ports 150 also during the "nozzle postcleaning".

As described above, in this example, the engaging mechanisms 230, 330 and the disengaging portion 630 allow the washing nozzle to retract in the order of the second cylinder 300, the first cylinder 200, and the nozzle head 100. Thus, the outer periphery of these movable portions can be entirely and evenly cleaned in the nozzle cleaning chamber 500. That is, when the multistage washing nozzle retracts, "nozzle body cleaning" can be performed effectively and reliably. Consequently, even a multistage washing nozzle can be maintained in a clean and sanitary condition. Thus, it is possible to save the trouble of cleaning, and also prevent malfunction and failure due to any attached dirt.

FIG. 16 is a schematic cross-sectional view showing the retracting motion of a washing nozzle according to a variation of this embodiment. This variation includes no disengaging portion 630. Even without the disengaging portion 630, the retracting motion of the washing nozzle can be performed in the order of the second cylinder 300, the first cylinder 200, and the nozzle head 100.

Figure 16A:
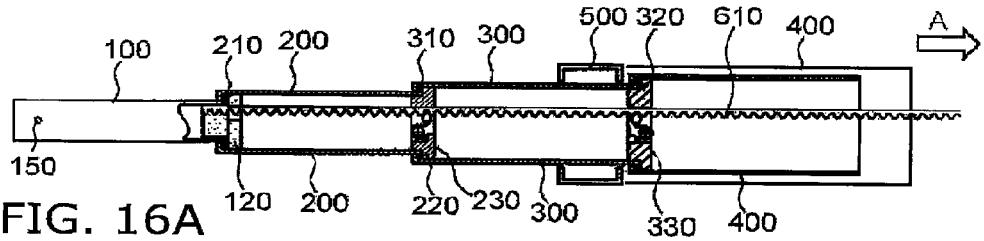
FIGS. 16A to 16D are schematic cross-sectional views showing the retracting motion of a washing nozzle according to a variation of this embodiment.

More specifically, in the extended state of the washing nozzle as shown in FIG. 16A, each latch of the engaging mechanism 230, 330 is engaged with a depression of the flexible rack 610. Hence, when the flexible rack 610 is pulled back in the direction of arrow A from this state, the nozzle head 100, the first cylinder 200, and the second cylinder 300 all start to retract.

Figure 16B:
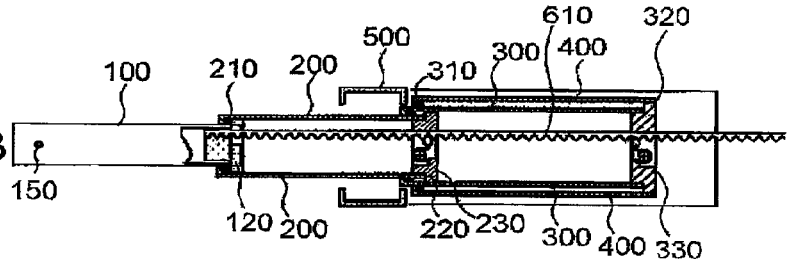

Next, as shown in FIG. 16B, when the second cylinder 300 is completely retracted and abuts the stopper (not shown), the latch of its engaging mechanism 330 starts to idle on the corrugated surface of the flexible rack 610. On the other hand, the nozzle head 100 and the first cylinder 200 further continue to retract.

Figure 16C:
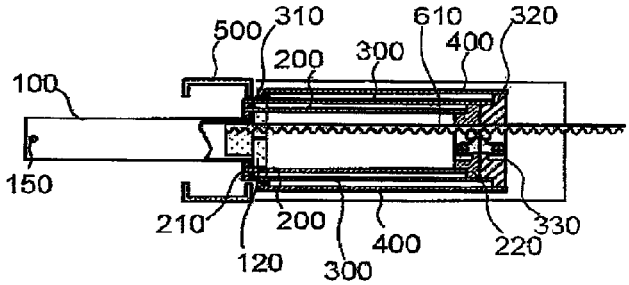

Next, as shown in FIG. 16C, when the first cylinder 200 is completely retracted and abuts the engaging mechanism 330 (or the stopper 320) of the second cylinder 300, the latch of its engaging mechanism 230 also starts to idle on the corrugated surface of the flexible rack 610.

Figure 16D:
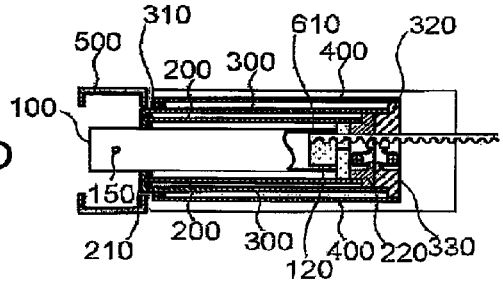

Next, when the flexible rack 610 is further pulled back in the direction of arrow A, the nozzle head 100 retracts with the latch of the engaging mechanism 230 of the first cylinder 200 and the latch of the engaging mechanism 330 of the second cylinder 300 both idling, and the washing nozzle is completely housed as shown in FIG. 16D.

As described above, even in the case without the disengaging portion 630, the action of the latches of the engaging mechanisms 230, 330 allows the washing nozzle to be retracted in the order of the second cylinder 300, the first cylinder 200, and the nozzle head 100 while passing through the nozzle cleaning chamber 500.

In this variation, when the washing nozzle is advanced, the second cylinder 300 first advances with the first cylinder 200 and the nozzle head 100. Next, the first cylinder 200 advances with the nozzle head 100 while the latch of the engaging mechanism 330 idles on the corrugated surface of the flexible rack 610. Subsequently, the nozzle head 100 advances while the latches of the engaging mechanisms 230, 330 each idle on the corrugated surface of the flexible rack 610.

Thus, even in the case where the washing nozzle advances, the washing nozzle can be kept clean if the nozzle can be retracted in the order as illustrated in FIG. 16 and sufficiently cleaned in the nozzle cleaning chamber 500.

Next, another variation of this embodiment is described.

Figure 17A:
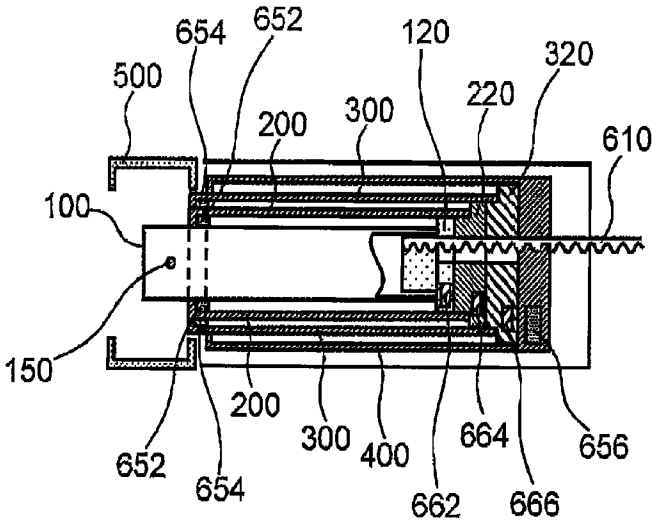
FIGS. 17A and 17B are schematic cross-sectional views showing a washing nozzle according to another variation of this embodiment.
Figure 17B:
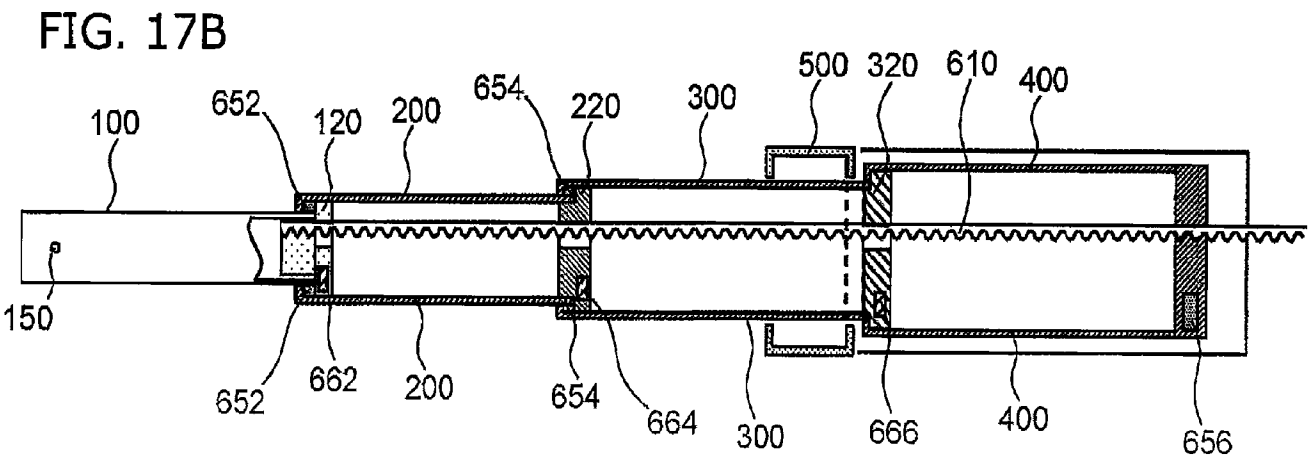

FIG. 17 is a schematic cross-sectional view showing a washing nozzle according to another variation of this embodiment.

In this variation, instead of the engaging mechanisms, magnets and magnetic bodies are used to control the order of advancing/retracting the washing nozzle. More specifically, a magnet 662 is provided near the base end of the nozzle head 100. Likewise, magnets 664, 666 are provided also near the base end of the first cylinder 200 and the second cylinder 300.

On the other hand, a magnetic body 652 is provided near the tip portion of the first cylinder 200. Likewise, a magnetic body 654 is provided near the tip portion of the second cylinder 300. Furthermore, a magnetic body 656 is provided near the base end of the third cylinder 400. These magnetic bodies 652, 654, 656 can be made of ferromagnetic material such as cobalt or nickel so as to be attracted to the magnets 662, 664, 666. It is noted that the sliders 210, 310, 410 are omitted in FIG. 17 for convenience. However, these sliders can be placed alternately with the magnetic bodies 652, 654, 656, or can be placed adjacently.

The order of advancing/retracting the washing nozzle can be controlled by adjusting the relationship of attractive/repulsive force acting between these magnets and magnetic bodies. For example, in the housed state of the washing nozzle as shown in FIG. 17A, a repulsive force acts between the magnet 662 and the magnet 664, a relatively weak attractive force acts between the magnet 664 and the magnet 666, and a relatively strong attractive force acts between the magnet 666 and the magnetic body 656. Then, the washing nozzle can be advanced in a suitable order.

FIG. 18 is a schematic cross-sectional view for describing the advancing motion of the washing nozzle of this variation.

Figure 18A:
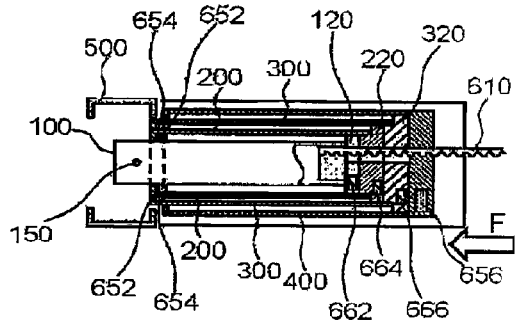
FIGS. 18A to 18D are schematic cross-sectional views for describing the advancing motion of the washing nozzle of a second variation.

More specifically, in the state shown in FIG. 18A, a repulsive force acts between the magnet 662 and the magnet 664, a weak attractive force acts between the magnet 664 and the magnet 666, and a strong attractive force acts between the magnet 666 and the magnetic body 656. Hence, when the flexible rack 610 is let out in the direction of arrow F, the nozzle head 100 first starts to advance by the repulsive force acting between the magnet 662 and the magnet 664.

Figure 18B:
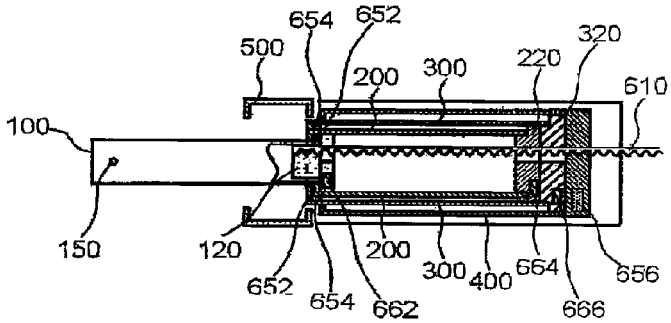

As shown in FIG. 18B, when the nozzle head 100 is completely advanced, its stopper 120 abuts the first cylinder 200, and the driving force is transmitted thereto. At this time, because the attractive force acting between the magnet 664 and the magnet 666 is weaker than the attractive force acting between the magnet 666 and the magnetic body 656, the second cylinder 300 remains retracted, and only the first cylinder 200 starts to advance.

Figure 18C:
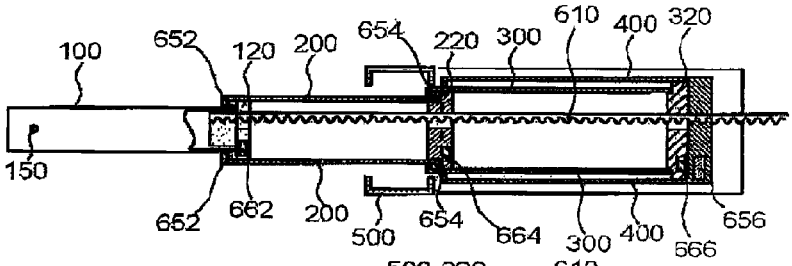
Figure 18D:
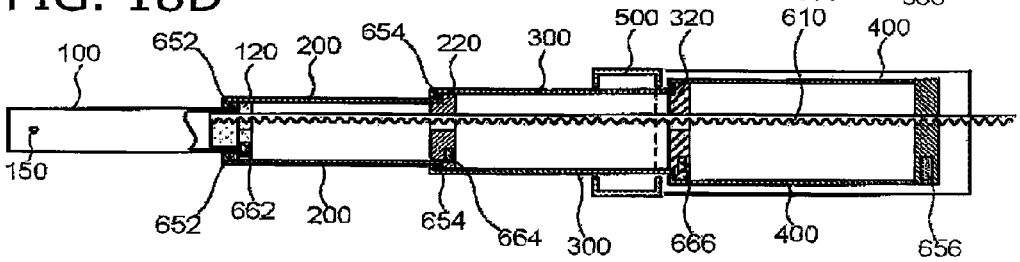

Next, as shown in FIG. 18C, when the first cylinder 200 is completely advanced, its stopper 220 abuts the second cylinder 300, and the driving force is transmitted thereto. Then, the second cylinder 300 overcomes the attractive force acting between the magnet 666 and the magnetic body 652 and starts to advance. Thus, as shown in FIG. 18D, the washing nozzle is extended.

On the other hand, in this extended state of the washing nozzle, the washing nozzle can be retracted in a suitable order by adjusting the relationship between the attractive force acting between the magnet 662 and the magnetic body 652 and the attractive force acting between the magnet 664 and the magnetic body 654.

FIG. 19 is a schematic cross-sectional view for describing the retracting motion of the washing nozzle of this variation.

Figure 19A:
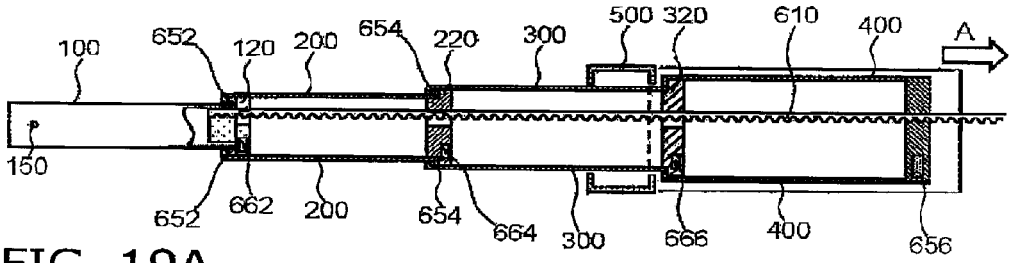
FIGS. 19A to 19D are schematic cross-sectional views for describing the retracting motion of the washing nozzle of the second variation.

More specifically, in the extended state of the washing nozzle as shown in FIG. 19A, adjustment is made so that the attractive force acting between the magnet 662 and the magnetic body 652 is relatively large and the attractive force acting between the magnet 664 and the magnetic body 654 is relatively small. At this time, the magnet 666 is scarcely affected by attractive and repulsive force from either the magnet 664 or the magnetic body 656 because of the large distance.

In this state, when the flexible rack 610 is pulled back in the direction of arrow A, the first cylinder 200 and the second cylinder 300 start to retract with the nozzle head 100 by the attractive force acting between the magnet 662 and the magnetic body 652 and the attractive force acting between the magnet 664 and the magnetic body 654.

Figure 19B:
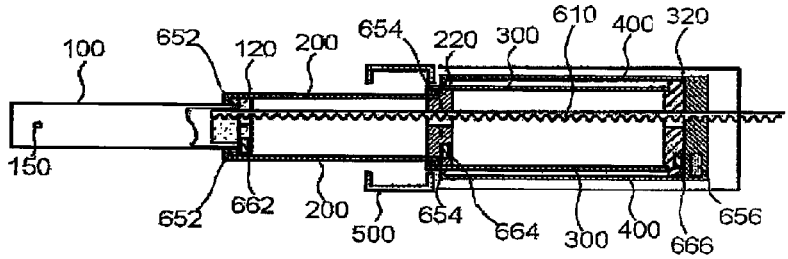

Then, as shown in FIG. 19B, the second cylinder 300 abuts the stopper (not shown) of the third cylinder 400. At this time, because the attractive force acting between the magnet 662 and the magnetic body 652 is relatively large, it overcomes the attractive force acting between the magnet 664 and the magnetic body 654 and separates them. Thus, the first cylinder 200 starts to retract.

Figure 19C:
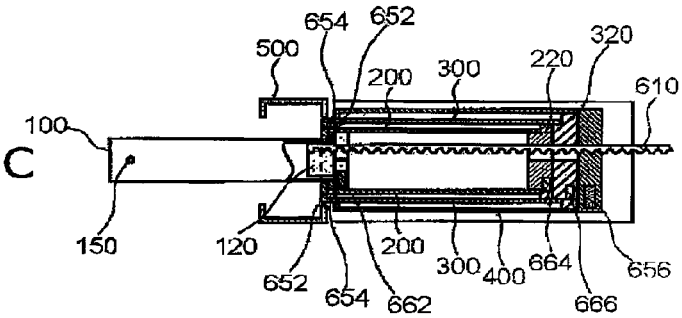
Figure 19D:
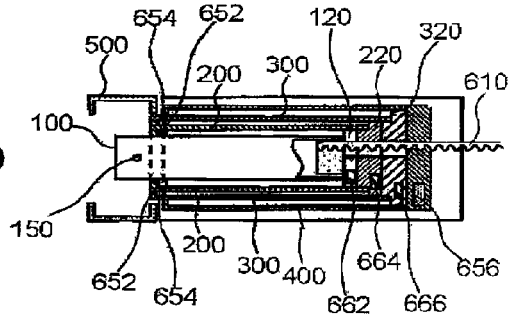

Next, as shown in FIG. 19C, when the first cylinder 200 is retracted to the rear end, the nozzle head 100 starts to retract by overcoming the attractive force acting between the magnet 662 and the magnetic body 652. Thus, as shown in FIG. 19D, the washing nozzle is completely housed.

As described above, the washing nozzle can be advanced and retracted in a prescribed order by suitably placing magnets and magnetic bodies in the nozzle head 100 and the first to third cylinder 200, 300, 400.

It is noted that the layout of the magnets and magnetic bodies and the relationship of attractive force or repulsive force acting therebetween in this variation are illustrative only. That is, the washing nozzle can be advanced sequentially from its inner element if, in the housed state of the washing nozzle, the effect of maintaining its outer element in the housed state is relatively large. For example, this variation is applicable if, in the housed state of the washing nozzle, the force of maintaining the second cylinder 300 in the housed state is the largest, the force of maintaining the first cylinder 200 in the housed state is smaller than that, and the force of maintaining the nozzle head 100 in the housed state is the smallest, or conversely, a force of advancing the nozzle head 100 acts thereon.

On the other hand, the washing nozzle can be retracted from the extended state sequentially from its outer element if the effect of maintaining its inner element in the extended state is relatively large. For example, this variation is applicable if, in the extended state of the washing nozzle, the force of maintaining the nozzle head 100 in the extended state is the largest, the force of maintaining the first cylinder 200 in the extended state is smaller than that, and the force of maintaining the second cylinder 300 in the extended state is the smallest, or conversely, a force of retracting the second cylinder 300 acts thereon.

As described above, the washing nozzle can be advanced and retracted in a prescribed order also by using magnets and magnetic bodies and suitably adjusting attractive/repulsive forces therebetween.

Next, the cylinder, slider, stopper and the like that can be provided in this embodiment are described in more detail with reference to examples.

Figure 20:
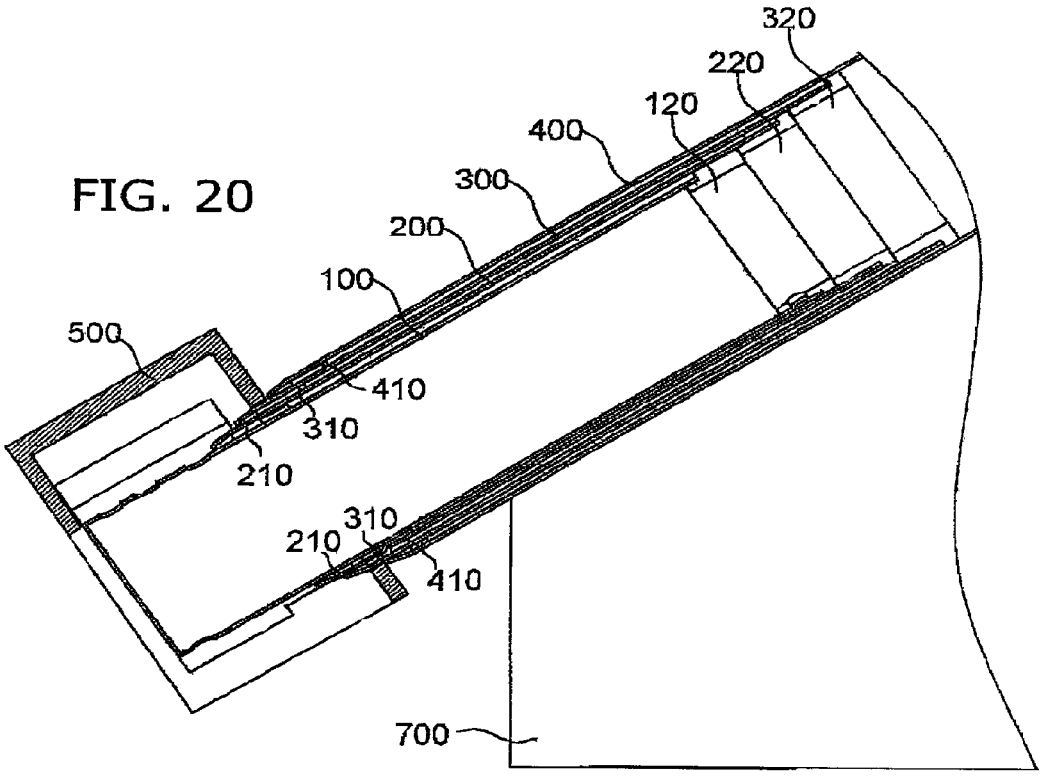
FIG. 20 is a schematic view illustrating the cross-sectional structure of the washing nozzle in the housed state.

FIG. 20 is a schematic view illustrating the cross-sectional structure of the washing nozzle in the housed state.

Figure 21:
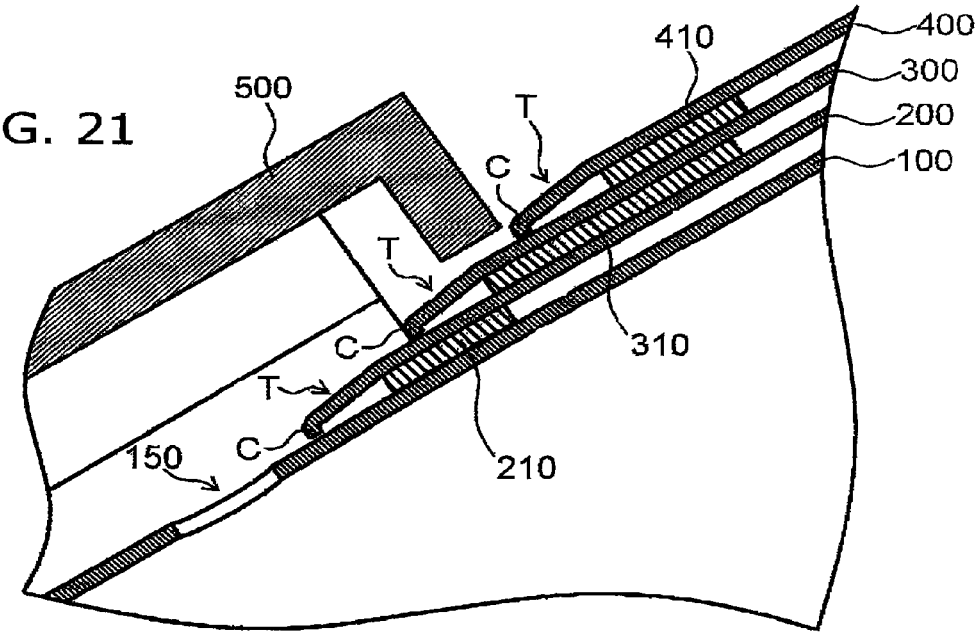
FIG. 21 is a partial cross-sectional view in the vicinity of the tip of this washing nozzle.

FIG. 21 is a partial cross-sectional view in the vicinity of the tip of this washing nozzle.

Figure 22:
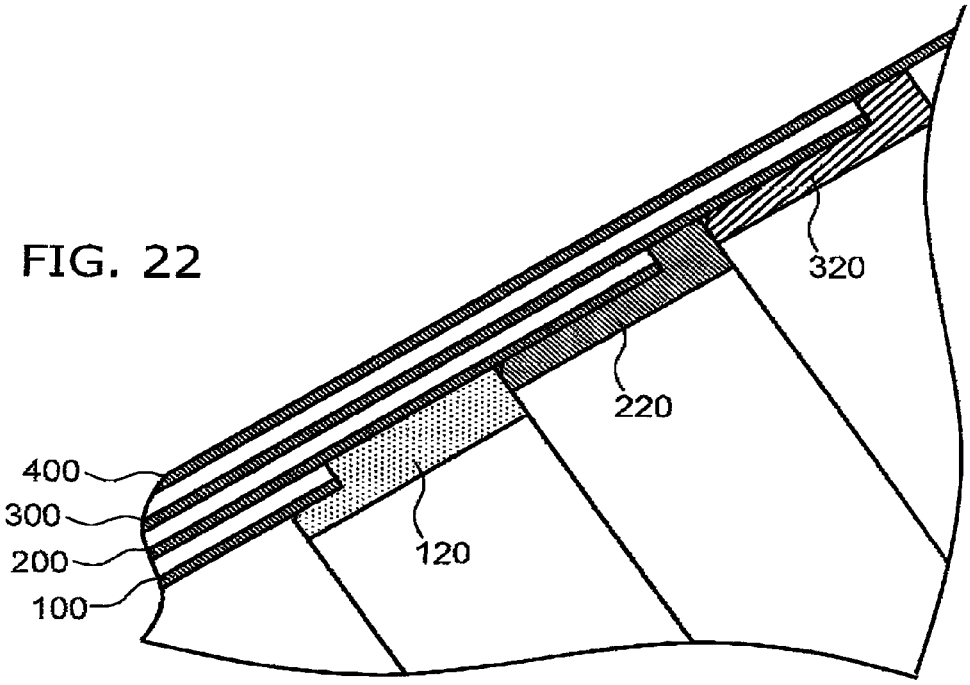
FIG. 22 is a partial cross-sectional view in the vicinity of the base end of this washing nozzle.

FIG. 22 is a partial cross-sectional view in the vicinity of the base end of this washing nozzle.

In this example, the nozzle head 100 and the first to third cylinder 200, 300, 400 are made of a metallic cylindrical body. However, the nozzle head 100 does not necessarily need to be metallic, but can illustratively be made of resin or the like.

If the nozzle head 100 and the first to third cylinder 200, 300, 400 are made of metal, a sufficient mechanical strength is obtained even with a small wall thickness. Hence, the increase in thickness of the nozzle portion can be prevented even for the multistage nozzle. Furthermore, the surface is resistant to flaws and deformation, and smooth sliding motion can be maintained even if the advancing/retracting motion is repeated for a long time. A metal material such as stainless steel, and aluminum with an alumite-treated surface, is advantageous as a material of the washing nozzle of the sanitary washing toilet seat device, also in regard to being resistant to rust and capable of maintaining cleanliness for a long time.

It is noted that the surface of the nozzle head 100 and the first and second cylinder 200, 300 can be coated with a film or a cover layer. For example, coating with a film made of resin provides resistance to dirt and rust, and allows smooth sliding motion. A similar effect can be expected by coating with a cover layer containing ceramics or the like.

On the other hand, also in this example, the nozzle head 100 and the first to third cylinder 200, 300, 400 are not in direct contact with each other, but are slidable in abutment with and supported by generally ring-shaped sliders 210, 310, 410 and stoppers 120, 220, 320 made of resin or the like. More specifically, the sliders 210, 310, 410 are provided inside the first to third cylinder 200, 300, 400 near the tip thereof, respectively. The stoppers 120, 220, 320 are provided at the base end of the nozzle head 100 and the first and second cylinder 200, 300 so as to protrude toward the periphery, respectively. Hence, the nozzle head 100, for example, is slidably supported in abutment with the stopper 120 and the slider 210, and is not in direct contact with the first cylinder 200. Likewise, the first cylinder 200 is slidably supported in abutment with the stopper 220 and the slider 310, and is not in direct contact with the second cylinder 300. The second cylinder 300 is also not in direct contact with the third cylinder 400, but is slidably supported in abutment with the stopper 320 and the slider 410.

In the case where the nozzle head 100 and the first to third cylinder 200, 300, 400 are made of metal, sliding these members in direct contact with each other results in a large sliding resistance and is likely to produce flaws and unusual noise. To prevent this, if the gap between the members is excessively increased, water or the like is likely to enter from outside.

In contrast, in this example, these metallic members are not in direct contact with each other, but are slidably supported by the sliders 210, 310, 410 and stoppers 120, 220, 320 made of resin or the like. Thus, it is possible to decrease the sliding resistance, avoid flaws and the like, and also prevent entry of water and the like from outside.

Furthermore, the sliders 210, 310, 410 and the stoppers 120, 220, 320 also serve to determine the stroke end of the nozzle head 100 and the first and second cylinder 200, 300. More specifically, in the housed state, as shown in FIG. 4, the stoppers abut each other. That is, the retraction limit of the nozzle head 100 and the first and second cylinder 200, 300 is regulated by the stoppers 120, 220, 320.

Furthermore, as described below with reference to FIG. 8 and the like, when the nozzle head 100 and the first and second cylinder 200, 300 are advanced, the sliders 210, 310, 410 abut the stoppers 120, 220, 320. That is, the advancement limit is regulated by the sliders 210, 310, 410 and the stoppers 120, 220, 320.

On the other hand, in this example, a narrowed portion T with its outer diameter narrowed in a generally tapered configuration is provided near the tip of the first to third cylinder 200, 300, 400, and a tucked portion C folded toward the central axis is provided at the extreme tip.

Such narrowed portions T and tucked portions C can prevent entry of water and foreign matter from the tip of these cylinders 200, 300, 400. Furthermore, if any foreign matter or the like is attached to the outer wall of the cylinder, it can be easily removed with the sliding motion. Moreover, the washing nozzle can be smoothly wiped so that cloth or the like is not caught at the tip of the cylinder. Furthermore, there is no concern about injury to hands and the like.

Figure 23:
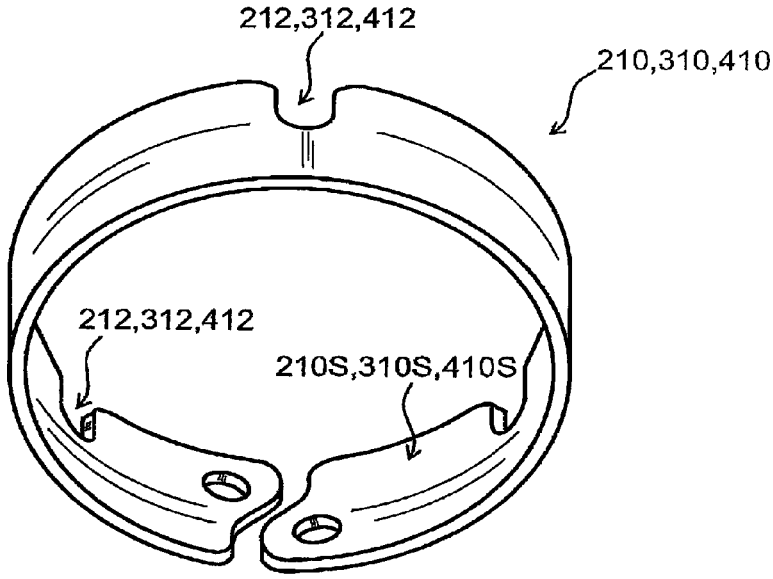
FIG. 23 is a schematic perspective view of a slider provided in this example.

FIG. 23 is a schematic perspective view showing an example slider provided in this example. That is, this figure is a perspective view of the slider 210, 310, 410 as viewed from the tip side of the washing nozzle.

Figure 24:
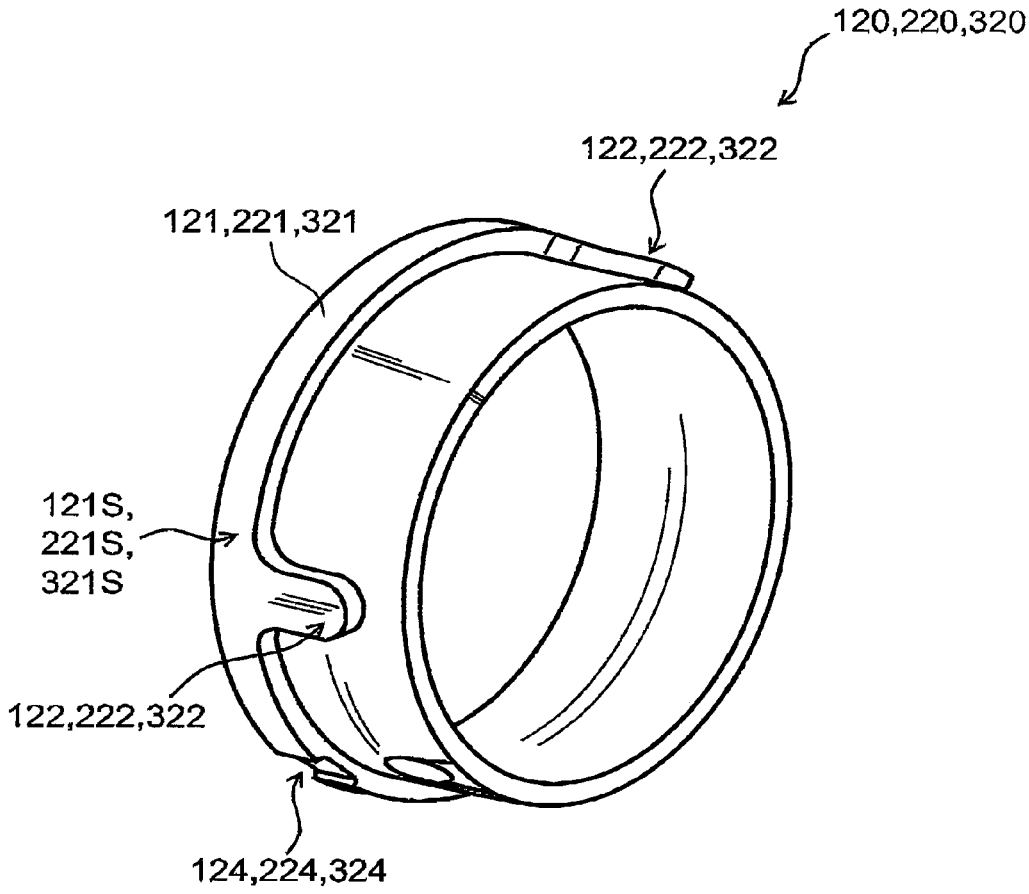
FIG. 24 is a perspective view of the slider 210, 310, 410 as viewed slightly from the tip side of this washing nozzle.

FIG. 24 is a schematic perspective view of the stopper provided in this example. This figure is likewise a perspective view of the stopper 120, 220, 320 as viewed slightly from the tip side of the washing nozzle.

The slider 210, 310, 410 has an inner peripheral wall 210S, 310S, 410S slidably abutting the nozzle head 100 or the cylinder 200, 300 provided inside the inner peripheral wall 210S, 310S, 410S. It is noted that the inner peripheral wall 210S, 310S, 410S can be partly bulged inside so that the resulting apex slidably abuts the nozzle head 100 or the cylinder 200, 300. This can prevent the problem of the slider 210, 310, 410 sticking to the nozzle head 100 or the cylinder 200, 300 due to the solidification of calcium components and the like in wash water.

On the other hand, the stopper 120, 220, 320 has, on its base end side, an extending portion 121, 221, 321 overhanging in the peripheral direction. The outer peripheral wall 121S, 221S, 321S of this extending portion 121, 221, 321 slidably abuts the cylinder 200, 300, 400 provided outside the outer peripheral wall 121S, 221S, 321S.

The material of the slider 210, 310, 410 can illustratively be PET (polyethylene terephthalate). The material of the stopper 120, 220, 320 can illustratively be POM (polyoxymethylene/polyacetal resin) and the like. These materials can be used to facilitate slidably and abuttably supporting the nozzle head 100, cylinders 200, 300 and the like made of stainless steel.

Furthermore, the slider 210, 310, 410 is provided with a depression 212, 312, 412 opened toward the base end of the washing nozzle. On the other hand, the stopper 120, 220, 320 is provided with a projection 122, 222, 322 in which the extending portion 121, 221, 321 protrudes toward the tip of the washing nozzle. In the extended state of the washing nozzle, the depression 212, 312, 412 of the slider can be engaged with the projection 122, 222, 322 of the stopper to prevent rotation of the nozzle head 100 and the cylinders 200, 300, 400.

On the other hand, the extending portion 121, 221, 321 of the stopper 120, 220, 320 is provided with a depression 124, 224, 324. As described below in detail, this depression 124, 224, 324 engages with an engaging thread formed on the cylinder provided outside the depression 124, 224, 324 and serves to prevent rotation of the washing nozzle in the housed state and during the advancing/retracting motion.

Figure 25:
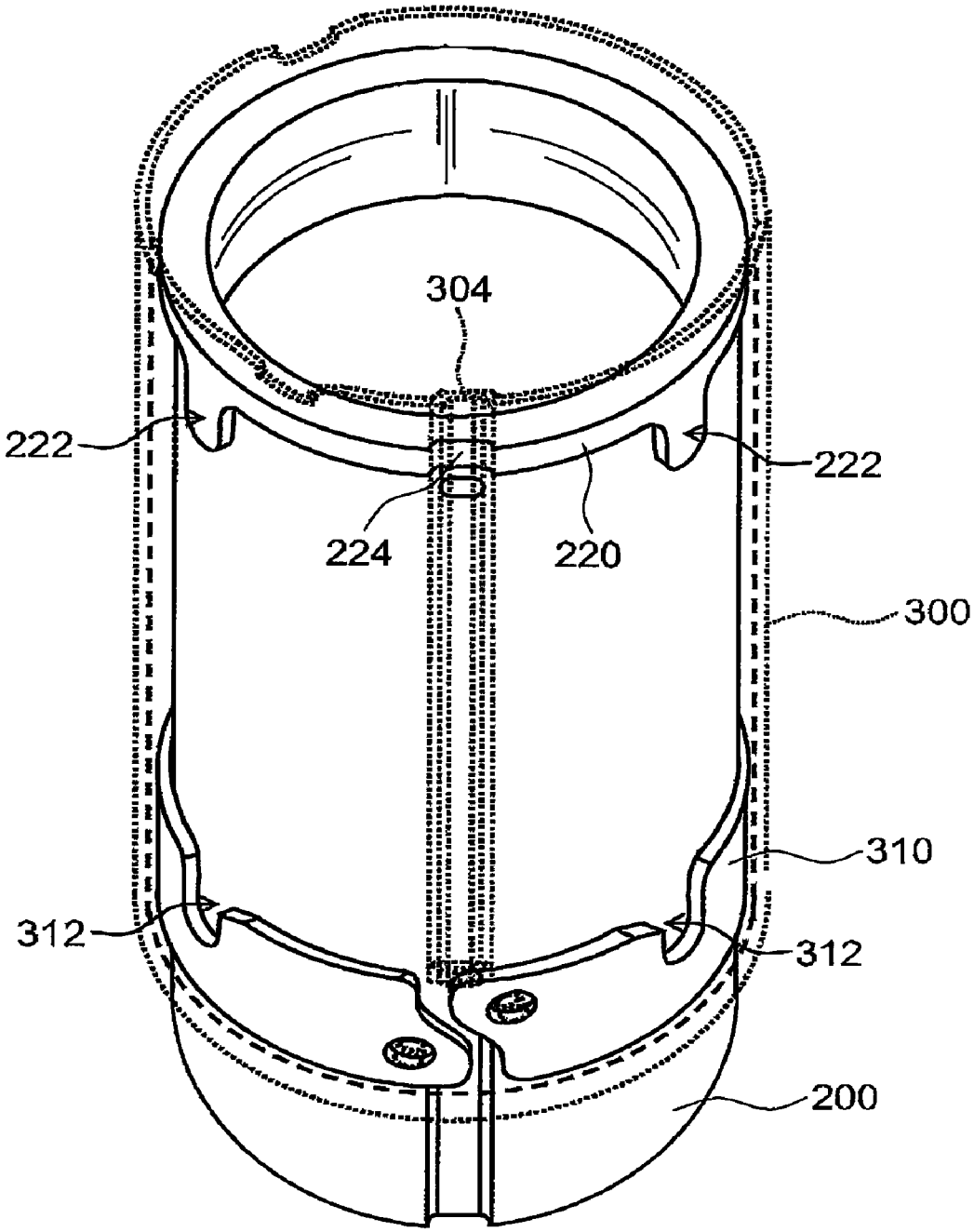
FIG. 25 is a schematic view showing the layout of the first and second cylinder 200, 300 in the housed state.

FIG. 25 is a partially transparent perspective view showing the layout of the first and second cylinder 200, 300 in the housed state. That is, this figure is a perspective view of these cylinders as viewed from the base end side.

The first cylinder 200 placed inside is provided with a stopper 220. The second cylinder 300 placed outside is provided with a slider 310. The first cylinder 200 is slidably supported in abutment with the slider 310 and the stopper 220.

Furthermore, the second cylinder 300 is provided with an engaging thread 304 in parallel to its sliding direction. The engaging thread 304 protrudes toward the central axis of the cylinder 300 and engages with the depression 224 provided in the stopper 220. A similar engaging thread is also provided on the first cylinder 200, but not shown in FIG. 25 for simplicity.

The second cylinder 300 slides with the engaging thread 304 engaged with the depression 224. Thus, the engaging thread 304 provided on the second cylinder 300 can be engaged with the depression 224 provided in the stopper 220 located inside to prevent rotation of the cylinder 300 in the housed state and during the advancing/retracting motion.

Consequently, deviation of the direction of water discharge from the water discharge port 150 provided in the nozzle head 100 is prevented, and water can be discharged constantly in a given direction.

Figure 26:
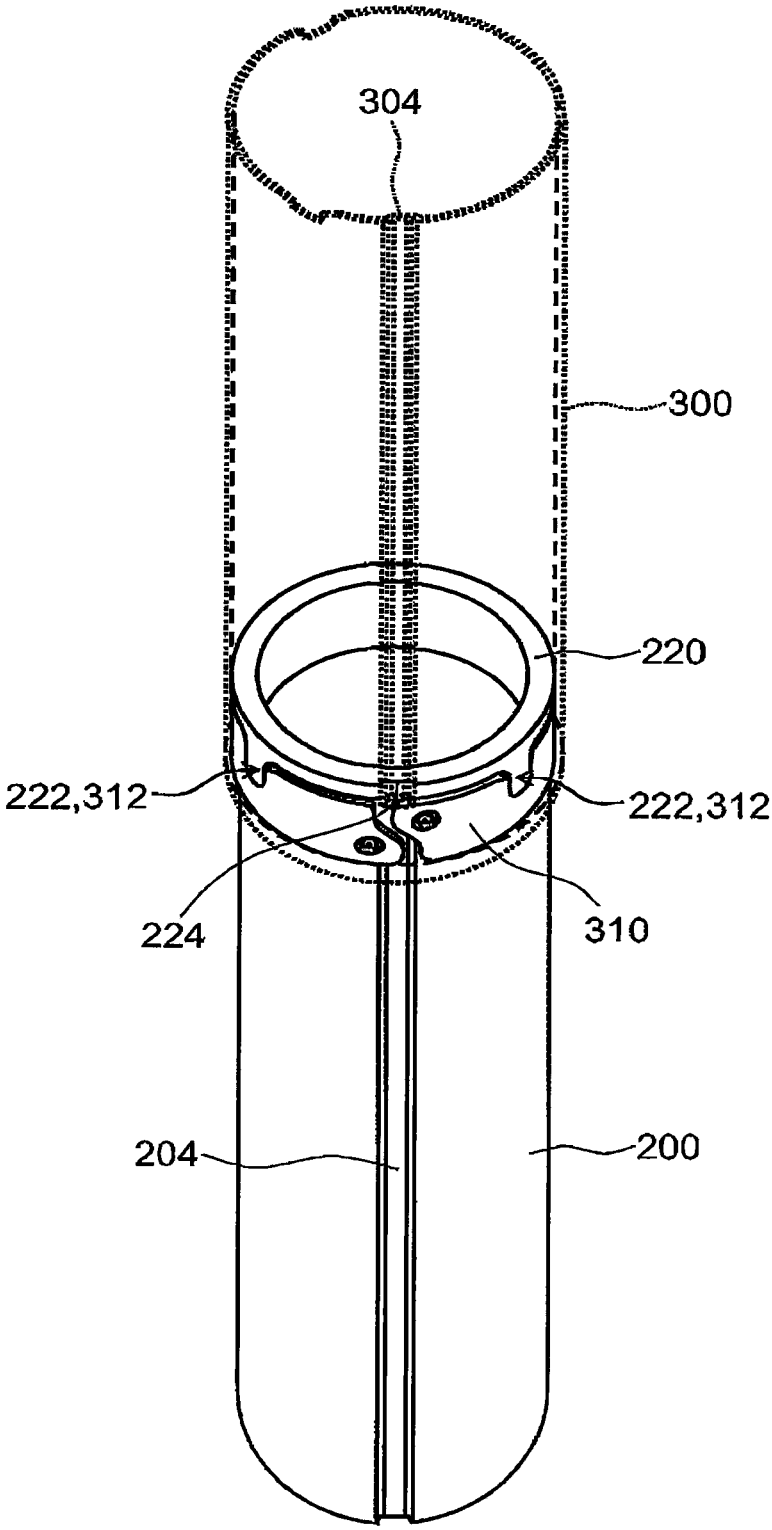
FIG. 26 is a partially transparent perspective view showing the layout of the first and second cylinder 200, 300 in the extended state.

FIG. 26 is a partially transparent perspective view showing the layout of the first and second cylinder 200, 300 in the extended state.

Figure 27:
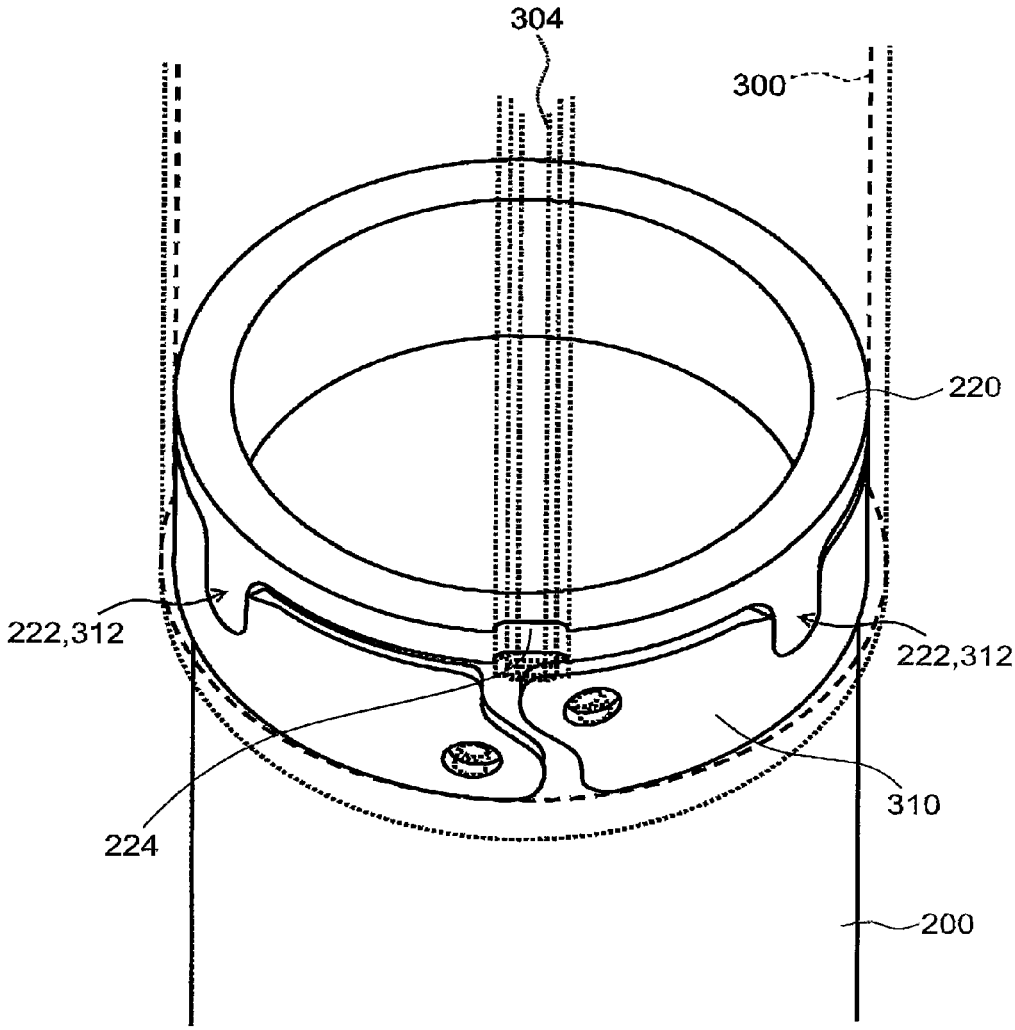
FIG. 27 is a partial enlarged view of FIG. 26.

FIG. 27 is a partial enlarged view of FIG. 26. These figures are perspective views of the cylinders as viewed from the base end side.

In the state of the first cylinder 200 advanced to its stroke end, the engaging thread 304 provided on the second cylinder 300 is still engaged with the depression 224 provided in the stopper 220. Furthermore, the depression 312 provided in the slider 310 engages with the projection 222 provided in the stopper 220. Consequently, relative rotation of these cylinders 200, 300 is blocked more firmly.

Thus, in the extended state of the washing nozzle, its rotation is blocked more firmly. Hence, also during cleaning the washing nozzle, for example, its rotation can be prevented. More specifically, when the washing nozzle is cleaned, it may be wiped with cloth and the like in the state advanced to the stroke end. At this time, the washing nozzle may be subjected to a force in the rotation direction. However, in this example, the engaging thread 304 is engaged with the depression 224, and furthermore, the depression 312 is engaged with the projection 222. Hence, rotation of the washing nozzle can be firmly blocked. Consequently, even if the washing nozzle is cleaned, deviation of the water discharge direction can be prevented, and water can be discharged constantly in a given direction.

The washing nozzle is cleaned when a user is not seated on the toilet seat of the sanitary washing toilet seat device. Furthermore, at that time, it is preferable that the washing nozzle be completely extended. Hence, a switch for cleaning the washing nozzle is desirably provided. Such a switch can be provided on the body of the sanitary washing toilet seat device, or can be provided on the remote controller of the sanitary washing toilet seat device.

Figure 28:
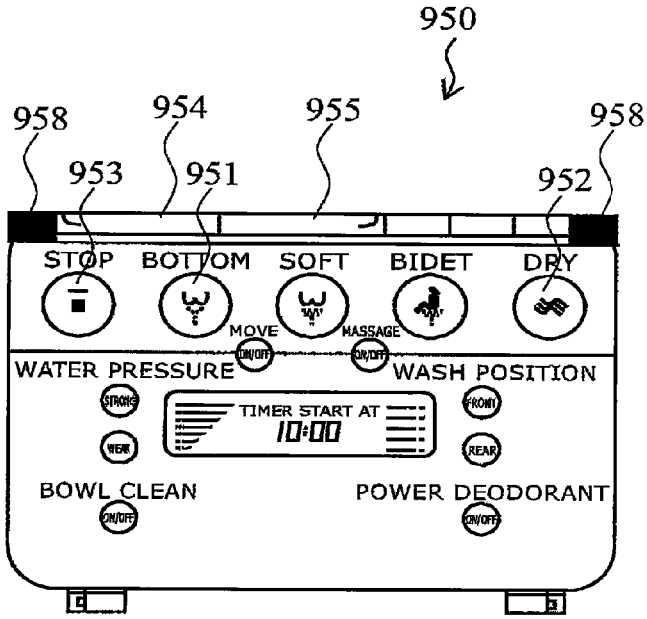
FIG. 28 is a schematic view illustrating the control panel of the remote controller of the sanitary washing toilet seat device.

FIG. 28 is a schematic view illustrating the control panel of the remote controller of the sanitary washing toilet seat device.

The remote controller of this example includes a set of switches for controlling the operation of the warm water washing toilet seat device, illustratively including a bottom wash switch 951, a warm air dry switch 952, and a stop switch 953. Furthermore, automatic flushing of the flush toilet bowl with wash water is also available, and a big flush switch 954 and a small flush switch 955 are provided. Moreover, a transmitter 958 based on an infrared LED (light emitting diode) is provided so that a signal is transmitted to the warm water washing toilet seat device.

Cleaning of the washing nozzle is relatively less frequent, and a special operation. Hence, it is suitable to provide the switch therefor inside the lid.

Figure 29:
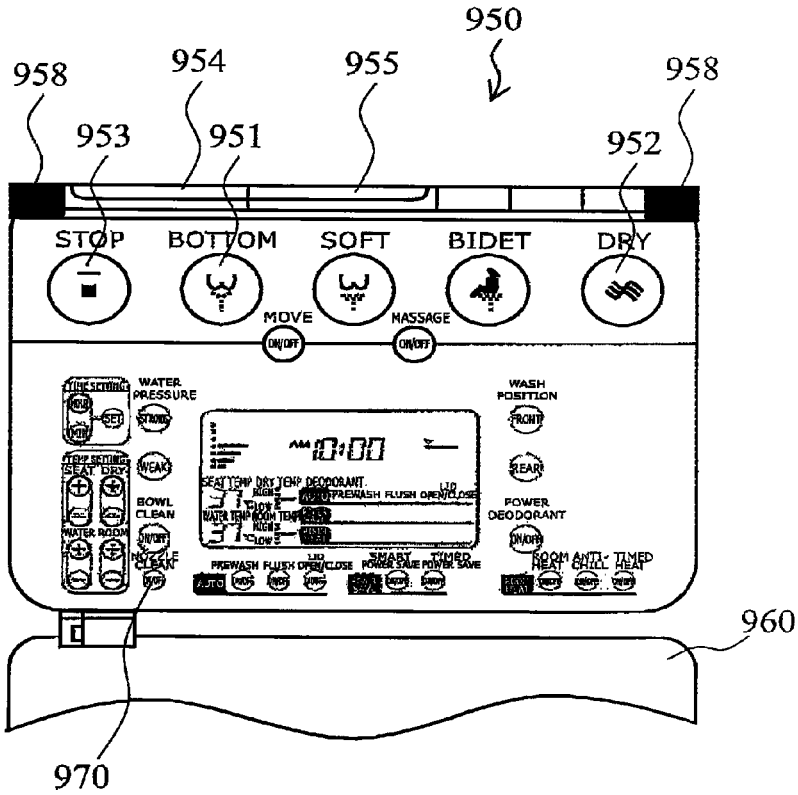
FIG. 29 is a schematic view illustrating the setting control panel inside the lid of the remote controller 950.

FIG. 29 is a schematic view illustrating the setting control panel inside the lid of the remote controller 950.

More specifically, the remote controller 950 of this example includes various setting switches and the like inside its front lid 960. It also includes a "nozzle clean" switch 970 for cleaning the washing nozzle. When the user manipulates the "nozzle clean" switch 970, the washing nozzle is completely extended as shown in FIG. 1B even if the user is not seated on the toilet seat. At this time, as described above with reference to FIGS. 26 and 27, the sliders 210, 310, 410 are engaged with the stoppers 120, 220, 320 to firmly block rotation of the washing nozzle. Hence, even if the user wipes the washing nozzle using cloth or paper with some force, rotation of the washing nozzle can be blocked. This can prevent deviation of the water discharge direction and damage to the washing nozzle and the mechanics provided therein.

Next, the motion of the multistage washing nozzle of this example is described.

FIG. 30 is a schematic partial cross-sectional view showing the advancing motion of the washing nozzle. It is noted that FIG. 30 is a schematic view of the washing nozzle as viewed from above.

Figure 30A:
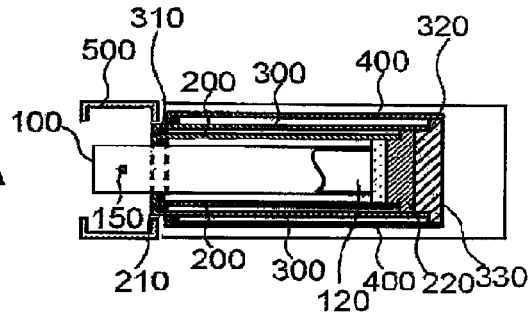
FIGS. 30A to 30D are schematic partial cross-sectional views showing the advancing motion of the washing nozzle.
Figure 30B:
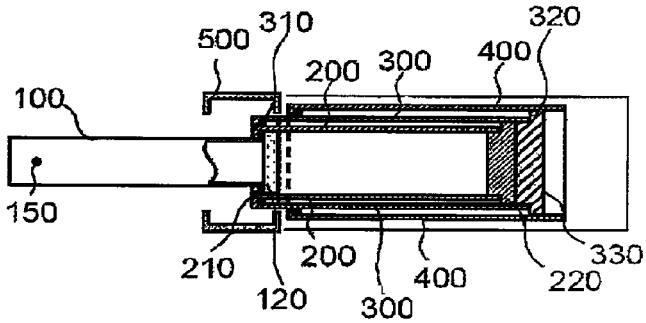
Figure 30C:
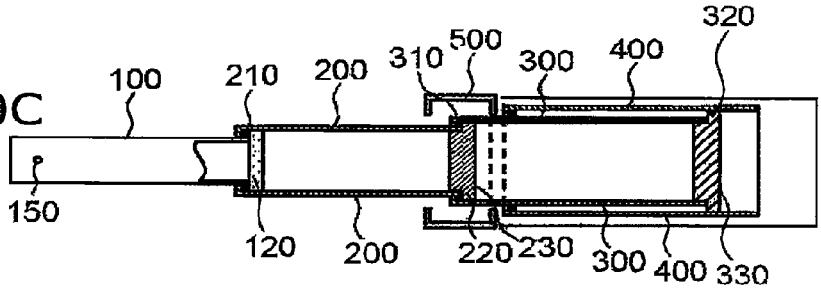

The advancing motion of the multistage washing nozzle can be performed sequentially from the inner element. More specifically, from the housed state of the washing nozzle as shown in FIG. 30A, first, as shown in FIG. 30B, the nozzle head 100 advances while passing through the cleaning chamber 500. Next, as shown in FIG. 30C, the first cylinder 200 advances while passing through the nozzle cleaning chamber 500. Finally, the second cylinder 300 advances while passing through the nozzle cleaning chamber 500, resulting in the extended state of the washing nozzle.

Figure 30D:
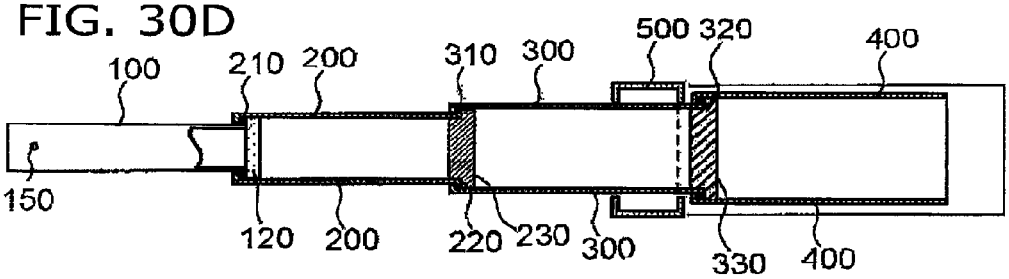

Thus, the washing nozzle is advanced from the inner movable portion, which is sequentially passed through the nozzle cleaning chamber 500. Hence, the outer peripheral surface of the movable portions of the nozzle can be entirely and evenly cleaned in the nozzle cleaning chamber 500. More specifically, when the sanitary washing toilet seat device is used, water is squirted to the "bottom" and the like of a user in the extended state of the washing nozzle as shown in FIGS. 1B and 30D or in a similar state. This washing operation can remove dirt and the like to cleanly wash the "bottom" and the like.

Furthermore, according to this example, when the washing nozzle advances to wash the "bottom" and the like, the washing nozzle can be passed through the nozzle cleaning chamber 500 in the order of the nozzle head 100, the first cylinder 200, and the second cylinder 300 while being cleaned therein. Consequently, the outer peripheral surface of the movable portions of the washing nozzle exposed outside in the extended state can be entirely and evenly cleaned. Consequently, the washing nozzle can be always kept clean, and the sanitary washing toilet seat device can be maintained in a sanitarily desirable condition. Furthermore, during washing the "bottom" and the like, dirt and the like may be spattered on the washing nozzle. However, according to this embodiment, the outer peripheral surface of the washing nozzle is entirely and evenly wetted in advance, and hence is resistant to attachment of dirt and the like. Consequently, the washing nozzle can be kept clean also after use. Furthermore, it is possible to save trouble to clean the washing nozzle, and prevent malfunction, failure and the like of the washing nozzle due to any attached dirt. A similar effect is also achieved when the washing nozzle is advanced for nozzle cleaning (see FIG. 29).

Furthermore, when the washing nozzle thus advances, the engaging thread (e.g., 304) provided on each cylinder slides while being engaged with the holding depression (e.g., 224) provided in the associated stopper. Hence, rotation of these elements can be prevented. Consequently, deviation of the water discharge direction is eliminated, and a stable cleaning effect is achieved.

Next, the retracting motion of the washing nozzle of this example is described.

FIG. 31 is a schematic partial cross-sectional view showing the retracting motion of the washing nozzle. It is noted that FIG. 31 is also a schematic view of the washing nozzle as viewed from above.

Figure 31A:
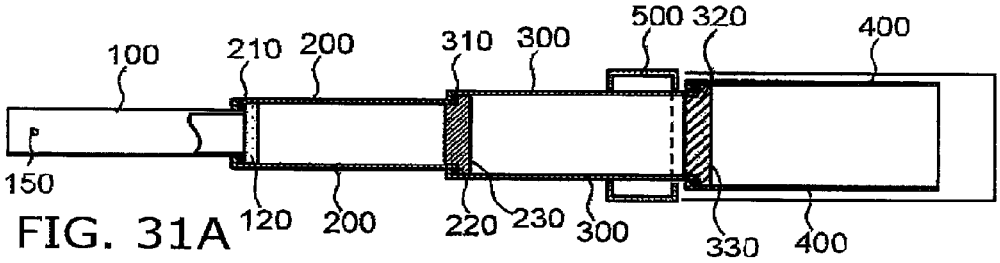
Figure 31B:
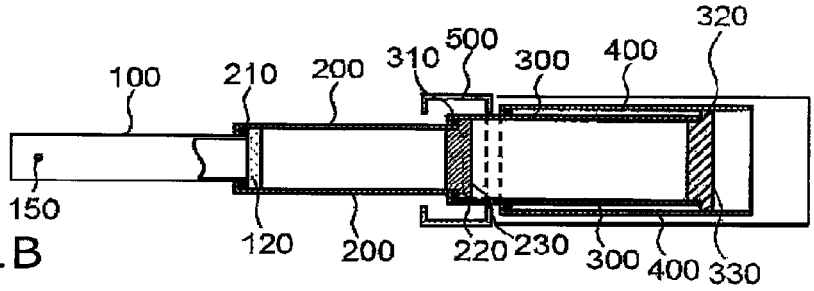
Figure 31C:
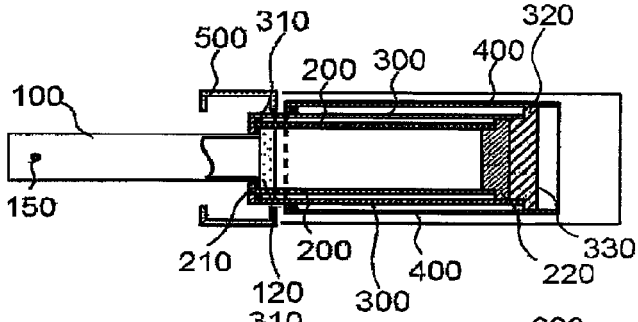
Figure 31D:
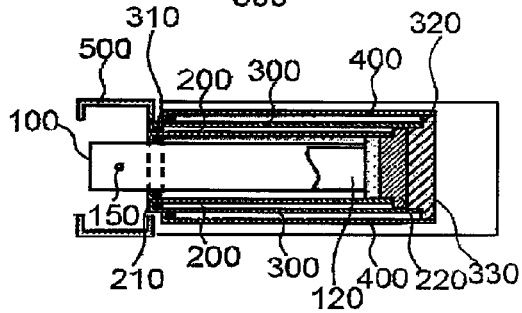

From the extended state of the washing nozzle as shown in FIG. 31A, the second cylinder 300 first retracts while interlocking with the nozzle head 100 and the first cylinder 200 and passing through the nozzle cleaning chamber 500, and is housed in the third cylinder 400 as shown in FIG. 31B. Next, the first cylinder 200 retracts while interlocking with the nozzle head 100 and passing through the nozzle cleaning chamber 500, and is housed in the second cylinder 300 as shown in FIG. 31C. Finally, the nozzle head 100 retracts while passing through the nozzle cleaning chamber 500, and is housed in the first cylinder 200 as shown in FIG. 31D.

Thus, in the retracting motion of the washing nozzle, the washing nozzle is retracted and passed through the nozzle cleaning chamber 500 sequentially from the outer movable portion. Hence, the outer peripheral surface of the movable portions of the nozzle can be entirely and evenly cleaned in the nozzle cleaning chamber 500. More specifically, when water is squirted to wash the "bottom" and the like of a user in the extended state of the washing nozzle as shown in FIGS. 1B and 31A or in a similar state, dirt and the like may attach to the surface of the washing nozzle.

However, according to this embodiment, the second cylinder 300, the first cylinder 200, and the nozzle head 100 can be passed through the nozzle cleaning chamber 500 in this order while undergoing "nozzle body cleaning". That is, the outer peripheral surface of these movable portions that have been exposed outside in the extended state can be entirely and evenly cleaned. Consequently, the washing nozzle can be always kept clean, and the sanitary washing toilet seat device can be maintained in a sanitarily desirable condition. Furthermore, it is possible to reduce trouble to clean the washing nozzle, and prevent malfunction, failure and the like of the washing nozzle due to any attached dirt. A similar effect is also achieved when the washing nozzle is advanced for nozzle cleaning (see FIG. 29).

Furthermore, also when the washing nozzle thus retracts, the engaging thread (e.g., 304) provided on each cylinder slides while being engaged with the holding depression (e.g., 224) provided in the associated stopper. Hence, rotation of these elements can be prevented. Consequently, deviation of the water discharge direction is eliminated, and a stable cleaning effect is achieved.

Next, the water discharge mechanism of the nozzle head 100 in this example is described.

Figure 32A:
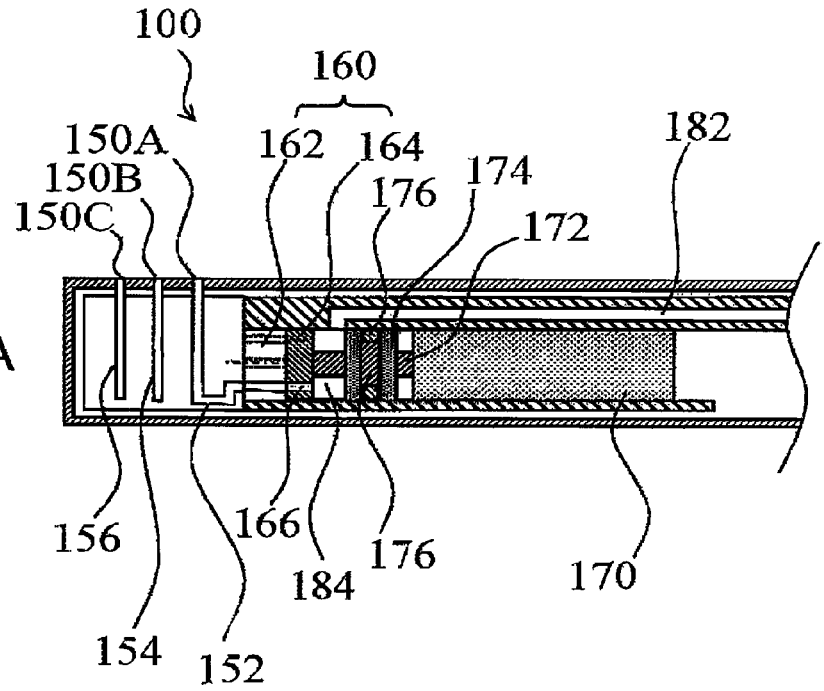
FIGS. 32A and 32B are schematic cross-sectional views illustrating two example internal structures of the nozzle head 100 of this example.
Figure 32B:
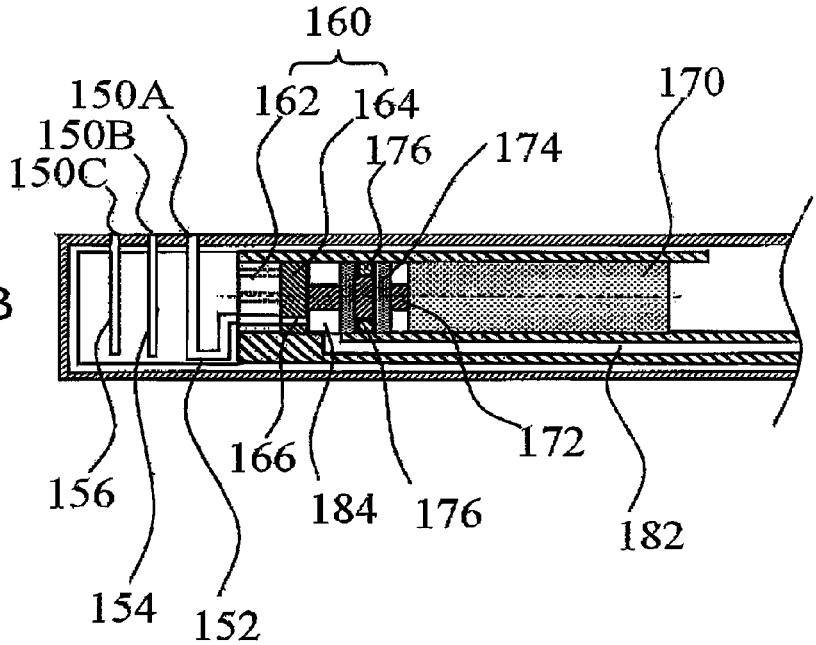

FIGS. 32A and 32B are schematic cross-sectional views illustrating two example internal structures of the nozzle head 100 of this example.

A first water discharge port 150A, a second water discharge port 150B, and a third water discharge port 150C are illustratively provided near the tip of the nozzle head 100. These water discharge ports can be suitably used for various purposes such as the normal "bottom washing", the "bottom washing" of the "soft mode", and "bidet washing". That is, the structure, opening diameter, and water discharge direction of these water discharge ports 150A-150C can be suitably adjusted to provide various water flows adapted to the user's preference and purpose.

These water discharge ports 150A-150C are connected to a switching mechanism 160 through a water flow path. The switching mechanism 160 includes a stator 162 and a rotor 164. The stator 162 is provided with a plurality of water channel openings corresponding to the number of water discharge ports, and the water channel openings illustratively supply water to the water discharge port 150A through the water flow path 152. Although only the water flow path 152 connected to the water discharge port 150A is shown in FIG. 32, the water flow paths 154, 156 led to the water discharge ports 150B, 150C are also in communication with the water channel openings provided in the stator 162 through paths not shown, respectively.

On the other hand, the rotor 164 is provided upstream of and adjacent to the stator 162. The rotor 164 is provided with one water channel opening 166. The rotor 164 is connected to and rotated by the output shaft 172 of a motor 170 and serves to supply water through the water channel opening 166 provided therein to one of the plurality of water channel openings provided in the stator 162. The water supplied from the water supply tube 180 (see FIG. 9) is supplied through a water channel 182 to a distribution chamber 184. The water introduced into the distribution chamber 184 is guided to one of the first to third water discharge port 150A-150C through the water channel opening of the stator 162 selected by the rotation of the rotor 164, and is discharged. Furthermore, the degree of opening of the water channel opening of the stator 162 can be varied by adjusting the rotation angle of the rotor 164 to also control the amount of water.

On the other hand, a partition plate 174 is provided between the distribution chamber 184 and the motor 170, and a waterproof structure is formed with a Y-packing 176. That is, the motor 170 side as viewed from the partition plate 174 is in ambient atmosphere, and water leakage into the motor 170 can be reliably prevented.

According to this example, the rotor 164 can be suitably rotated to select one of the first to third water discharge port 150A-150C and discharge water therefrom, and to adjust the water pressure (or the amount of water) to a desired level.

Furthermore, according to this example, the switching mechanism 160 and the motor 170 are incorporated in the nozzle head 100, and thereby the number of water supply tubes 180 connected to the nozzle head 100 can be reduced to one. That is, the number of water supply tubes 180 disposed in the washing nozzle can be reduced to one. Consequently, the multistage washing nozzle can be smoothly advanced/retracted without interference with the water supply tube.

Here, comparison is made between the two examples shown in FIGS. 32A and 32B. In the example shown in FIG. 32A, the water channel 182 is provided in the upper portion of the nozzle head 100, whereas in the example shown in FIG. 32B, the water channel 182 is provided in the lower portion of the nozzle head 100.

Here, the flow path of water in the nozzle head 100 is described. In the example shown in FIG. 32A, the water supplied through the water channel 182 flows downward into the distribution chamber 184. Then, the water passes through the water channel opening 166 of the rotor and the water channel opening of the stator 162, flows further downward in the water flow path 152, then flows upward, and is ejected from the water discharge port 150A.

Here, the water flow path 152 is directed once downward in order to control the water flow and ejection angle of the discharged water ejected from the water discharge port 150A. That is, to control the water flow and angle of the discharged water ejected from the water discharge port 150A, the water flow path 152 is desirably directed once downward to form a water path making best use of the thickness along the height of the nozzle head 100. However, it is difficult to form, at the bottom of the nozzle head 100, all the plurality of water channel openings provided in the stator 162. Hence, each of the water flow paths extending from the water channel openings provided in the stator 162 to the water discharge ports 150A-150C needs to include a flow path directed downward.

In the example shown in FIG. 32B, the water supplied through the water channel 182 flows upward into the distribution chamber 184. Then, the water passes through the water channel opening 166 of the rotor and the water channel opening of the stator 162, flows conversely downward in the water flow path 152, then flows upward, and is ejected from the water discharge port 150A. That is, from the water channel 182, the water flows once upward, and then flows conversely downward in the water flow path 152. Thus, the direction of water flow changes vertically in a crankshaft configuration. However, such change of water flow in a crankshaft configuration increases pressure loss, and the discharge pressure of water from the water discharge port 150A is likely to decrease.

In contrast, in the example shown in FIG. 32A, the water supplied through the water channel 182 flows downward into the distribution chamber 184. Then, the water passes through the water channel opening 166 of the rotor and the water channel opening of the stator 162, flows further downward in the water flow path 152, then flows upward, and is ejected from the water discharge port 150A. That is, the water flow from the water channel 182 to the lowest point of the water flow path 156 is directed generally downward, and the direction of water flow does not change in a crankshaft configuration. Hence, as compared with the example shown in FIG. 32B, the pressure loss is lower, and the discharge pressure of the water from the water discharge port 150A can be increased.

As described above, in consideration of the pressure loss associated with the direction of water flow, the water channel 182 placed in the upper portion of the nozzle head 100 as shown in FIG. 32A is more favorable than the water channel 182 placed in the lower portion of the nozzle head 100 as shown in FIG. 32B. Hence, the water supply tube 180 disposed inside the washing nozzle is also more favorably placed in the upper portion of the washing nozzle as illustrated in FIG. 9. That is, in the washing nozzle, if the flexible rack 610 is provided below and the water supply tube 180 is provided above, then the effect of reducing the pressure loss of water flow in the nozzle head 100 is achieved.

Next, the overall configuration of the sanitary washing toilet seat device of this embodiment is described.

Figure 33:
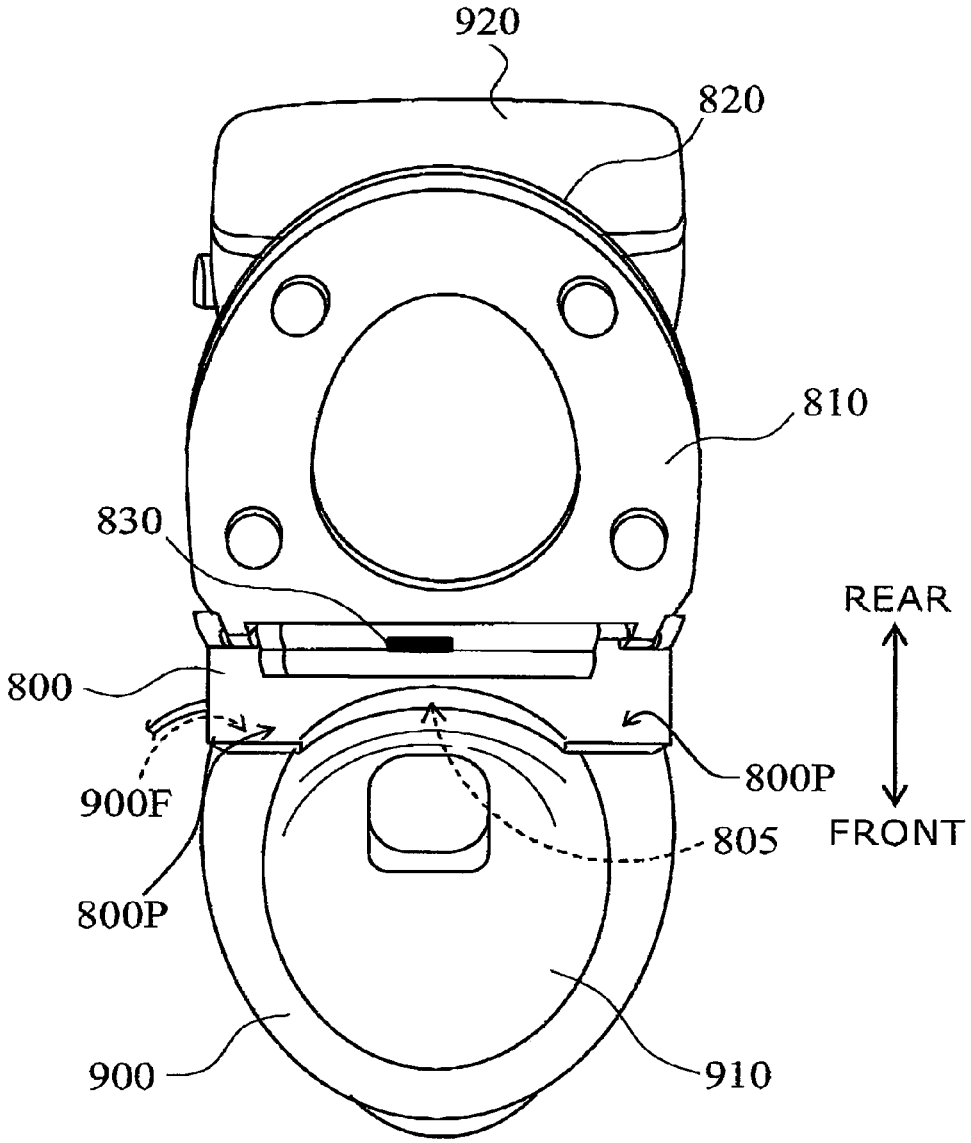
FIG. 33 is a schematic view of a sanitary washing toilet seat device according to an embodiment of the invention as viewed from above.

FIG. 33 is a schematic view of a sanitary washing toilet seat device according to a first example of the invention as viewed from above.

More specifically, this sanitary washing toilet seat device includes a sanitary washing toilet seat device body 800 placed on a flat surface 900F at the rear top of a sit-down toilet bowl 900. The sanitary washing toilet seat device body 800 is provided with a toilet seat 810 and a toilet lid 820. Furthermore, a seating sensor 830 for detecting the presence of a user sitting on the toilet seat 810 is suitably provided.

Figure 34:
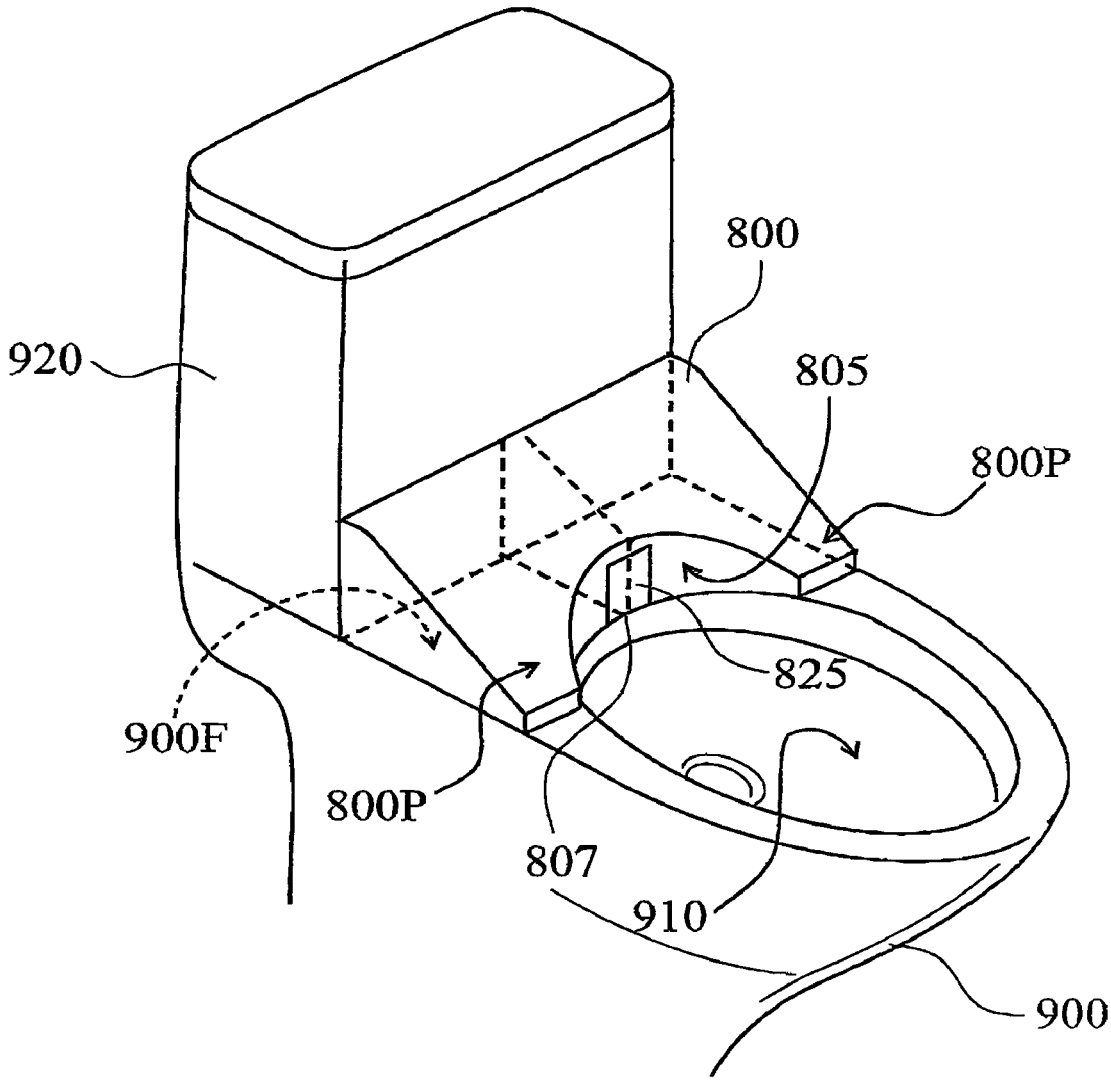
FIG. 34 is a schematic perspective view showing the sanitary washing toilet seat device of this example with the toilet seat 810 and the toilet lid 820 removed.

FIG. 34 is a schematic perspective view showing the sanitary washing toilet seat device of this example with the toilet seat 810 and the toilet lid 820 removed.

The sanitary washing toilet seat device body 800 of this example can squirt water and wash the "bottom" and the like of a user sitting on the toilet seat 810, and has the same features as those widely used under the trade name of "Washlet" and the like. The sanitary washing toilet seat device body 800 can be also provided with other features such as a "warm air drying feature" for drying the wet "bottom", a "toilet seat heating feature" for warming the toilet seat 810, and a "deodorizing feature" for removing odors in the sit-down toilet bowl. Furthermore, it can be also provided with an "automatic opening/closing feature" for automatically opening the toilet lid 820 upon detecting the approaching user and automatically closing the toilet lid 820 when the user leaves. These features can be executed/configured by suitably manipulating a controller (not shown) provided on the sanitary washing toilet seat device body 800, or can be executed by manipulating a remote controller (not shown) placed on the wail or the like of a toilet.

Furthermore, an "automatic flushing feature" for flushing the sit-down toilet bowl 900 with wash water by remote control can be added to the sanitary washing toilet seat device body 800. This feature is based on a driving mechanism for actuating the draining mechanism of a low tank 920 and a flush valve. A signal for operating this driving mechanism is outputted from the sanitary washing toilet seat device body 800 to automatically flush the sit-down toilet bowl 900 with wash water.

In this example, the sanitary washing toilet seat device body 800 is placed on the flat surface 900F at the rear top of the flush sit-down toilet bowl 900, and its front face 805 is curved along the shape of the opening of the bowl 910 of the sit-down toilet bowl 900. Here, "rear" refers to the side on which the low tank 920, the flush valve and the like are typically placed as shown in FIG. 33, that is, the far side as viewed from the user in normal use. Furthermore, an extending portion 800P extending forward is provided on the left and right side of the curved front face 805. Moreover, the curved front face 805 is provided with an opening 807 through which the washing nozzle for washing the "bottom" is to be passed. The opening 807 is provided with a shutter plate 825, and the washing nozzle is housed behind this shutter plate 825.

Figure 35:
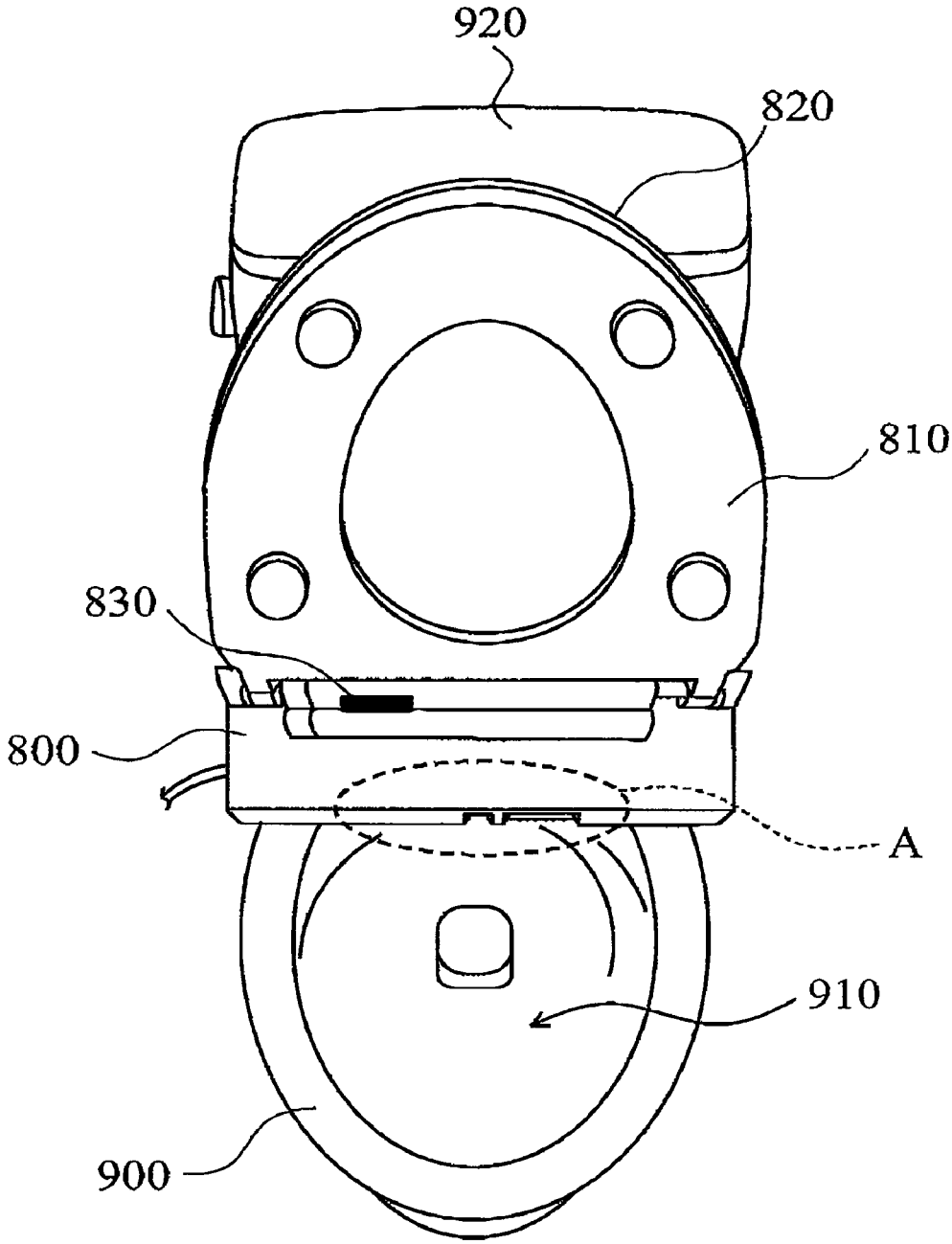
FIG. 35 is a schematic view showing a sanitary washing toilet seat device of a second example.

FIG. 35 is a schematic view showing a sanitary washing toilet seat device of a second example of the invention.

More specifically, in this example, the sanitary washing toilet seat device body 800 has a linear front edge, extending above the bowl 910 of the sit-down toilet bowl 900 and partly covering it as shown by the dashed line A. If the sanitary washing toilet seat device body 800 thus extends above the bowl 910, its backside is likely to become dirty by "spatters" from the pooled water. Furthermore, urine is likely to splash on the extended portion during male urination.

In contrast, in the first example, as shown in FIGS. 33 and 34, the sanitary washing toilet seat device body 800 extends above the bowl 910 only slightly. Consequently, it is unlikely to become dirty, and urine is unlikely to splash thereon even during male urination. Furthermore, it is possible to save trouble to detach the sanitary washing toilet seat device body 800 from the sit-down toilet bowl 900 at each cleaning time, and thus cleaning is significantly facilitated. Moreover, a simple and sleek appearance is achieved, providing users with a feeling of cleanliness and sanitariness. Thus, it is possible to offer a toilet device with comfortable usage.

Figure 36:
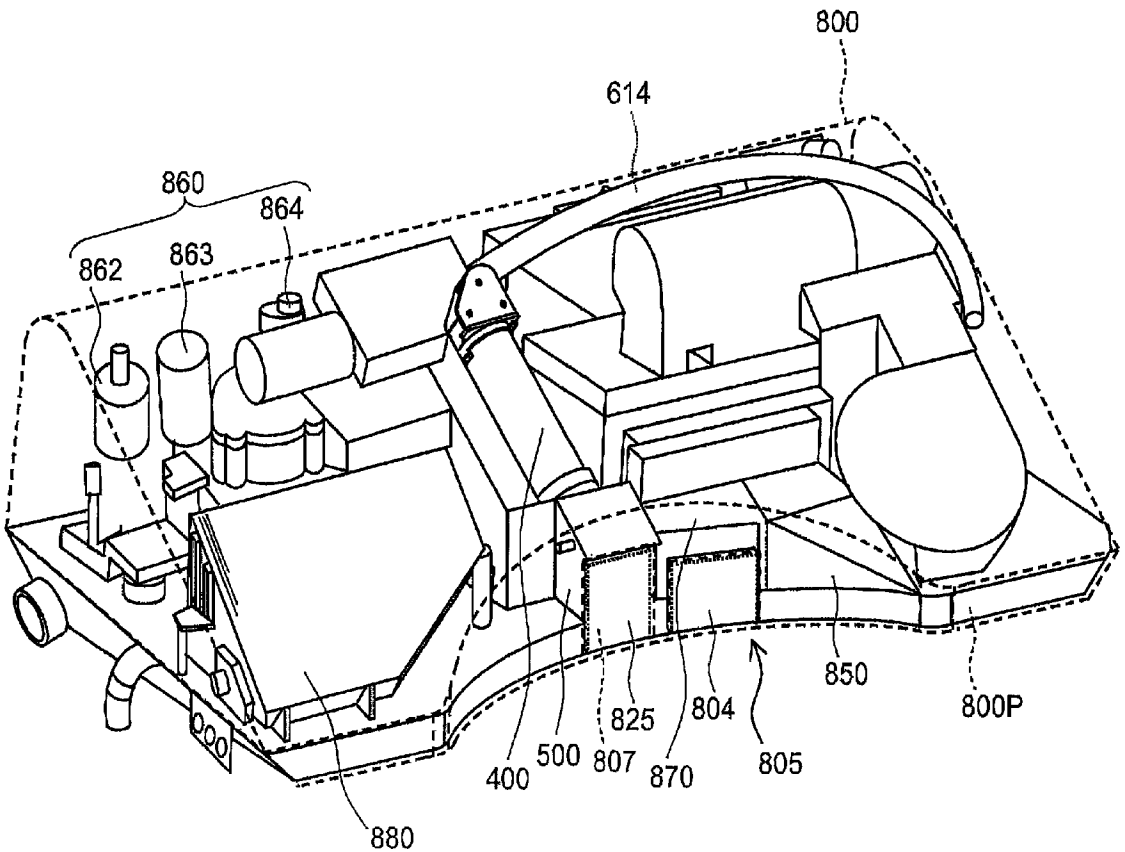
FIG. 36 is a transparent view illustrating the internal structure of the sanitary washing toilet seat device body 800.

FIG. 36 is a transparent view illustrating the internal structure of the sanitary washing toilet seat device body 800 of the first example.

More specifically, the washing nozzle described above with reference to FIGS. 1 to 32 is provided near the center of the sanitary washing toilet seat device body 800. A guiding pipe 612 for housing the flexible rack 610 is provided behind the washing nozzle. On the observers' right of the washing nozzle is provided a warm air dryer 870, which can blow warm air to the "bottom" and the like of a user through a reclosable shutter plate 804. Further on the right side is provided a deodorizer 850. In this example, part of the deodorizer 850 is housed so as to protrude into the right extending portion 800P.

On the other hand, on the observers' left of the washing nozzle is provided a water channel system 860 for supplying warm water to the washing nozzle. This water channel system 860 illustratively includes a valve unit 862, a heat exchange unit 863, and a flow control unit 864. A control board 880 is incorporated in front of the water channel system 860. The control board 880 includes an electrical circuit for controlling various components of the sanitary washing toilet seat device. By placing the control board 880 above the water channel system 860, a short circuit and electrical leakage can be prevented in case of due condensation and unlikely water leakage. Furthermore, by allowing the control board 880 to protrude into the left extending portion 800P, the limited housing space can be effectively used.

In the housed state, the washing nozzle described above with reference to FIGS. 1 to 32 is housed behind the shutter plate 825. The shutter plate 825 is normally biased by a spring (not shown) or the like, for example, to a position with the opening 807 closed. When the washing nozzle advances, the shutter plate 825 is pushed by the washing nozzle and opens against the biasing force. Alternatively, the shutter plate 825 can be opened/closed using an actuator or the like.

According to this example, the multistage design of the washing nozzle allows it, in the housed state, to be compactly housed in the sanitary washing toilet seat device body 800. On the other hand, after washing the "bottom" and the like of a user, the surface of the nozzle head 100 and the cylinders 200, 300 can be evenly cleaned. In particular, in this example, the front face of the sanitary washing toilet seat device body 800 does not cover the bowl 910, but is provided so as to be generally continuous to or set back from (in the direction away from the bowl 910) the curved sidewall of the opening of the bowl 910. Hence, the depth of the sanitary washing toilet seat device body 800 needs to be shortened. In this regard, the washing nozzle of this example is illustratively based on the three-stage structure, which allows it to be compactly housed in the sanitary washing toilet seat device body 800 having a limited depth. Furthermore, the three-stage design of the washing nozzle allows the water discharge port at its tip to be advanced sufficiently far from the front face 805 of the sanitary washing toilet seat device body 800 and squirt wash water reliably to the "bottom" and the like.

Furthermore, after use, the surface of the washing nozzle body can be evenly cleaned. Thus, it is possible to provide a sanitary washing toilet seat device which is always kept clean, saves the trouble of cleaning, and is resistant to malfunction, failure and the like.

In the foregoing, an example overall configuration of the sanitary washing device of this embodiment has been described.

Next, another variation of the washing nozzle that can be used in this embodiment is described. In this variation, the water supply tube connected to the nozzle head 100 is bent and in pressure contact with the cylinder inner wall or the stopper to produce a frictional force. This can apply a driving force for retraction to the cylinders, and each cylinder can be retracted in a prescribed order.

FIG. 37 is a schematic cross-sectional view for conceptually describing the motion of the washing nozzle of this variation. In this variation, one end of the water supply tube 180 is connected to the nozzle head 100. The water supplied through the water supply tube 180 is discharged from the water discharge port 150 provided in the nozzle head 100. The water supply tube 180 is pulled out backward from the second cylinder 300 via through holes 225, 325 of the stoppers 220, 320 provided in the first and second cylinder, respectively, is folded back forward (toward the nozzle head 100), and is connected to a water supply terminal 186 fixed adjacent to the base 700. It is noted that the water supply tube 180 is made of resin or other material having both flexibility and elasticity, such as nylon.

It is noted that this variation does not include the third cylinder 400 described above with reference to FIG. 1 and the like. In contrast, a depression (not shown) provided in the stopper 320 of the second cylinder 300 is fitted into a rail (not shown) provided on the base 700 so that the second cylinder 300 is slidably supported relative to the base 700.

Figure 37A:
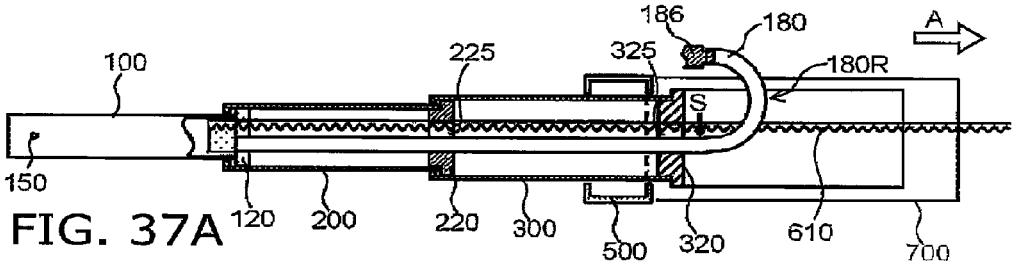
FIGS. 37A to 37D are schematic cross-sectional views for conceptually describing the motion of the washing nozzle of this variation.

From the extended state of the washing nozzle as shown in FIG. 37A, when the flexible rack 610 is pulled back in the direction of arrow A, the nozzle head 100 and the water supply tube 180 connected thereto start to retract. At this time, because the water supply tube 180 is folded back behind the nozzle, its bending portion 180R is subjected to a force to expand it outward. Hence, the water supply tube 180 is in pressure contact with the inner wall of the through hole 325 of the stopper 320 in the direction of arrow S, producing a relatively large frictional force between the water supply tube 180 and the stopper 320. This frictional force allows the water supply tube 180 to apply a driving force for retraction to the stopper 320. In the case where this frictional force is larger than the frictional force produced between the second cylinder 300 and the base 700, the second cylinder 300 also starts to retract interlocking with the retracting motion of the water supply tube 180. As introduced later with reference to an example, according to the result of prototyping by the inventor, the frictional force between the water supply tube 180 and the stopper 320 was easily made larger than the frictional force between the second cylinder 300 and the base 700 by bending the water supply tube 180 as shown in FIG. 37.

Figure 37B:
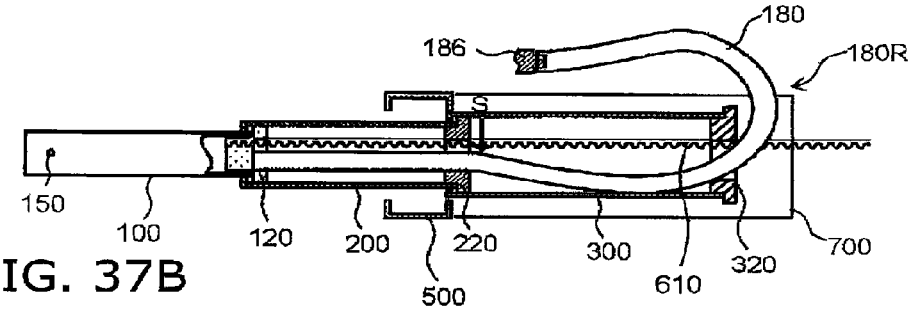

Thus, the frictional force produced between the water supply tube 180 and the stopper 320 is used to apply a driving force for retraction to the second cylinder 300. The second cylinder 300 is retracted to its stroke end as shown in FIG. 37B. At this time, the water supply tube 180 is still bent, subjected to a force to expand it outward. Hence, the water supply tube 180 is in pressure contact with not only the stopper 320, but also the inner wall of the through hole 225 of the stopper 220, in the direction of arrow S.

When the flexible rack 610 is further pulled back in this state, the water supply tube 180 retracts while sliding on the inner wall of the through hole 325 of the stopper 320 because the second cylinder 300 is restrained by the stroke end. The frictional force produced between the water supply tube 180 and the inner wall of the through hole 225 of the stopper 220 applies a driving force for retraction to the stopper 220. In the case where this frictional force is larger than the frictional force produced between the first cylinder 200 and the second cylinder 300, the first cylinder 200 also retracts interlocking with the retraction of the water supply tube 180. Also in this case, according to the result of prototyping by the inventor, the frictional force produced between the water supply tube 180 and the stopper 220 was easily made larger than the frictional force produced between the first cylinder 200 and the second cylinder 300 by bending the water supply tube 180.

Figure 37C:
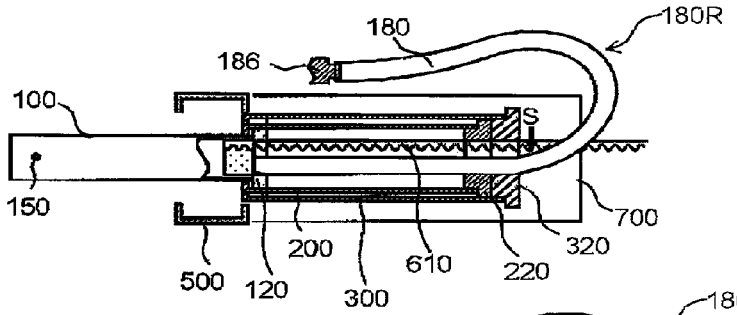
Figure 37D:
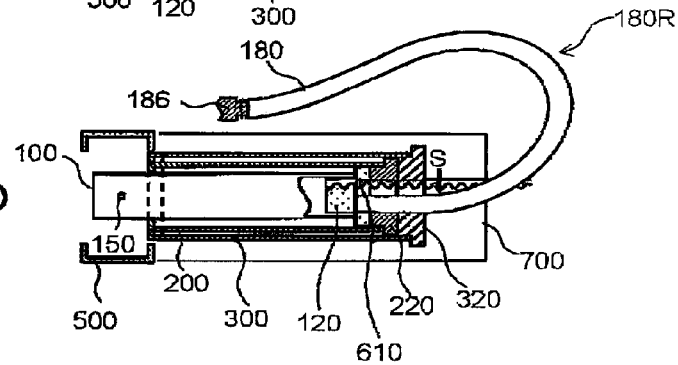

When the first cylinder 200 is retracted to its stroke end as shown in FIG. 37C, the water supply tube 180 retracts while sliding on each inner wall of the through hole 225 of the stopper 220 and the through hole 325 of the stopper 320. Finally, as shown in FIG. 37D, the nozzle head 100 is retracted, and the washing nozzle is completely housed.

As described above, according to this variation, the water supply tube 180 passing through the washing nozzle is bent to produce a frictional force between the water supply tube 180 and the stoppers 320, 220 so that the second cylinder 300, the first cylinder 200, and the nozzle head 100 can be retracted in this order. Hence, the outer periphery of these movable portions can be entirely and evenly cleaned in the nozzle cleaning chamber 500.

In this variation, the water supply tube 180 is in slidable contact with the inner wall of the through holes 325, 225 of the stoppers 320, 220. However, alternatively, the water supply tube 180 can be in slidable contact with the inner wall of the first and second cylinder 200, 300.

Furthermore, in this variation, the water supply tube 180 is bent. However, alternatively, a linear body having both flexibility and elasticity can be connected to the nozzle head 100, passed through the washing nozzle, and bent outside. Such a linear body has the same effect as the water supply tube 180 described with reference to FIG. 37 and can be in slidable contact with the inner wall of the stoppers 220, 320 or the first and second cylinder 200, 300 to produce a suitable frictional force. Consequently, the second cylinder 300, the first cylinder 200, and the nozzle head 100 can be retracted in this order.

Furthermore, the number of water supply tubes or linear bodies provided to produce such a frictional force can be either one or more than one. As described below with reference to an example, providing a plurality of water supply tubes or linear bodies is advantageous in that a larger frictional force is easily obtained.

Next, an example of the washing nozzle shown in FIG. 37 is described.

Figure 38:
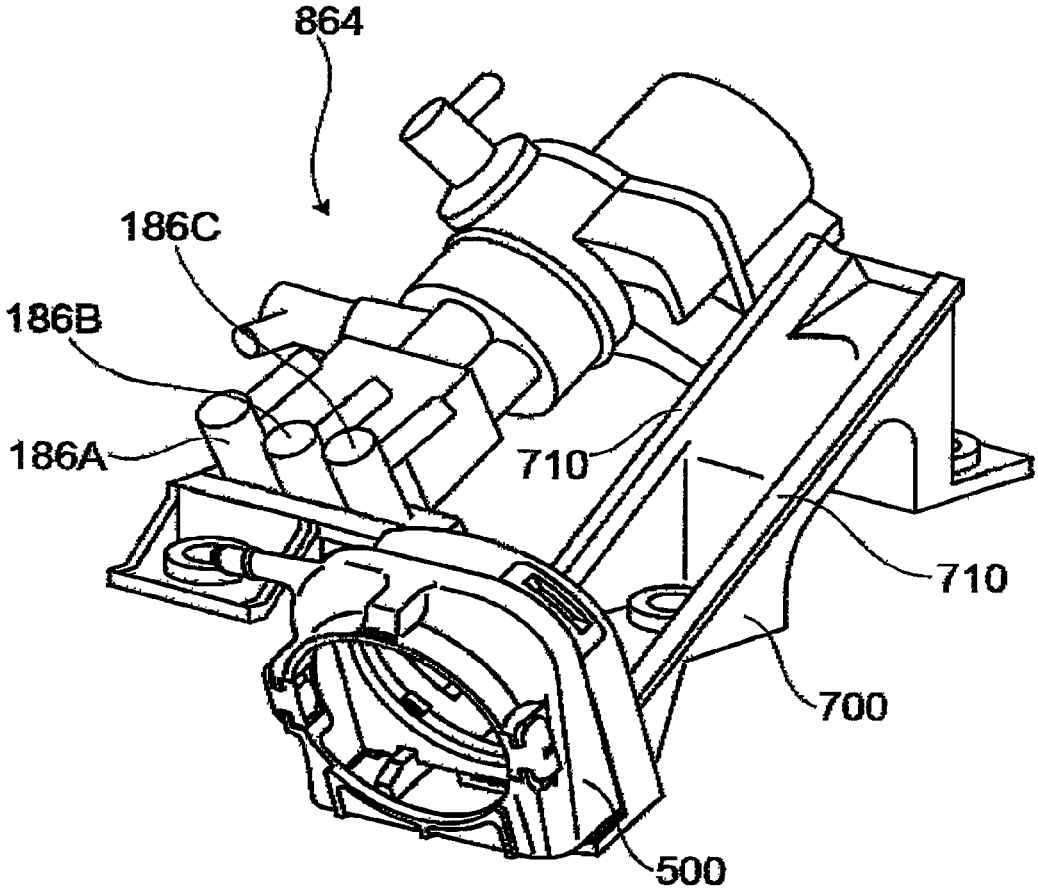
FIG. 38 is an assembly view of the washing nozzle of this example.
Figure 39:
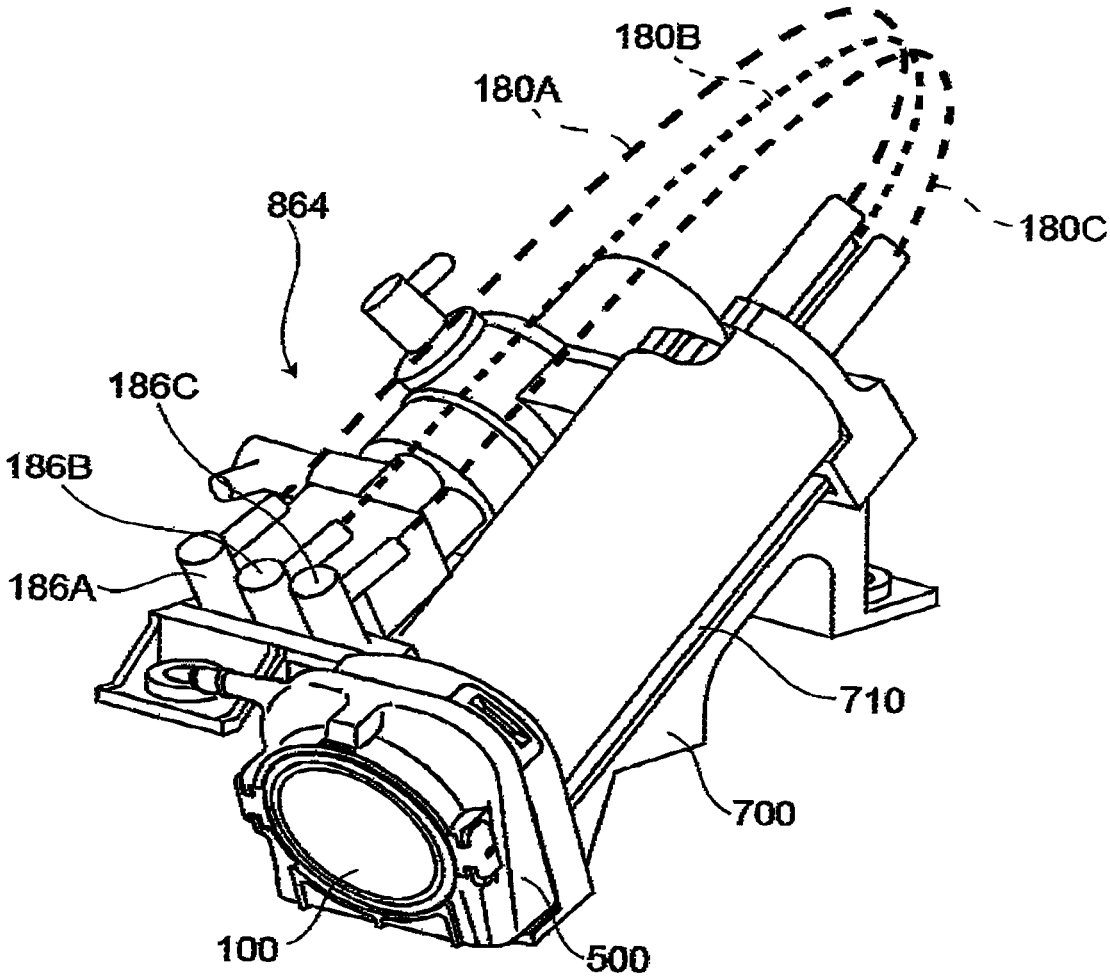
FIG. 39 is an assembly view of the washing nozzle of this example.

FIGS. 38 and 39 are assembly views of the washing nozzle of this example. More specifically, FIG. 38 shows the base 700 before the washing nozzle is installed thereon, and FIG. 39 shows the base 700 with the washing nozzle installed thereon.

A flow control unit 864 is adjacently provided beside the base 700 of the washing nozzle. The flow control unit 864 includes a switching valve for switching between the water supply path to the nozzle head 100 and the water supply path to the nozzle cleaning chamber 500 and adjusting the momentum of water, and a flow path switching valve for switching the modes of water discharge from the water discharge port of the nozzle head 100. Furthermore, it can also include a pulsator for providing pulsation to the momentum of the water discharged from the nozzle head 100. In the example shown in FIG. 38, the flow control unit includes three water supply terminals 186A, 186B, 186C, to which water supply tubes 180A, 180B, 180C are connected, respectively. The water supply terminal 186A supplies water to be discharged for the normal "bottom washing". The water supply terminal 186B supplies water to be discharged for the "bidet washing". The water supply terminal 186C supplies water to be discharged for the "swirl washing". Here, the "swirl washing" is a washing mode of producing a swirling flow in a cavity formed in the nozzle head 100 and spirally discharging water from the tip of a rotator rotated by the swirling flow. In the case where the pulsator is also incorporated in the flow control unit 864, vibration occurs. Hence, the base 700 and the flow control unit 864 are desirably installed inside the sanitary washing device body 800 via antivibration rubber or the like.

On the other hand, rails 710 are provided on both sides of the top of the base 700. As described later in detail, these rails 700 are fitted into depressions of the stopper 320 provided on the second cylinder 300 and slidably support the second cylinder 300.

In this example, three water supply tubes 180A, 180B, 180C are bent and introduced into the washing nozzle. These three water supply tubes are in slidable contact with the stoppers of the washing nozzle, and thereby the retracting motion as described above with reference to FIG. 37 can be reliably performed.

Figure 40:
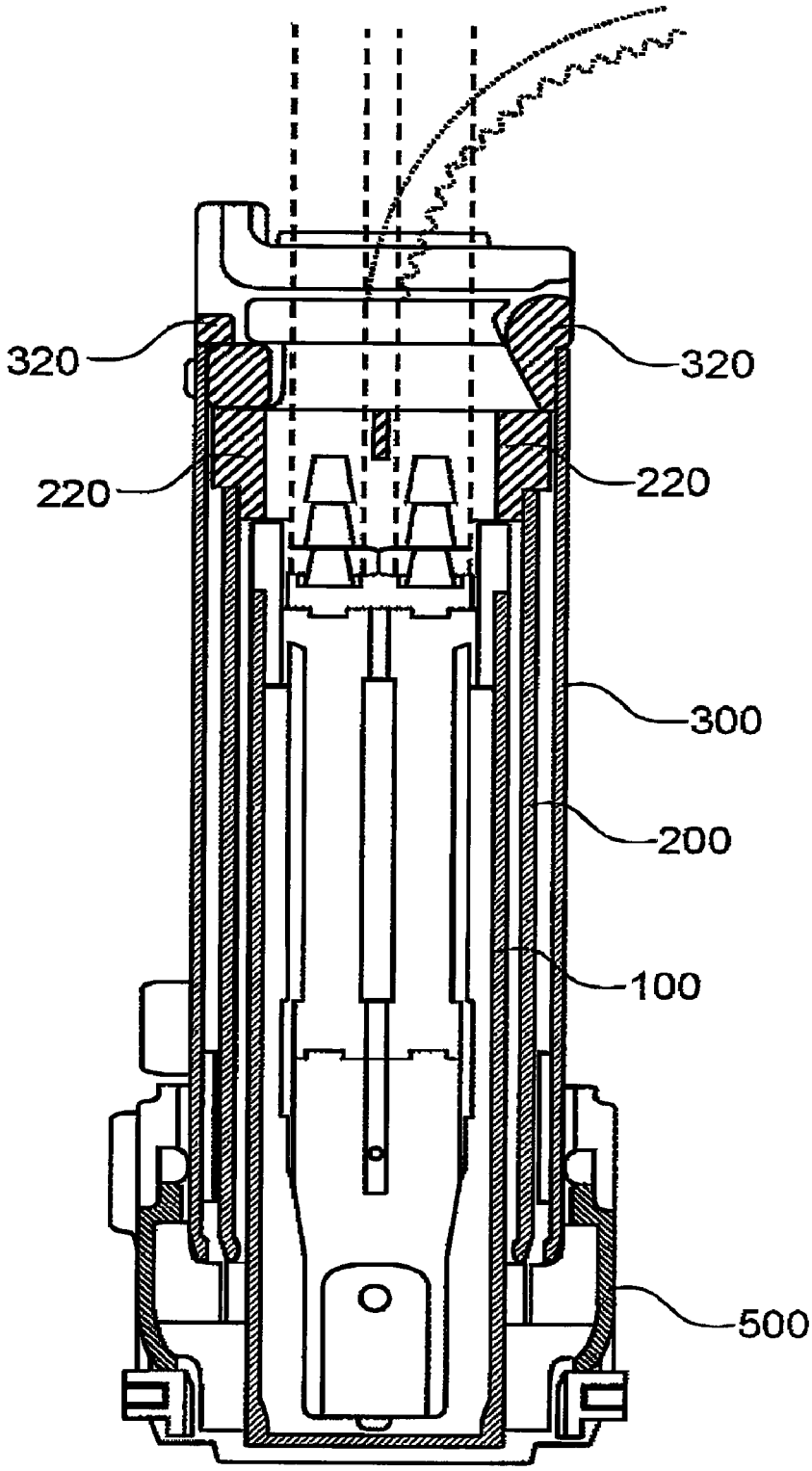
FIG. 40 is a schematic view showing the cross-sectional structure of the washing nozzle of this example.
Figure 41:
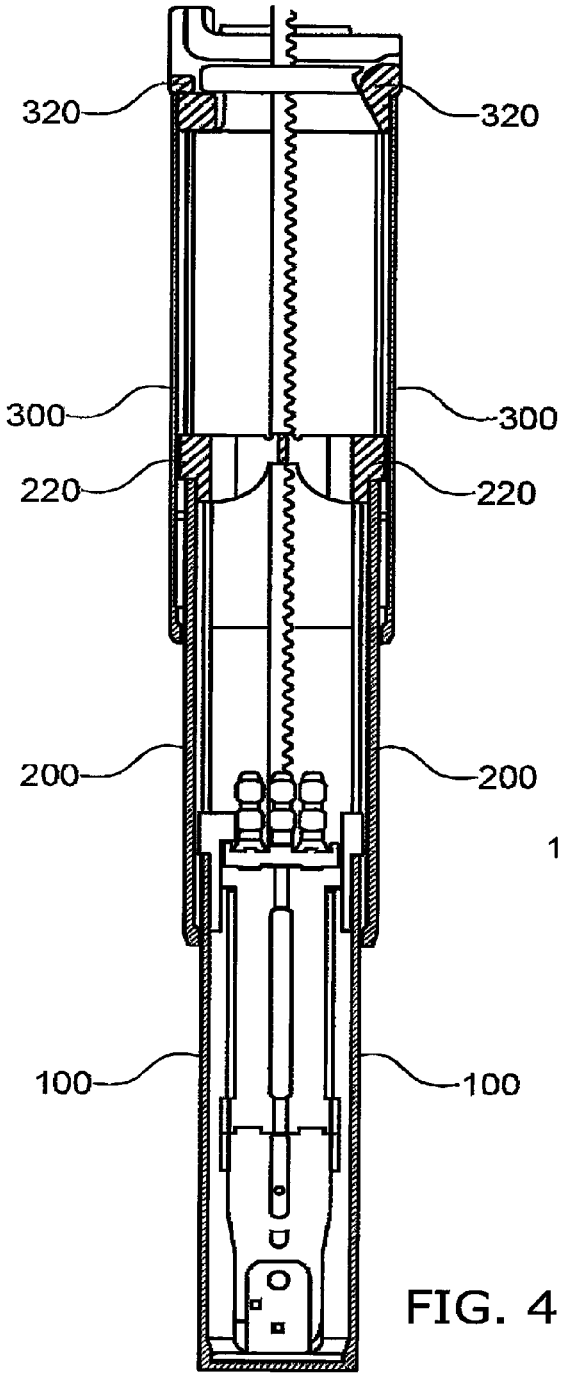
FIG. 41 is a schematic view showing the cross-sectional structure of the washing nozzle of this example.

FIGS. 40 and 41 are schematic views showing the cross-sectional structure of the washing nozzle of this example. More specifically, FIG. 40 shows the housed state of the washing nozzle, and FIG. 41 shows the advanced state of the washing nozzle.

In this structure, the first cylinder 200 and the nozzle head 100 are housed in this order in the second cylinder 300. In the completely housed state of the washing nozzle, the tip portion of the nozzle head 100 is almost housed in the nozzle cleaning chamber 500. A stopper 220 is provided at the rear end of the first cylinder 200, and a stopper 320 is provided at the rear end of the second cylinder 300.

Figure 42:
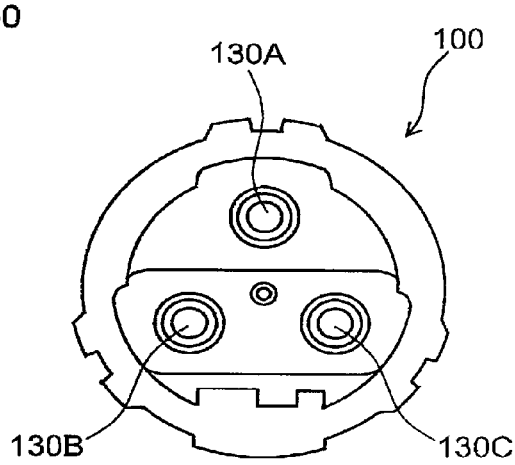
FIG. 42 is a schematic view showing the rear end of the nozzle head 100.

FIG. 42 is a schematic view showing the rear end of the nozzle head 100.

Water inlet terminals 130A, 130B, 130C for connecting the water supply tubes 180A, 180B, 180C, respectively, are provided at the rear end of the nozzle head 100. The water supply tube 180A is connected to the water inlet terminal 130A, which is supplied with wash water for the normal "bottom washing". The water supply tube 180B is connected to the water inlet terminal 130B, which is supplied with wash water for the "bidet washing". The water supply tube 180C is connected to the water Inlet terminal 130C, which is supplied with wash water for the "swirl washing".

Figure 43A:
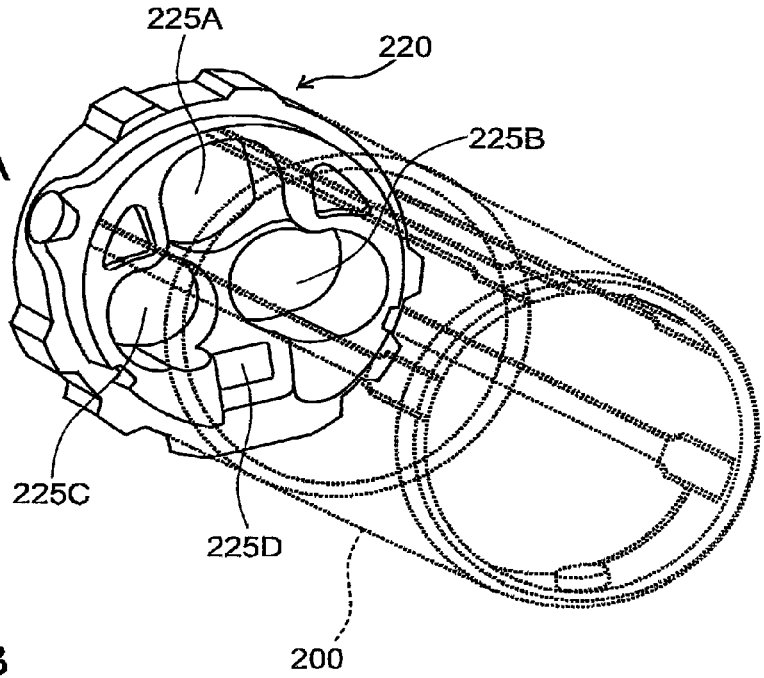
FIGS. 43A and 43B are perspective views of the stopper 220 of the first cylinder 200 as viewed from two directions.
Figure 43B:
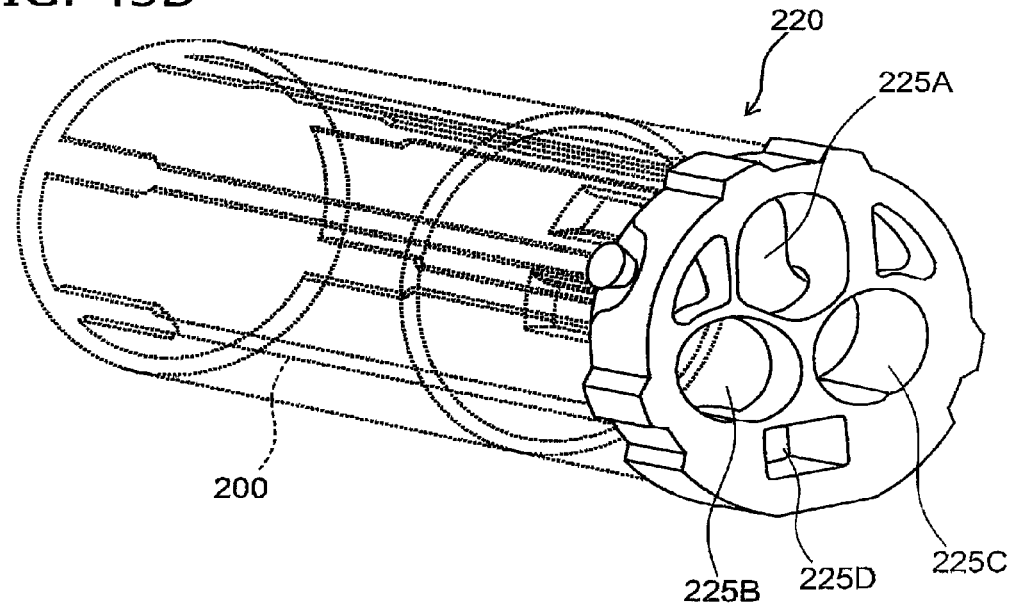

FIGS. 43A and 43B are perspective views of the stopper 220 of the first cylinder 200 as viewed from two directions.

The stopper 220 is provided with four through holes 225A, 225B, 225C, 225D. The water supply tube 180A is inserted into the through hole 225A. The water supply tube 180B is inserted into the through hole 225B, and the water supply tube 180C is Inserted into the through hole 225C. The flexible rack 610 is inserted into the through hole 225D.

The water supply tubes 180A-180C are in slidable contact with the inner wall of the through holes 225A-225C, respectively, to produce a frictional force as described above with reference to FIG. 37. Thus, the first cylinder 200 can be retracted interlocking with the retraction of the water supply tubes 180A-180C.

FIGS. 44A and 44B are perspective views of the stopper 320 of the second cylinder 300 as viewed from two directions.

A notch 300S opened in the bending direction of the water supply tubes 180A-180C is provided at the rear end of the second cylinder 300. The stopper 320 is provided around the notch 300S. The stopper 320 has a single through hole 325. The three water supply tubes 180A-180C and the flexible rack 610 are all suitably Inserted into this through hole 325. Of the three water supply tubes 180A-180C that are bent, the water supply tubes 180A, 180B are particularly in slidable contact with the inner wall of the through hole 325 to produce a frictional force as described above with reference to FIG. 37. Thus, the second cylinder 300 can be retracted interlocking with the retraction of the water supply tubes 180A, 180B.

Furthermore, a pair of opposed depressions 326 are provided in the lower portion of the stopper 320. These depressions 326 are fitted into the rail 710 provided on the base 700 (see FIG. 38) to slidably support the second cylinder 300.

Figure 45:
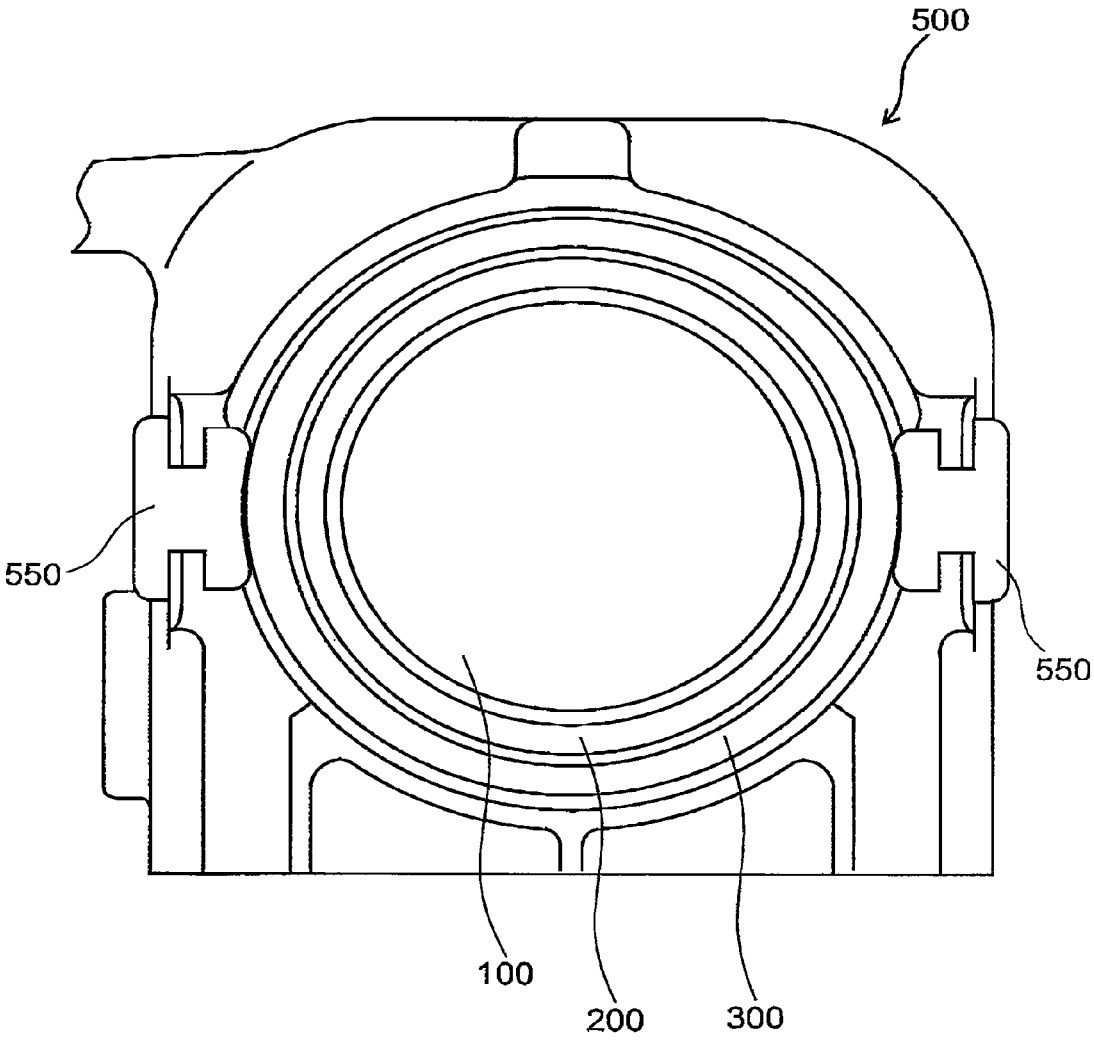
FIG. 45 is a schematic view of the nozzle cleaning chamber 500 as viewed from the front.

FIG. 45 is a schematic view of the nozzle cleaning chamber 500 as viewed from the front.

Figure 46A:
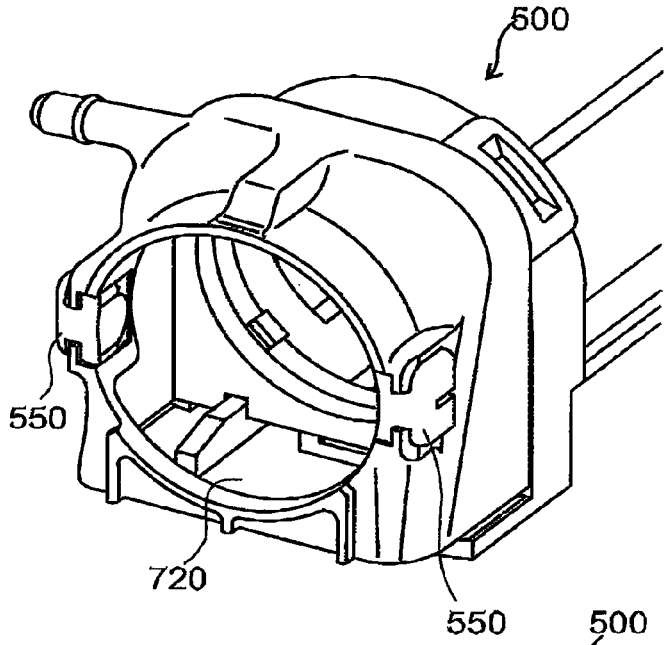
FIGS. 46A and 46B are schematic views of the nozzle cleaning chamber 500 as viewed obliquely from above.
Figure 46B:
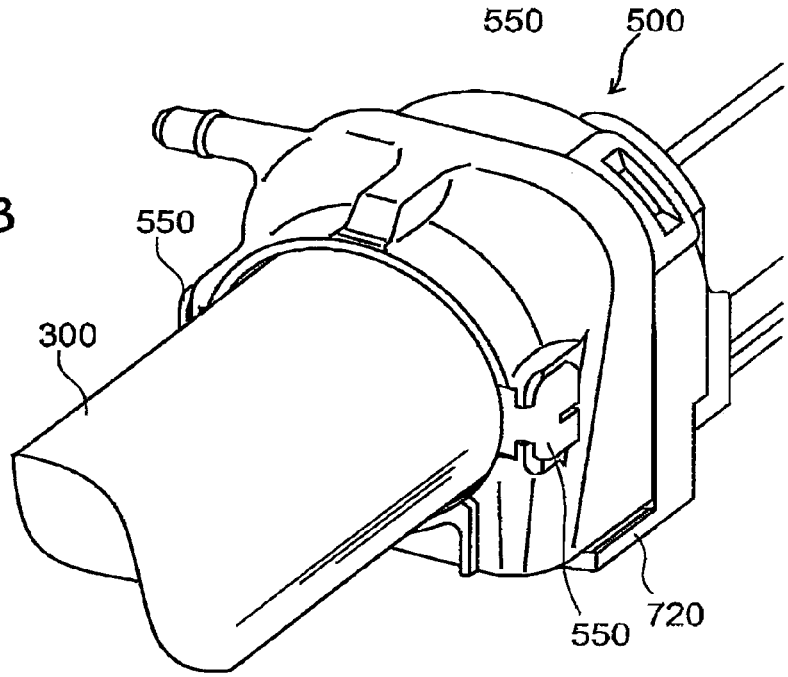

FIG. 46 is a schematic view of the nozzle cleaning chamber 500 as viewed obliquely from above.

The nozzle cleaning chamber 500 in this example is the same as that shown in FIGS. 1, 3, and 4 in being opened at the bottom, but is different from that shown in FIGS. 1, 3, and 4 in surrounding the entire periphery of the washing nozzle at the front. Furthermore, supports 550 are provided on both the left and right side of the nozzle cleaning chamber 500 near its tip.

Figure 47A:
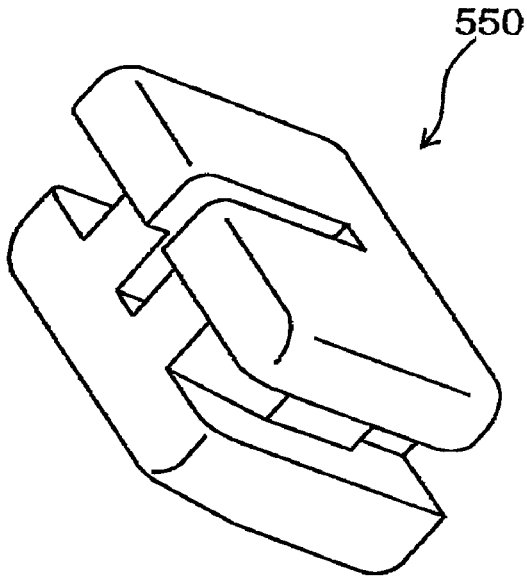
FIGS. 47A and 47B are perspective views of the support 550.
Figure 47B:
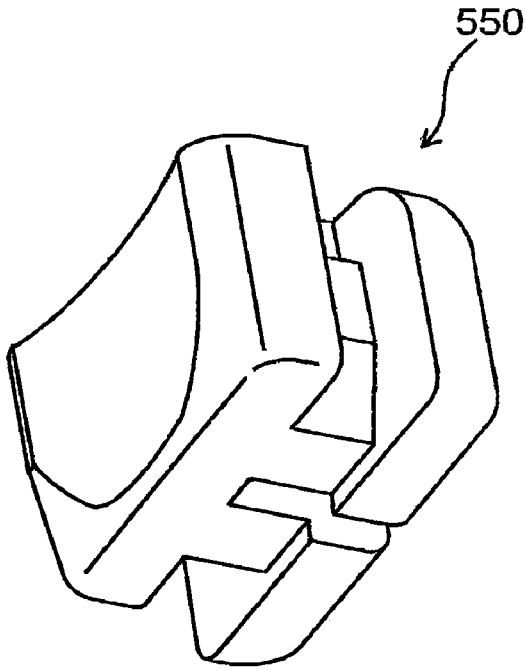

FIG. 47 is a perspective view of the support 550.

The supports 550 can be attached to both sides of the nozzle cleaning chamber 500 illustratively by snap fitting. These supports 550 support the second cylinder 300 from both sides in the extended state of the washing nozzle to serve to prevent horizontal wobbling. Furthermore, when pulsating water is discharged from the nozzle head 100, for example, the washing nozzle may vibrate. In such cases, the supports 550 made of an elastic body such as rubber can absorb vibration to achieve an antivibration effect.

On the other hand, this example includes a protective wall 720 extending forward from the base 700. The protective wall 720 occludes the rear of the opening at the bottom of the nozzle cleaning chamber 500 and serves to prevent wash water discharged in the nozzle cleaning chamber 500 from spattering backward inside the sanitary washing device body 800. Furthermore, when urine or the like enters from the front of the nozzle cleaning chamber 500, for example, the protective wall 720 can prevent the urine or the like from entering the rear inside of the sanitary washing device body 800.

FIGS. 48 to 51 are schematic views showing the retracting motion of the washing nozzle of this example.

Figure 48:
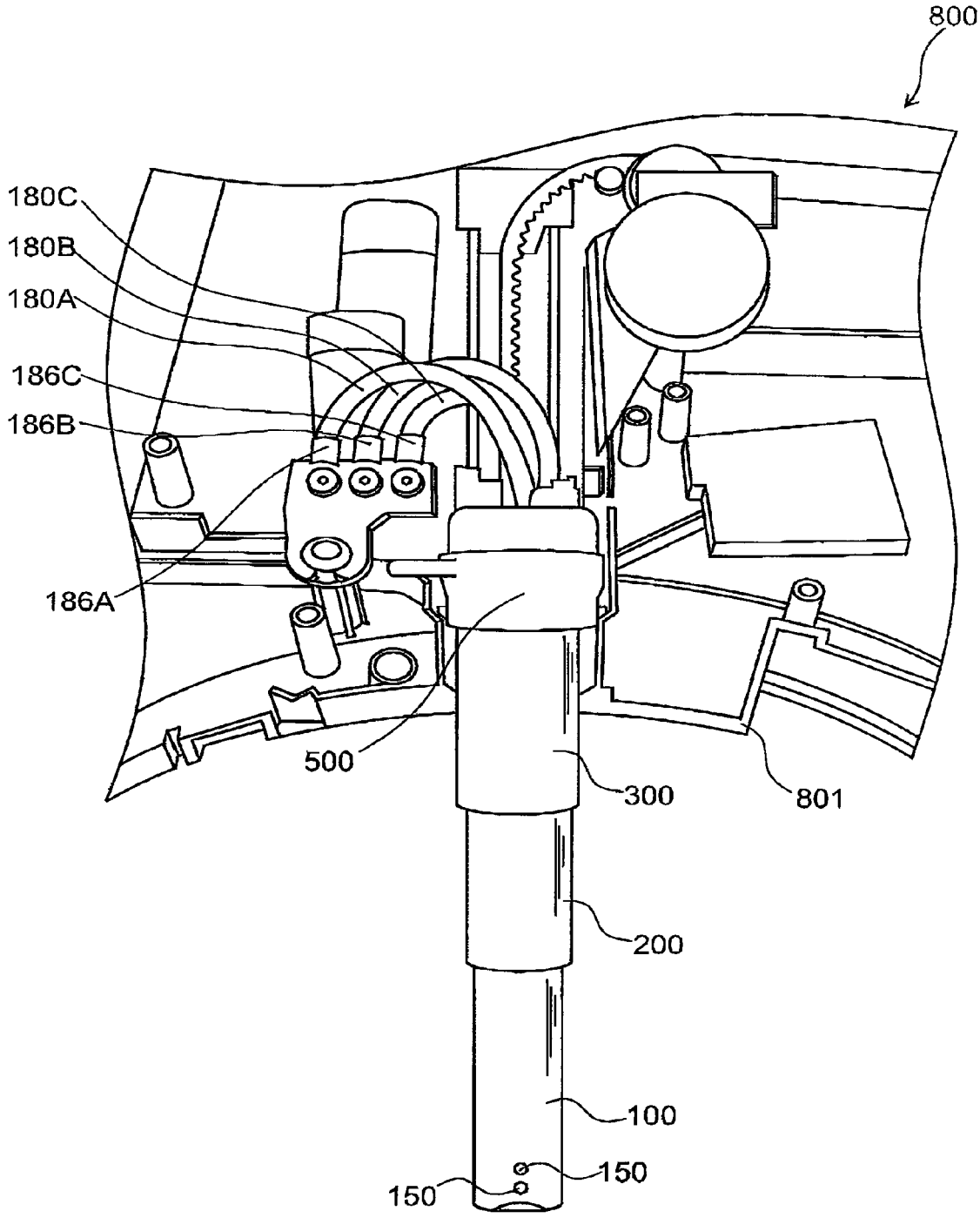
FIG. 48 is a schematic view showing the retracting motion of the washing nozzle of this example.

FIG. 48 shows the completely extended state of the washing nozzle attached to a case plate 801 of the sanitary washing device body 800. In this state, the three water supply tubes 180A-180C connected respectively to the three water supply terminals 186A-186C are greatly bent and pulled into the second cylinder 300. Of these three water supply tubes, in particular, the water supply tubes 180A, 180B located on the outside of the bending portion are in strong pressure contact with the inner wall of the through hole 325 of the stopper 320 of the second cylinder 300 to produce a large frictional force. Hence, when the flexible rack 610 is pulled back for the retracting motion, the second cylinder 300 also starts to retract interlocking with the retracting motion of the water supply tubes 180A, 180B.

Figure 49:
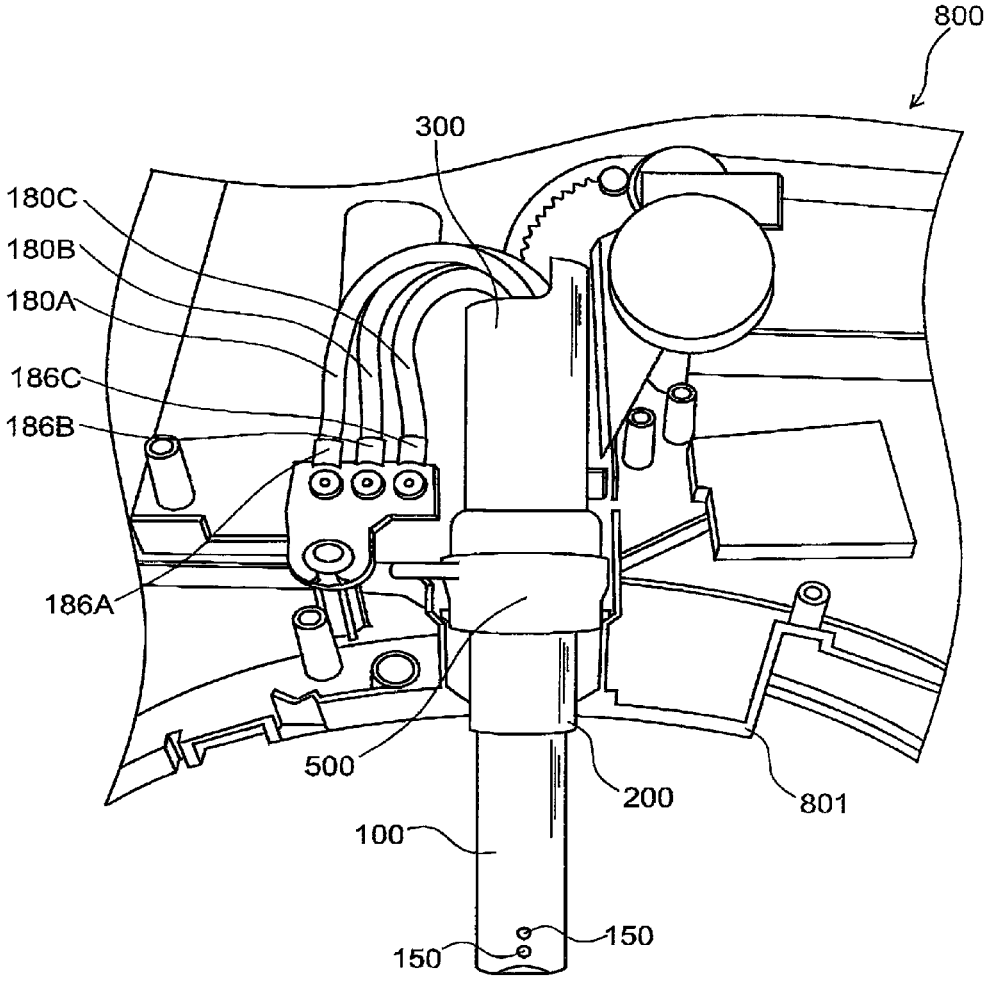
FIG. 49 is a schematic view showing the retracting motion of the washing nozzle of this example.

As the second cylinder 300 retracts, the abutment condition between the inner wall of the through hole 325 of the stopper 320 and the water supply tubes 180A, 180B gradually changes. For example, the water supply tubes 180A, 180B can be configured to scarcely abut the inner wall of the through hole 325 of the stopper 320 when the second cylinder 300 is retracted to the stroke end as shown in FIG. 49. In such a case, little frictional force is produced between the water supply tubes 180A, 180E and the stopper 320. However, at this time, a frictional force is produced between the water supply tubes 180A, 180B and the stopper 220 of the first cylinder 200, and a driving force for retraction is propagated to the first cylinder 200. When the first cylinder 200 is thus retracted, the second cylinder 300 is also interlockingly retracted if the frictional force between the second cylinder 300 and the base 700 is smaller than the frictional force between the first cylinder 200 and the second cylinder 300.

As shown in FIG. 49, when the second cylinder 300 is retracted to its stroke end, the water supply tubes 180A, 180B further continue to retract while sliding on the inner wall of the through hole 325 of the stopper 320. Also at this time, the water supply tubes 180A-180C are greatly bent, and hence subjected to a force to expand them outward. Thus, the water supply tubes 180A-180C are in pressure contact with the inner wall of the through holes 220A-220C (see FIG. 43) of the stopper 220 of the first cylinder 200, respectively, to produce a frictional force. In the case of the stopper 220, a frictional force is produced in each of the three through holes 220A-220C. Hence, a retracting force can be strongly applied to the first cylinder 200 from the three water supply tubes 180A-180C.

Figure 50:
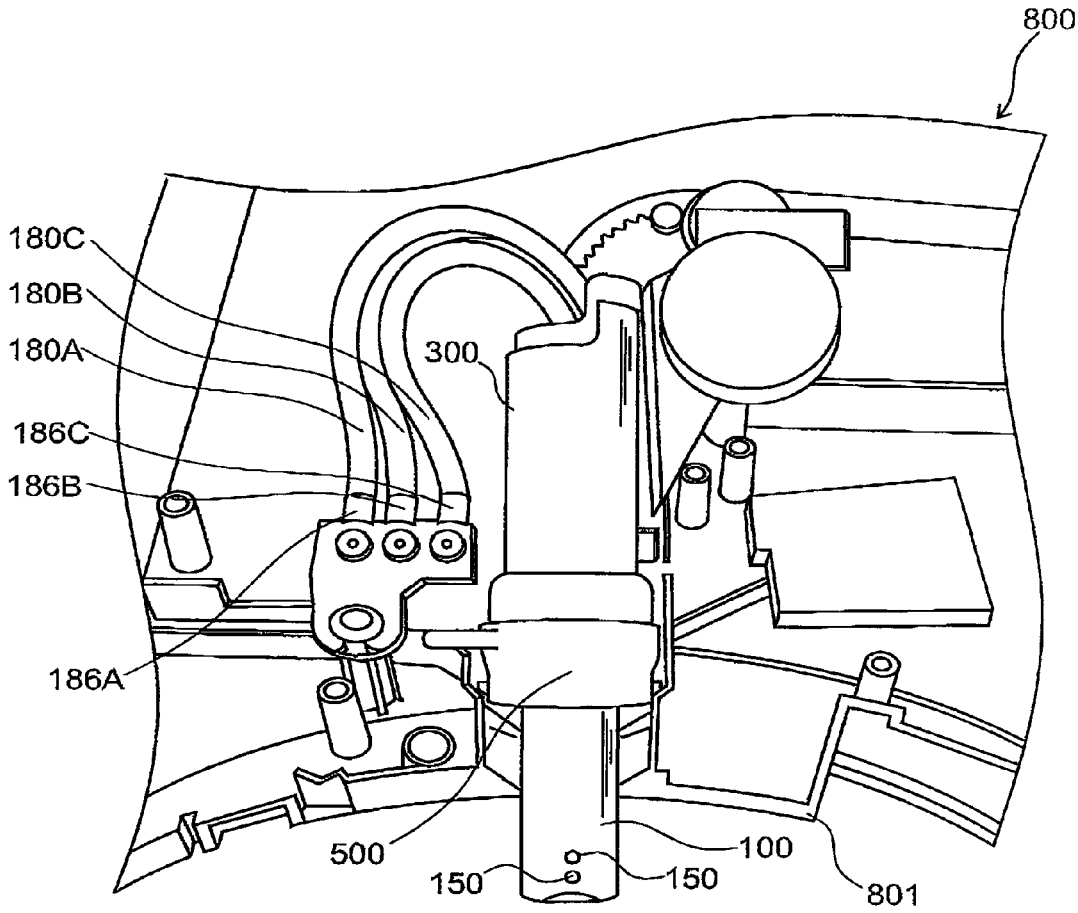
FIG. 50 is a schematic view showing the retracting motion of the washing nozzle of this example.
Figure 51:
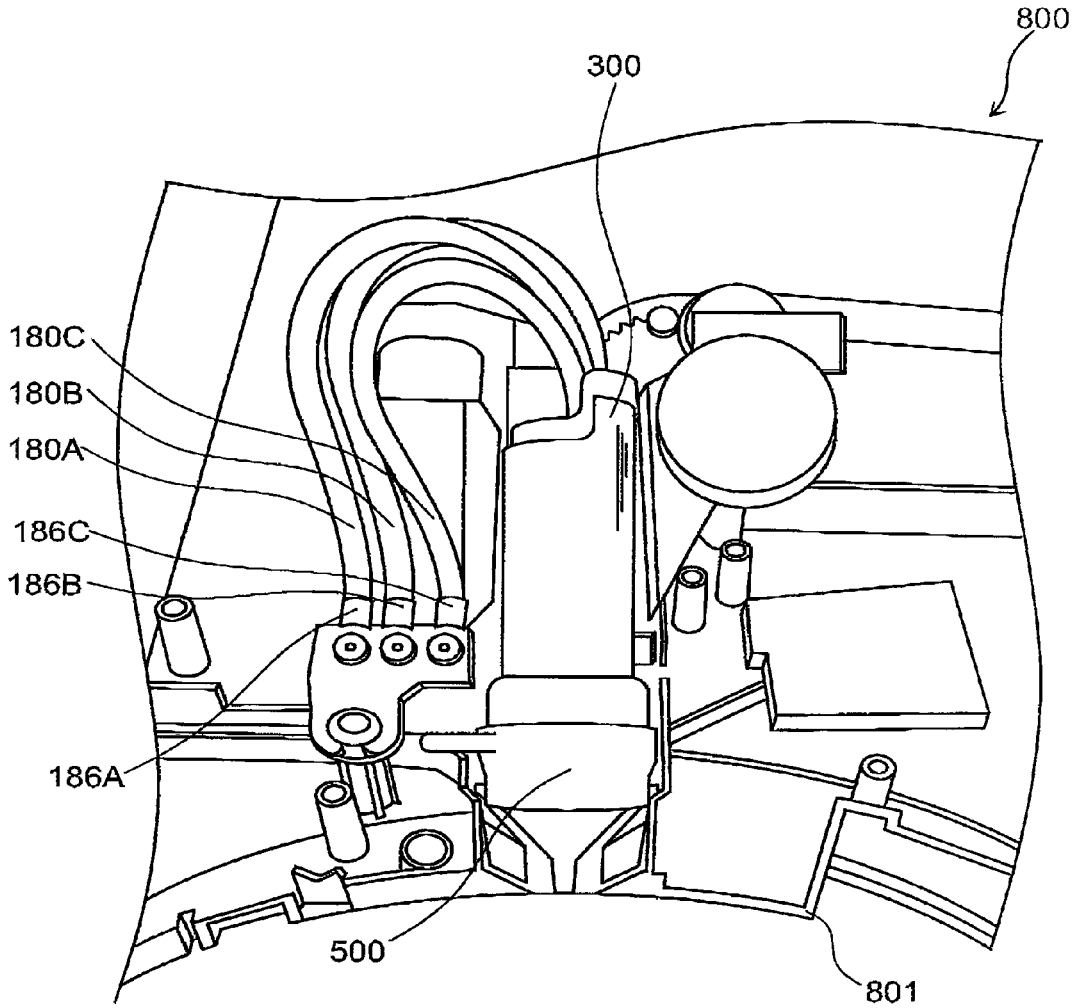
FIG. 51 is a schematic view showing the retracting motion of the washing nozzle of this example.

As shown in FIG. 50, when the first cylinder 200 is retracted to its stroke end, the water supply tubes 180A-180C continue to retract while sliding on the inner wall of the through holes of the stoppers 320, 220. Then, as shown in FIG. 51, the nozzle head 100 is retracted, and the washing nozzle is completely housed.

As described above, the water supply tubes 180A-180C are bent and in slidable contact with the stoppers so that the second cylinder 300, the first cylinder 200, and the nozzle head 100 can be retracted in this order.

It is noted that, even in the case where the frictional force between the water supply tubes 180A-180C and the stopper 320 is somewhat smaller, for example, if the frictional force between the nozzle head 100 and the first cylinder 200 and the frictional force between the first cylinder 200 and the second cylinder 300 are larger than the frictional force between the second cylinder 300 and the base 700, then the first cylinder 200 and the second cylinder 300 can be retracted interlocking with the retraction of the nozzle head 100. That is, in this example, the magnitude relationship between the frictional forces of such elements can also be used.

For example, the frictional force between the nozzle head 100 and the first cylinder 200 and the frictional force between the first cylinder 200 and the second cylinder 300 are easily increased in the completely extended state of the washing nozzle. For example, as described above with reference to FIGS. 26 and 27, in the extended state, the depression of the slider can be engaged with the projection of the stopper to obtain a stronger frictional force. That is, when the washing nozzle is retracted from the completely extended state like this, it is easily retracted from the second cylinder 300 in turn. Hence, for example, to retract the washing nozzle, if retraction is started after it is once completely extended, retraction in the order of the second cylinder 300, the first cylinder 200, and the nozzle head 100 may be performed more easily.

The embodiment of the invention has been described with reference to examples. However, the invention is not limited to these examples. For example, the shape, structure, number, layout and the like of the nozzle head and the cylinders can be modified, and such modifications are encompassed within the scope of the invention as long as they are based on the spirit of the invention. For example, it is possible to slide the third cylinder 400 relative to the base 700 so that, when the washing nozzle is advanced, the second cylinder 300 is completely exposed from the nozzle cleaning chamber 500 in the advancing direction.

The features described above with reference to FIGS. 1 to 36 can be combined with each other in any way as long as technically feasible, and sanitary washing toilet seat devices and toilet devices resulting from such combinations are also encompassed within the scope of the invention as long as they are based on the spirit of the invention.

Various elements included in the sanitary washing toilet seat device and the toilet device of the invention such as the deodorizer, warm air dryer, seating sensor, enclosure, remote controller, sit-down toilet bowl, and low tank can be suitably modified in design by those skilled in the art to similarly practice the invention and achieve similar effects, and such modifications are also encompassed within the scope of the invention as long as they are based on the spirit of the invention.

All the other sanitary washing toilet seat devices and toilet devices, which can be implemented by those skilled in the art through suitable design change to the sanitary washing toilet seat device and the toilet device described above as the embodiment of the invention, are also similarly encompassed within the scope of the invention.

Industrial Applicability

According to this invention, in a sanitary washing toilet seat device and a toilet device equipped therewith, a multi-stage washing nozzle can be accurately advanced/retracted.

The invention claimed is:

1. A sanitary washing toilet seat device comprising:

a nozzle head having a water discharge port;

a first cylinder capable of housing at least part of the nozzle head;

a second cylinder capable of housing at least part of the first cylinder; and a driver configured to advance or retract at least one of the nozzle head and the first and second cylinder, the driver including:

a flexible rack with one end connected to the nozzle head;

a motor; and a transmission mechanism configured to transmit rotation of the motor to the flexible rack, and the nozzle head and the cylinder being advanced to a fully extended position and a fully retracted position by the rotation of the motor.

2. The sanitary washing toilet seat device according to claim 1, wherein the flexible rack includes a metal cable and a resin portion covering the cable.

3. The sanitary washing toilet seat device according to claim 1, wherein the nozzle head includes a first stopper which abuts the first cylinder in its advanced state, the first cylinder includes a second stopper which abuts the second cylinder in its advanced state, and when the nozzle head and the first and second cylinder are advanced from a retracted state, the nozzle head advances when the transmission mechanism transmits the rotation of the motor to the flexible rack, the nozzle head and the first cylinder interlockingly advance when the first stopper abuts the first cylinder, and the nozzle head and the first and second cylinder interlockingly advance when the second stopper abuts the second cylinder.

4. The sanitary washing toilet seat device according to claim 1 or 3, further comprising:

a support which slidably supports the second cylinder, wherein a frictional force acting between the first cylinder and the second cylinder is larger than a frictional force acting between the nozzle head and the first cylinder, and a frictional force acting between the second cylinder and the support is larger than the frictional force acting between the first cylinder and the second cylinder.

5. The sanitary washing toilet seat device according to claim 1, further comprising:

a water supply tube configured to supply water to the nozzle head;

a first engaging mechanism provided at the base end of the first cylinder, engaging the flexible rack, and including a first frame having at least two through holes; and a second engaging mechanism provided at the base end of the second cylinder, engaging with the flexible rack, and including a second frame having at least two through holes, wherein the flexible rack passes through one of the two through holes of the first frame and one of the two through holes of the second frame, and the water supply tube passes through another of the two through holes of the first frame and another of the two through holes of the second frame.

6. The sanitary washing toilet seat device according to claim 1, further comprising:

a nozzle cleaning chamber capable of cleaning the nozzle head and the first and second cylinder, wherein the second cylinder, in its advanced state, passes through the nozzle cleaning chamber, and in retracting the nozzle head and the first and second cylinder from the advanced state thereof, the driver interlockingly retracts the nozzle head and the first and second cylinder, then interlockingly retracts the nozzle head and the first cylinder, and then further retracting the nozzle head.

7. The sanitary washing toilet seat device according to claim 6, further comprising:

a first engaging member provided at the base end of the first cylinder and biased to the flexible rack;

a second engaging member provided at the base end of the first cylinder and biased to the flexible rack; and a disengaging member provided near the basal portion of a washing nozzle having at least the nozzle head and the first and second cylinder, the disengaging member exerting an effort in a direction away from the flexible rack, when the nozzle head and the first and second cylinder are retracted from the advanced state thereof, the nozzle head and the first and second cylinder are retracted while the first engaging member engages with the flexible rack and the second engaging member engages with the flexible rack, then the nozzle head and the first cylinder are retracted while the first engaging member engages with the flexible rack and the second engaging member disengages from the flexible rack, and then the nozzle head is further retracted while the first engaging member disengages from the flexible rack.

8. The sanitary washing toilet seat device according to claim 7, wherein, in the retracted state of the nozzle head and the first and second cylinder, the tip portion of the nozzle head protrudes from the first cylinder and is housed in the nozzle cleaning chamber.

9. The sanitary washing toilet seat device according to claim 7, further comprising:

a water supply tube bent and configured to supply water to the nozzle head, wherein one end of the water supply tube is connected to a water supply terminal provided outside the first and second cylinder, the other end of the water supply tube is connected to the nozzle head through the first and second cylinder, and the water supply tube is in slidable contact with the second cylinder so that at least part of the driving force for interlockingly retracting the nozzle head and the first and second cylinder is applied to the second cylinder.

10. The sanitary washing toilet seat device according to claim 1, further comprising:

a first rear member provided at the rear of the nozzle head;

a first front member provided at the front of the first cylinder;

a second rear member provided at the rear of the first cylinder; and a second front member provided at the front of the second cylinder, wherein, when the nozzle head is advanced relative to the first cylinder, the first rear member abuts and engages with the first front member to restrain relative rotation of the nozzle head with respect to the first cylinder, and when the first cylinder is advanced relative to the second cylinder, the second rear member abuts and engages with the second front member to restrain relative rotation of the first cylinder with respect to the second cylinder.

11. The sanitary washing toilet seat device according to claim 10, further comprising:

a first switch to be operated for squirting water from the water discharge port to wash part of a user's body; and a second switch to be operated for cleaning at least part of the nozzle head and the cylinders, wherein, upon operation of the first switch, at least one of the pairs of the front members and the rear members to be engaged therewith is not in engagement, and upon operation of the second switch, all the pairs of the front members and the rear members to be engaged therewith are in engagement.

12. The sanitary washing toilet seat device according to claim 10, wherein each of the rear members has one of an engaging depression and a projection, each of the front members has the other of the engaging depression and the projection, and when the rear member abuts the front member, the engaging depression engages with the projection.

13. The sanitary washing toilet seat device according to claim 10, wherein each of the cylinders has an engaging thread provided in parallel to the advancing direction, each of the rear members has a holding depression, and the nozzle head and the cylinders advance and retract while the holding depression provided on the rear member thereof engages with the engaging thread provided on the cylinder and being adjacent to said holding depression.

14. A toilet device comprising:

a sit-down toilet bowl; and the sanitary washing toilet seat device according to claim 1.

* * * * *

UNITED STATES PATENT AND TRADEMARK OFFICE

CERTIFICATE OF CORRECTION

PATENT NO. : 8,161,580 B2
APPLICATION NO. : 12/278932
DATED : April 24, 2012
INVENTOR(S) : Kenji Hashidume et al.

It is certified that error appears in the above-identified patent and that said Letters Patent is hereby corrected as shown below:

In the specification, column 3, line 30, change “30D” to -- 31D --

In the specification, column 29, line 45, change “180E” to -- 180B --

Signed and Sealed this
Eleventh Day of September, 2012

David J. Kappos

David J. Kappos
*Director of the United States Patent and Trademark Office*